US005188927A

United States Patent [19]

Okada et al.

[11] Patent Number: 5,188,927

[45] Date of Patent: Feb. 23, 1993

[54] COMPOSITION AND PROCESS FOR THE PROCESSING OF SILVER HALIDE COLOR PHOTOGRAPHIC MATERIAL

[75] Inventors: Hisashi Okada; Seki Hiroyuki, both of Minami Ashigara, Japan

[73] Assignee: Fuji Photo Film Co., Ltd., Kanagawa, Japan

[21] Appl. No.: 715,282

[22] Filed: Jun. 14, 1991

[30] Foreign Application Priority Data

| | | | |
|---|---|---|---|
| Jun. 15, 1990 | [JP] | Japan | 2-156683 |
| Sep. 27, 1990 | [JP] | Japan | 2-258539 |
| Nov. 30, 1990 | [JP] | Japan | 2-330776 |

[51] Int. Cl.[5] ..... G032 7/42

[52] U.S. Cl. ..... 430/393; 430/428; 430/460; 430/461

[58] Field of Search ..... 430/372, 393, 428, 430, 430/460, 461

[56] References Cited

U.S. PATENT DOCUMENTS

| | | | |
|---|---|---|---|
| 3,615,508 | 10/1971 | Stephen et al. | 430/393 |
| 3,870,520 | 3/1975 | Shimamura et al. | 430/430 |
| 3,928,040 | 12/1975 | Shumamura et al. | 430/430 |
| 4,268,618 | 5/1981 | Hashimura | 430/393 |
| 4,818,673 | 4/1989 | Ueda et al. | 430/430 |
| 5,063,140 | 11/1991 | Kuse et al. | 430/430 |

FOREIGN PATENT DOCUMENTS

| | | | |
|---|---|---|---|
| 71402 | 2/1983 | European Pat. Off. . | |
| 0196091 | 10/1986 | European Pat. Off. . | |
| 329003 | 8/1989 | European Pat. Off. | 430/393 |
| 2554861 | 6/1976 | Fed. Rep. of Germany . | |
| 2186987 | 8/1987 | United Kingdom . | |

OTHER PUBLICATIONS

Grant Haist: "Modern Photographic Processing", vol. 2, 1979, John Wiley and Sons, Inc., N.Y. USA pp. 576–587.

*Primary Examiner*—Hoa Van Le

*Attorney, Agent, or Firm*—Sughrue, Mion, Zinn, Macpeak & Seas

[57] ABSTRACT

A composition for the processing of a silver halide color photographic material, which comprises at least one metal chelate compound formed of a salt of metal selected from the group consisting of Fe(III), Mn(III), Co(III), Rh(II), Rh(III), Au(III), Au(II) and Ce(IV) and a compound represented by the general formula (I):

(I)

wherein $R_1$, $R_2$, $R_3$, $R_4$, $R_a$, $R_b$, and $R_c$ each represent a hydrogen atom, an aliphatic group or an aromatic group; $R_5$ and $R_6$ each represents a hydrogen atom, an aliphatic group, an aromatic group, a halogen atom, a cyano group, a nitro group, an acyl group a sulfamoyl group, a carbamoyl group, an alkoxycarbonyl group, an aryloxycarbonyl group, a sulfonyl group or a sulfinyl group, or $R_5$ and $R_6$ together may form a 5- or 6-membered ring; $L_1$ represents a divalent aliphatic or aromatic group or a divalent linking group containing at least one of them; $A_1$ represents a carboxyl group, a phosphono group, a sulfo group, a hydroxyl group, or a substituted group thereof (acidic group only) with an alkali metal atom; and t and u each represents an integer 0 or 1; provided that when $R_5$ and $R_6$ together form a 5- or 6-membered ring, $R_1$, $R_2$, $R_3$ and $R_4$ each does not present an aromatic ring, and when $R_5$ and $R_6$ together form a benzene ring, at least one of t and u represents 1, and a process for the processing of a silver halide color photographic material with the processing composition.

20 Claims, No Drawings

COMPOSITION AND PROCESS FOR THE PROCESSING OF SILVER HALIDE COLOR PHOTOGRAPHIC MATERIAL

FIELD OF THE INVENTION

The present invention relates to a composition for the processing of a silver halide color photographic material. More particularly, the present invention relates to a processing composition containing a novel bleaching agent for use in the bleaching step after color development and a process for the processing of a silver halide color photographic material with said processing composition.

BACKGROUND OF THE INVENTION

A silver halide color photographic material (hereinafter referred to as a "color light-sensitive material") is essentially imagewise exposed to light, and then subjected to color development and desilvering.

In the color development process, silver halide grains which have been exposed to light are reduced by a color developing agent to silver, and the resulting oxidation product of the color developing agent reacts with a coupler to form a dye image.

In the subsequent desilvering step, developed silver produced at the development step is oxidized (bleached) with a bleaching agent having an oxidizing power to a silver salt which is then removed from the light-sensitive layer together with unused silver halide grains by a fixing agent which renders these silver salts and silver halide soluble (fixing). Bleaching and fixing may be effected separately as bleaching step and fixing step, or together as a blix step. These processing steps are further described in James, "The Theory of Photographic Process", 4th edition, 1977.

For the purpose of maintaining desired photographic and physical properties of the dye image or for maintaining processing stability, various auxiliary steps may be added to these essential processing steps. Examples of these auxiliary steps include a rinse (with water) step, a stabilizing step, a film hardening step, and a stop step.

These processing steps are normally effected by means of an automatic developing machine. In recent years, small-sized automatic developing machines called "mini-labo" have been installed in retail stores to provide rapid processing services to customers.

Under these circumstances, it has been keenly desired to speed up processing. It has also been desired to considerably speed up the bleaching step.

However, the ferric complex of ethylenediaminetetraacetic acid, which has been heretofore used in the art, is essentially disadvantageous in that its oxidizing power is weak. In spite of some improvements such as the use of bleach accelerators (e.g., addition of mercapto compounds as described in U.S. Pat. No. 1,138,842), the objective, i.e., rapid bleaching has not yet been attained.

Furthermore, when such a bleach accelerator is used, the bleaching power is considerably reduced due to the deterioration of the bleach accelerator, making it impossible to reduce the replenishment rate. As a result, the objective of considerably reducing the amount of waste liquid cannot be attained.

As bleaching agents which can attain rapid bleach there have been known red prussiate, iron chloride, bromate, etc. However, red prussiate cannot be widely used due to problem of environmental protection. Iron chloride cannot be widely used due to the inconvenience of difficult handling due to metallic corrosion. Bromates cannot be widely used due to the solution instability.

It has therefore been desired to provide a bleaching agent which provides for a rapid bleaching that can be effected with ease of handling and without any problem of discharge of waste liquid.

In recent years, ferric complexes of 1,3-diaminopropanetetraacetic acid have been disclosed as bleaching agents which can meet these requirements.

However, these bleaching agents have some disadvantages. One of these disadvantages is that these bleaching agents cause bleach fogging accompanied by bleach. As a process for eliminating bleach fogging there has been proposed a process which comprises the addition of a buffer to the bleaching solution (disclosed, for example, in JP-A-1-213657). (The term "JP-A" as used herein means an "unexamined published Japanese patent application".) However, this improvement leaves much to be desired. In particular, in the case of rapid processing where color development is effected in 3 minutes, heavier bleach fogging can be caused due to the use of a highly active developer.

Further, the use of a processing solution having a bleaching capacity comprising a ferric complex of 1,3-diaminopropanetetraacetic acid causes an increase in stain during storage of the photographic material after processing.

Another problem is that the use of a bleaching solution comprising a ferric complex of 1,3-diaminopropanetetraacetic acid causes an intensification of magenta dye on the dye image portion which leads to a change in gradation during storage after processing.

A further problem is that when a shorter bleaching time is used, even though a bleaching solution comprising a ferric complex of 1,3-diaminopropanetetraacetic acid is used, since cyan dye on the image portion tends to become a leuco dye, the recovery to the original color is inhibited.

It is also a problem that when a processing solution having bleaching capacity comprising a ferric complex of 1,3-diaminopropanetetraacetic acid is used, especially at bleach-fixing step where bleaching and fixing are carried out simultaneously, the stability of the solution is extermely poor. When such a solution is subjected to a continuous processing, desilvering capacity extremely decreases as compared with the starting of the processing, or precipitation forms.

It has therefore been desired to provide a novel processing composition having a bleaching capacity which can substitute for these bleaching agents and a processing method using such a processing composition.

SUMMARY OF THE INVENTION

It is therefore an object of the present invention to provide a processing composition which can be easily handled and causes no environmental problem of waste liquid and a processing method using such a processing composition.

It is another object of the present invention to provide a processing composition having a bleaching capacity excellent in desilvering properties and a processing method using such a processing composition.

It is a further object of the present invention to provide a processing composition having a bleaching capacity which causes little bleach fogging and a processing method using such a processing composition.

It is a further object of the present invention to provide a processing composition having a bleaching capacity which causes little stain with time and a processing method using such a processing composition.

It is a further object of the present invention to provide a processing composition having a bleaching capacity which provides rapid bleaching properties, no deterioration in the recovery to the original color and causes little gradation change with time and a processing method using such a processing composition.

It is a further object of the present invention to provide a processing composition having a bleaching power with an excellent ageing stability and a processing method using the processing composition.

It is a further object of the present invention to provide a processing composition which can stably maintain the above mentioned properties during a continuous processing and a processing method using such a processing composition.

The above and other objects of the present invention will become more apparent from the following detailed description and examples.

The present invention provides a composition for the processing of a silver halide color photographic material, which comprises at least one metal chelate compound formed of a salt of metal selected from the group consisting of Fe(III), Mn(III), Co(III), Rh(II), Rh(III), Au(III), Au(II) and Ce(IV) and a compound represented by the general formula (I):

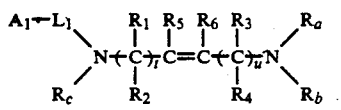

(I)

wherein $R_1$, $R_2$, $R_3$, $R_4$, $R_a$, $R_b$, and $R_c$ each represents a hydrogen atom, an aliphatic group or an aromatic group; $R_5$ and $R_6$ each represents a hydrogen atom, an aliphatic group, an aromatic group, a halogen atom, a cyano group, a nitro group, an acyl group a sulfamoyl group, a carbamoyl group, an alkoxycarbonyl group, an aryloxycarbonyl group, a sulfonyl group or a sulfinyl group, or $R_5$ and $R_6$ together may form a 5- or 6-membered ring; $L_1$ represents a divalent aliphatic or aromatic group or a divalent linking group containing at least one of them; $A_1$ represents a carboxyl group, a phosphono group, a sulfo group, a hydroxyl group, or a substituted group thereof (acidic group only) with an alkali metal atom; and t and u each represents an integer 0 or 1; provided that when $R_5$ and $R_6$ together form a 5- or 6-membered ring, $R_1$, $R_2$, $R_3$ and $R_4$ each does not present an aromatic ring, and when $R_5$ and $R_6$ together form a benzene ring, at least one of t and u represents 1.

The present invention further provides a processing method of a silver halide color photographic material using the composition.

DETAILED DESCRIPTION OF THE INVENTION

In accordance with the present invention, a silver halide color photographic material which has been imagewise exposed to light and color-developed can be processed with a processing composition containing at least a compound of the present invention to effect the bleaching of developed silver at an extremely high rate with no remarkable bleach fogging which has been caused by the prior art bleaching agent which can provide a rapid bleach. This effect can be attained more remarkably when the rapid processing in 3 minutes or less is followed by the processing with a processing composition of the present invention. The composition of the present invention can also provide an excellent image preservability after processing and easy handling.

Further, if the processing composition of the present invention contains an organic acid, the recovery to the original color cannot be worsened, in addition to these effects. This effect can be attained more remarkably when the bleaching step is expedited.

Moreover, when the processing is effected at a reduced replenishment rate of the bleaching solution, the effects of the present invention can be attained remarkably. That is, an excellent image preservability after processing can be provided. An easy handling can also be provided.

The compound represented by the general formula (I) will be further described hereinafter.

In the general formula (I) of the present invention, an aliphatic group includes a straight-chain, branched or cyclic alkyl, alkenyl or alkynyl group, preferably containing 1 to 10 carbon atoms. A preferred example of such an aliphatic group is an alkyl group, particularly $C_{1-4}$ alkyl group.

In the present invention an aromatic group includes a monocyclic or bicyclic aryl group such as a phenyl group and a naphthyl group, preferably a phenyl group.

In the present invention a group having an acyl moiety includes those having an aliphatic and aromatic acyl moiety; a sulfonyl group or a sulfinyl group is a group connected to an aliphatic group or an aromatic group; and sulfamoyl group and a carbamoyl group include unsubstituted groups thereof and aliphatic and aromatic sulfamoyl and carbamoyl groups.

The acyl group, sulfamoyl group, carbamoyl group, alkoxycarbonyl group, aryloxycarbonyl group, sulfonyl group or sulfinyl group represented by $R_5$ or $R_6$ preferably contains 10 or less carbon atoms.

When $R_5$ and $R_6$ do not form a ring $R_1$, $R_2$, $R_3$, and $R_4$ each is preferably a hydrogen atom, and $R_5$ and $R_6$ each is preferably in the cis-position.

$R_1$, $R_2$, $R_3$, $R_4$, $R_5$, $R_6$, $R_a$, $R_b$ and $R_c$ may contain substituents. Examples of such substituents include an alkyl group ($C_{1-6}$: e.g., methyl and ethyl), an aralkyl group ($C_{7-11}$; e.g., phenylmethyl), an alkenyl group ($C_{3-6}$: e.g., allyl), an alkinyl group ($C_{2-6}$), an alkoxy group ($C_{1-6}$: e.g., methoxy and ethoxy), an aryl group ($C_{6-13}$: e.g., phenyl and p-methylphenyl), an unsubstituted amino group, an aliphatic or aromatic amino group ($C_{1-12}$: e.g., dimethyl amino), an acylamino group ($C_{2-13}$ e.g., acetylamino), a sulfonylamino group ($C_{1-13}$: e.g., methanesulfonylamino), a ureido group ($C_{1-13}$), a urethane group (alkoxycarbonylamino, aryloxycarbonylamino and amino carbonyloxy: $C_{2-13}$), an aryloxy group ($C_{6-13}$: e.g., phenyloxy), a sulfamoyl group ($C_{1-13}$: e.g., methylsulfamoyl), a carbamoyl group ($C_{1-13}$: e.g., carbamoyl and methylcarbamoyl), an alkylthio group ($C_{1-6}$: e.g., methylthio), an arylthio group ($C_{6-13}$: e.g., phenylthio), a sulfonyl group ($C_{1-13}$: e.g., methanesulfonyl), a sulfinyl group ($C_{1-13}$: e.g., methanesulfinyl), a hydroxy group, a halogen atom (e.g., Cl, Br, and F), a cyano group, a sulfo group, a carboxy group, a phosphono group, an aryloxycarbonyl group ($C_{7-14}$: e.g., phenyloxycarbonyl), an acyl group ($C_{2-4}$: e.g., acetyl and benzoyl), an alkoxycarbonyl group ($C_{2-14}$: methoxycarbonyl), an acyloxy group ($C_{2-14}$: e.g., acetoxy), a carbonamide group ($C_{2-14}$), a sulfonamide group ($C_{1-}$ 13), and a nitro group (in the parentheses preferred carbon numbers and preferred groups are shown). These groups may be further substituted with these groups.

Preferred examples of substituents to be contained in $R_a$, $R_b$ and $R_c$ include carboxyl group, phosphono group, sulfo group, and hydroxyl group, more preferably carboxyl group and hydroxyl group, particularly carboxyl group. The hydrogen atom in acidic groups herein may be substituted with an alkali metal atom such as Na and K.

$R_1$, $R_2$, $R_3$, $R_4$, $R_5$, $R_6$, $R_a$, $R_b$, $R_c$, and $L_1$ may be connected to each other to form a ring.

$L_1$ represents an aliphatic group, aromatic group or a divalent linking group containing at least one of them. Preferred examples of such a divalent linking group include an alkylene group (preferably $C_{1-10}$ alkylene group), an arylane group (preferably $C_{6-10}$ arylene group), an aralkylene group (preferably $C_{7-10}$ aralkylene group), —O—, —S—,

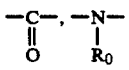

(in which $R_0$ is a hydrogen atom, aliphatic group, aromatic group or hydroxyl group , —$SO_2$—, and group formed of a combination of alkylene group and arylene group. A combination of these groups may be used. These divalent linking groups may have substituents. Examples of such substituents include those described with reference to $R_1$.

$L_1$ may be preferably represented by the general formula ($L_1$):

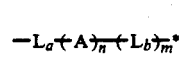

($L_1$)

wherein $L_a$ and $L_b$ each represents an alkylene group, an aralkylene group or an arylene group; and A represents —O—, —S—,

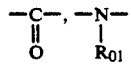

(in which $R_{01}$ represents a hydrogen atom, an aliphatic group, an aromatic group or hydroxyl group), —$SO_2$— or a group formed of a combination thereof.

The suffixes m and n each represents an integer 0 or 1. The symbol * indicates the position at which $L_1$ is connected to $A_1$. Specific preferred examples of $L_1$ will be set forth below.

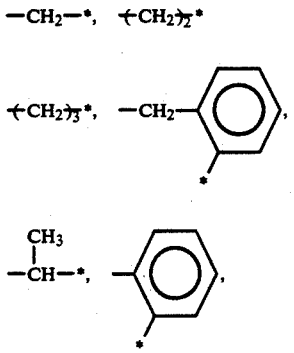

-continued

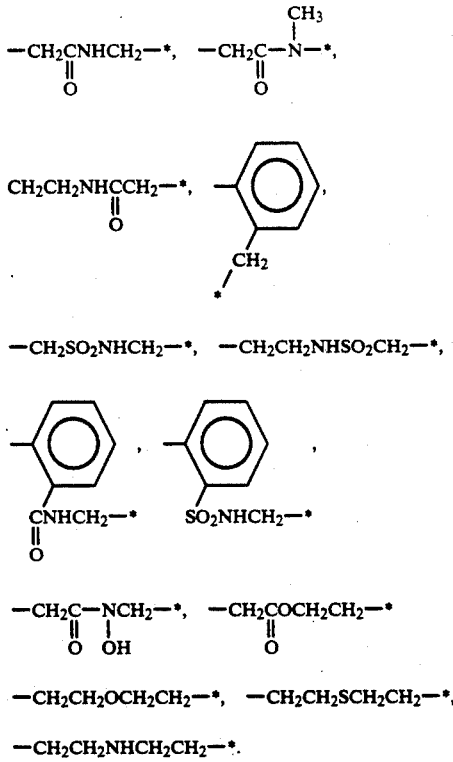

$L_1$ is preferably a group represented by the general formula ($L_1$) wherein n and m each represents 0, more preferably methylene group or ethylene group.

$A_1$ represents a carboxyl group, phosphono group, sulfo group or hydroxyl group. $A_1$ is preferably a carboxyl group or hydroxyl group, more preferably a carboxyl group. The hydrogen atom of the acidic groups herein may be substituted with an alkali metal atom such as sodium and potassium metal atom.

The suffixes t and u in general formula (I) each represents an integer 0 or 1. At least one of t and u is preferably 1. In particular, t and u both preferably represent an integer of 1.

In the present invention, chelate compounds represented by the general formula (II) may be preferably used.

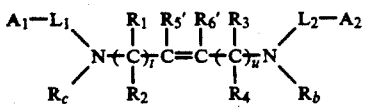

(II)

wherein $R_1$, $R_2$, $R_3$, $R_4$, $R_b$, $R_c$, $A_1$, $L_1$, t and u are as defined in the general formula (I); $L_2$ has the same meaning as $L_1$ in the general formula (I); $A_2$ has the same meaaning as $A_1$ in the general formula (I), and $R_5'$ and $R_6'$ has the same meaning as $R_5$ and $R_6$ with the proviso that $R_5'$ and $R_6'$ are not connected to each other to form a ring.

Preferred among the groups represented by the general formula (II) is one represented by the general formula (III):

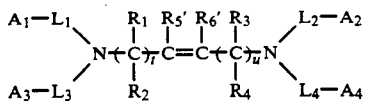

(III)

wherein $R_1$, $R_2$, $R_3$, $R_4$, $R_5'$, $R_6'$, $A_1$, $A_2$, $L_1$, $L_2$, t and u are as defined in the general formula (II); $L_3$ and $L_4$ each has the same meaning as $L_1$ in the general formula (I); and $A_3$ and $A_4$ each has the same meaaning as $A_1$ in the general formula (I).

Among compounds represented by general formula further compounds which can be preferably used in the persent invention are compounds represented by general formula (IV):

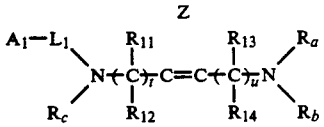

(IV)

wherein Z represents a nonmetallic atom group which forms a 5- or 6-membered ring; $A_1$, $L_1$, $R_a$, $R_b$, $R_c$, t and u each has the same meaning as those of general formula (I); $R_{11}$, $R_{12}$, $R_{13}$ and $R_{14}$ each represents a hydrogen atom, or an aliphatic group, provided that when the ring formed by Z is a benzene ring, at least one of t and u is 1.

Examples of the 5- or 6-membered ring represented by

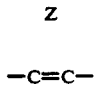

include aromatic ring (e.g., benzene, naphthalene, phenanthrene, anthracene), heterocyclic group preferably containing at least one of N, O and S atoms as a hetro atom (e.g., pyridine, pyrazine, pyrimidine, pyridazine, thiophene, furane, pyran, pyrrole, imidazole, pyrazole, isothiazole, isooxazole, thianthrene, isobenzofurane, chromene, xanthene, phenoxathiin, indolidine, isoindole, indole, imidazole, quinolidine, isoquinoline, quinoline, phthalazine, naphthyridine, quinoxaline, quinazoline, cinnoline, pterindine, carbazole, carboline, phenanthridine, acridine, pteridine, phenanthroline, phenazine, phenothiazine, phenoxazine, chroman, · pyroline, pyrazoline, indoline, isoindoline), and cyclic alkene (e.g., cyclopentyl, cyclohexene). These rings may be condensed with other rings, such as those disclosed above.

Preferred among the rings represented by

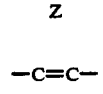

are benzene, naphthalene, pyridine, pyrazine, pyrimidine, quinoline, and quinoxaline. Particularly preferred among these rings is benzene.

The ring represented by

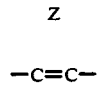

may contain at least one substituent disclosed for $R_1$.

$L_1$ is preferably a $C_{1-4}$ alkylene group, $C_{6-12}$ arylene group or a group containing a combination thereof, more preferably methylene group or ethylene group, particularly methylene group.

$A_1$ represents a carboxyl group, phosphono group, sulfo group or hydroxyl group. The hydrogen atom in the acidic group represented by $A_1$ may be substituted with an alkali metal atom such as Na and K. $A_1$ is preferably a carboxyl or hydroxyl group, particularly carboxyl group.

$R_{11}$, $R_{12}$, $R_{13}$ and $R_{14}$ may be the same or different and each independently represents a hydrogen atom, or an aliphatic group (preferably an alkyl group). The total carbon number of these groups is preferably 1 to 13. The alkyl groups represented by $R_{11}$ to $R_{14}$ may be substituted by substituents as set forth with reference to $R_1$. $R_{11}$, $R_{12}$ $R_{13}$ and $R_{14}$ each is preferably a hydrogen atom.

Ra, Rb and Rc may be the same or different and each independently represents a hydrogen atom, an aliphatic group (preferably an alkyl group) or an aromatic group (preferably an aryl group).

The alkyl group represented by Ra, Rb or Rc may be straight-chain, branched or cyclic and preferably contains 1 to 10 carbon atoms. Preferred examples of such an alkyl group include methyl group and ethyl group. The aryl group represented by Ra, Rb or Rc preferably contains 6 to 10 carbon atoms and is more preferably a phenyl group.

The alkyl or aryl group represented by Ra, Rb or Rc may be substituted by substituents as set forth with reference to $R_1$. Preferred examples of such substituents include a carboxyl group, a phosphono group, a sulfo group, a hydroxyl group and substituted groups thereof (acidic group only) with an alkali metal atom (e.g., Na and K). More preferred among these substituents are carboxyl group and hydroxyl group. Particularly preferred among these substituents is carboxyl group. Ra, Rb and Rc may be connected to each other to form a ring ($R_a$ and $R_b$ or $R_a$ and $R_c$).

The suffix t and each represents an integer 0 or 1. At least one of t and u is preferably 1. Particularly, t and u both represents 1.

The compound which can be more preferably used in the present invention is a compound represented by the general formula (V):

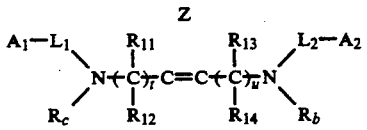

(V)

wherein Z, $A_1$, $L_1$, $R_{11}$, $R_{12}$, $R_{13}$, $R_{14}$, $R_b$, $R_c$, t, and u are as defined in the general formula (IV); $L_2$ has the same meaning as $L_1$ in the general formula (IV); and $A_2$ has the same meaning as $A_1$ in the general formula (IV).

More preferred compounds are those represented by the general formula (VI):

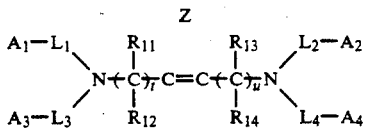

(VI)

wherein Z, $A_1$, $L_1$, $R_{11}$, $R_{12}$, $R_{13}$, $R_{14}$, t, and u are as defined in the general formula (IV); $L_2$, $L_3$ and $L_4$ each has the same meaning as $L_1$ in the general formula (IV); and $A_2$, $A_3$ and $A_4$ has the same meaning as $A_1$ in the general formula (IV).

Specific examples of the compound represented by the general formula (I) will be set forth below, but the present invention should not be construed as being limited thereto.

1.

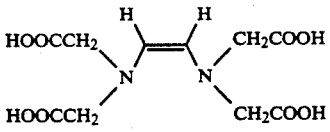

2.

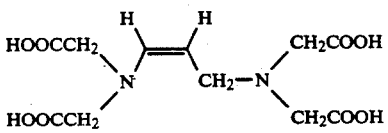

3.

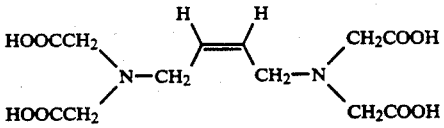

4.

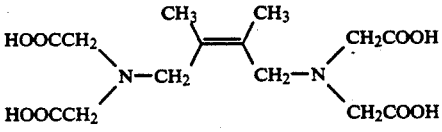

5.

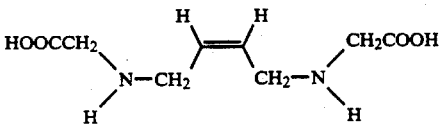

6.

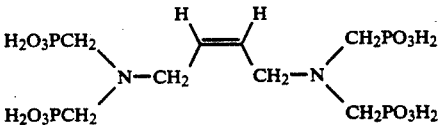

7.

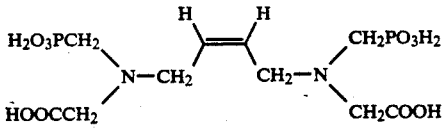

8.

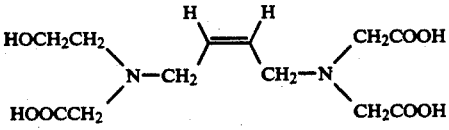

9.

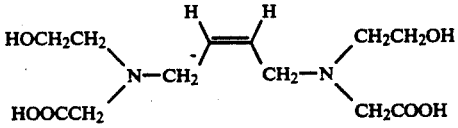

10.

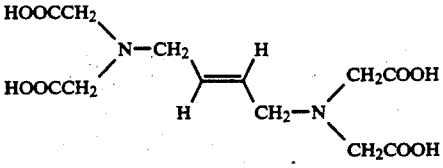

-continued
11.
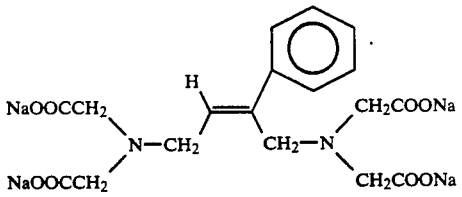
12.
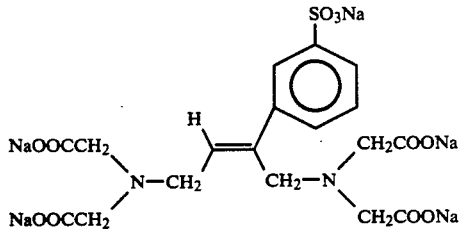
13.
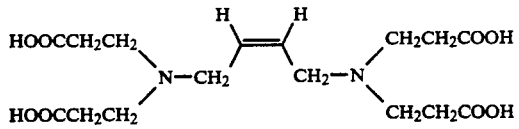
14.
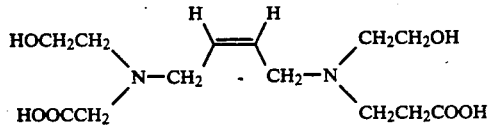
15.
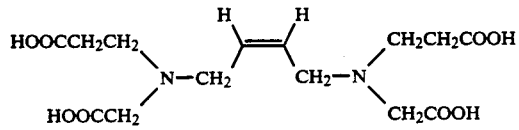
16.
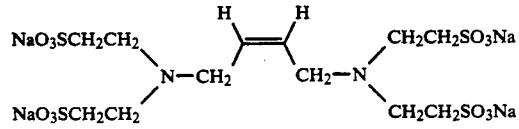
17.
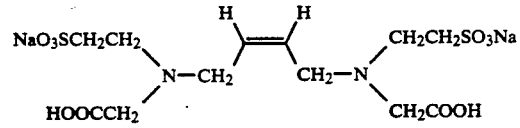
18.
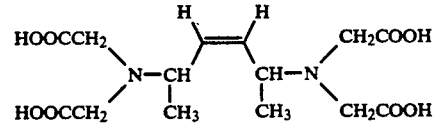
19.
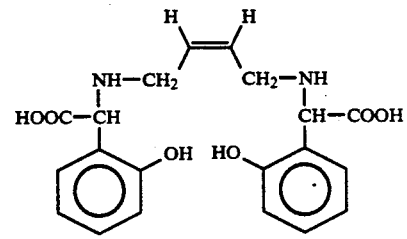

-continued
20.
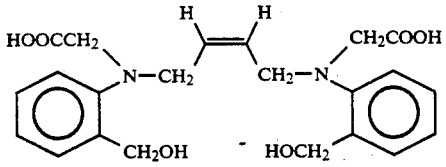
21.
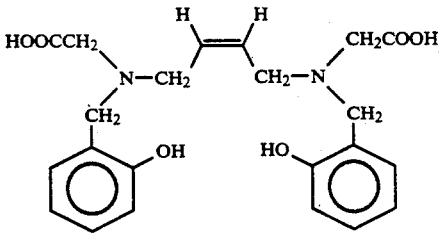
22.
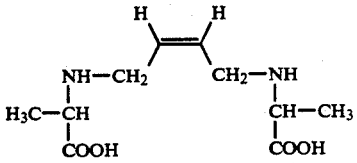
23.
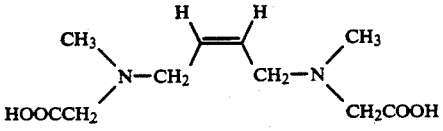
24.
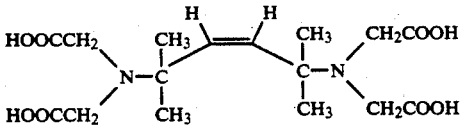
25.
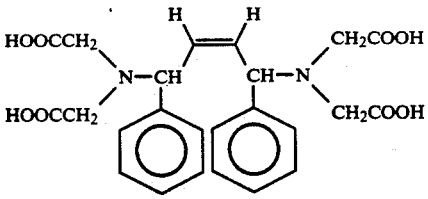
26.
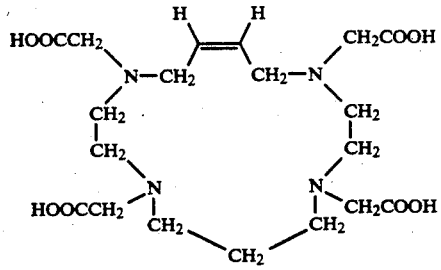
27.
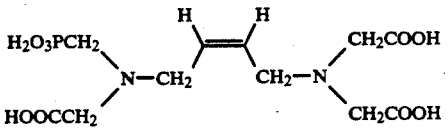
28.
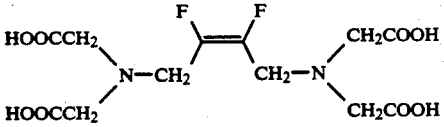

-continued
29.
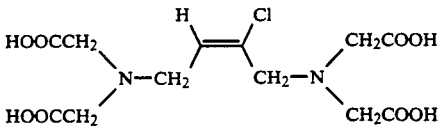
30.
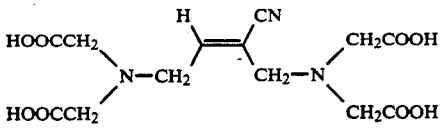
31.
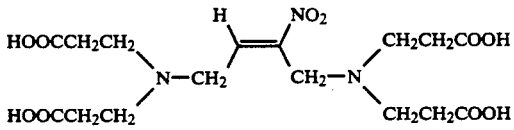
32.
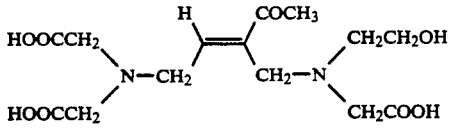
33.
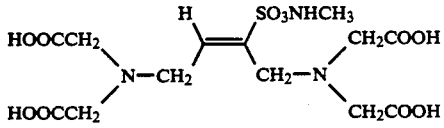
34.
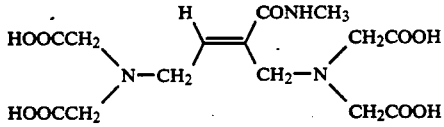
35.
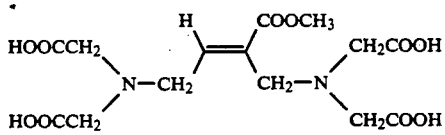
36.
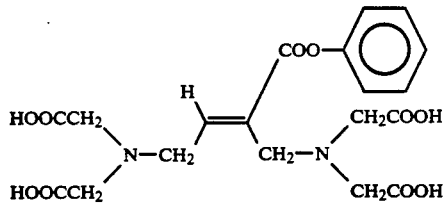
37.
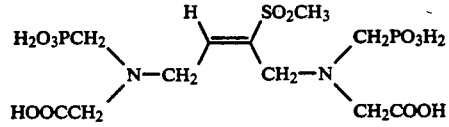
38.
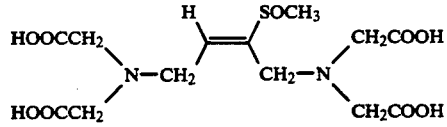
39.
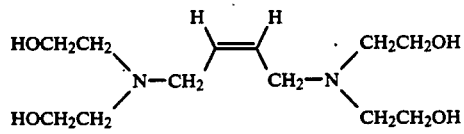

-continued
40.
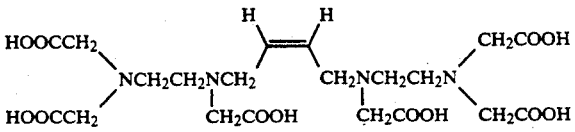
41.
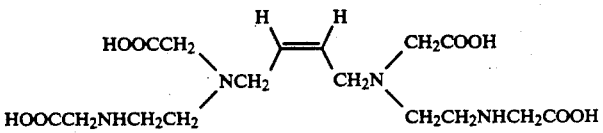
42.
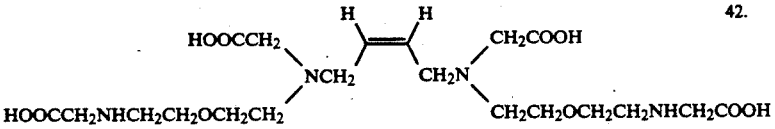
43.
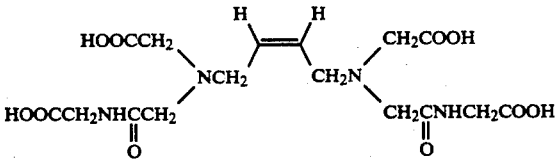
44.
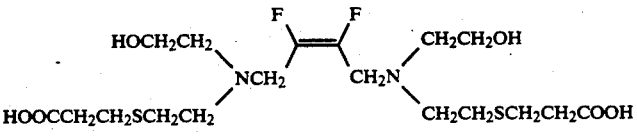
45.
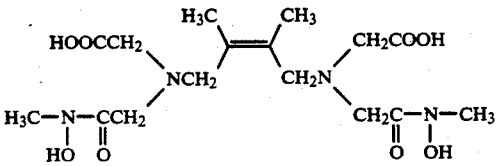
46.
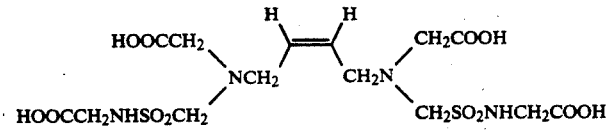
47.
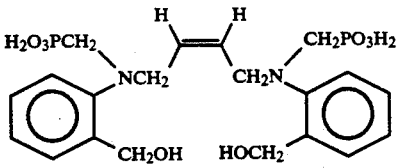
48.
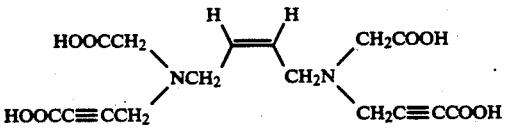
49.
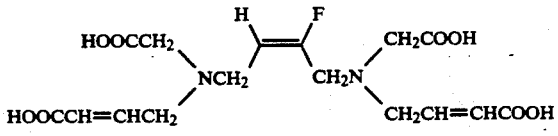

-continued
50.
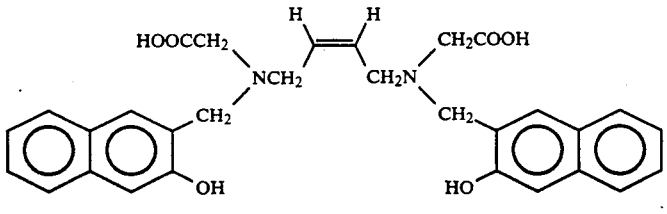
51.
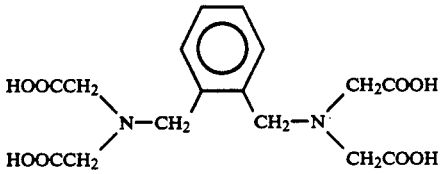
52.
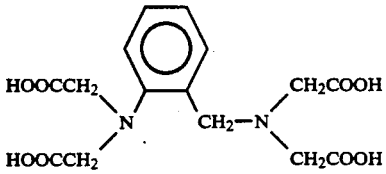
53.
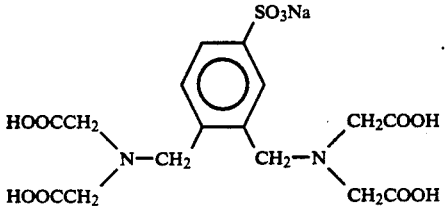
54.
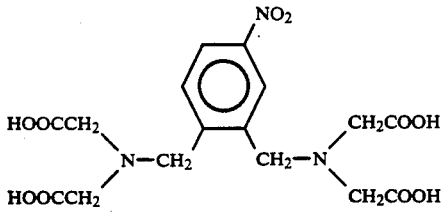
55.
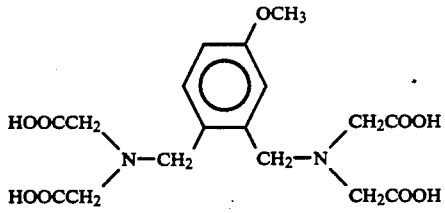
56.
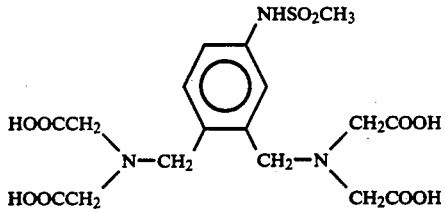

-continued
57.
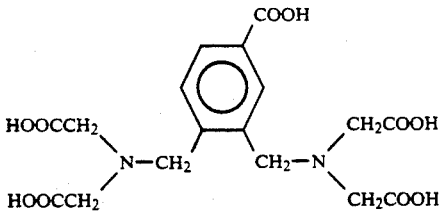
58.
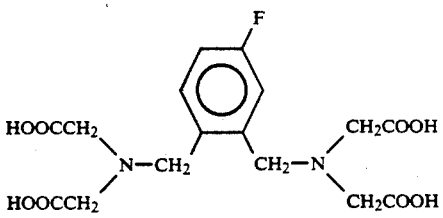
59.
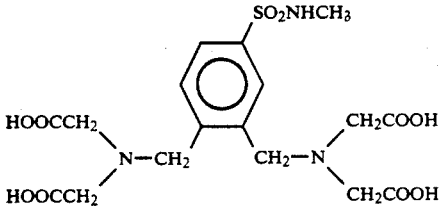
60.
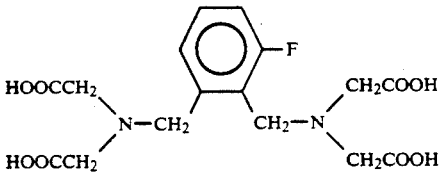
61.
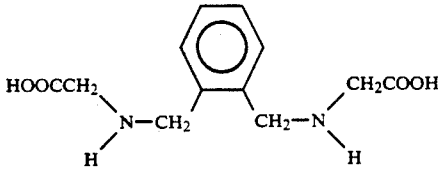
62.
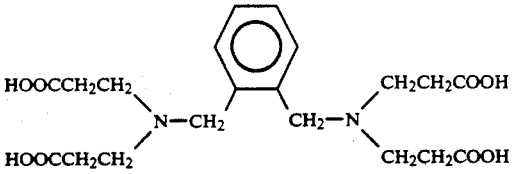
63.
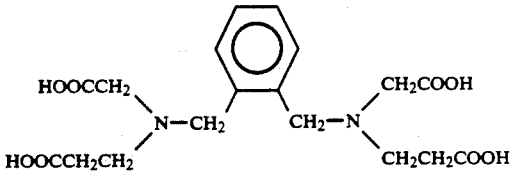
64.
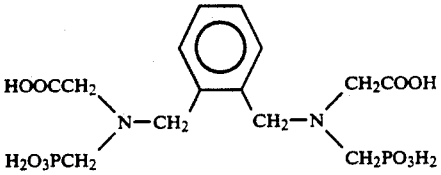

-continued
65.
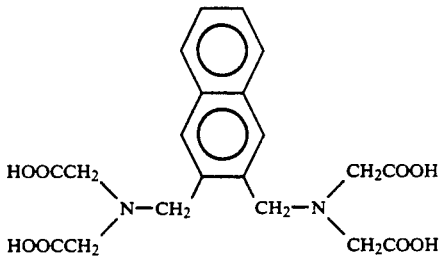
66.
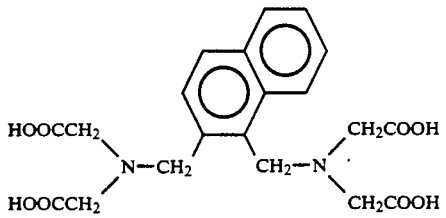
67.
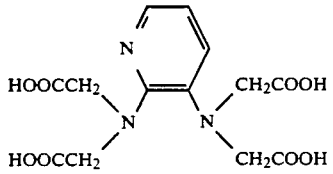
68.
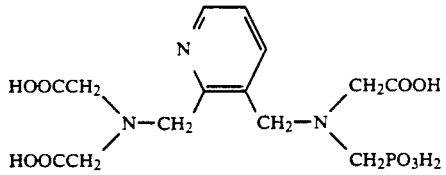
69.
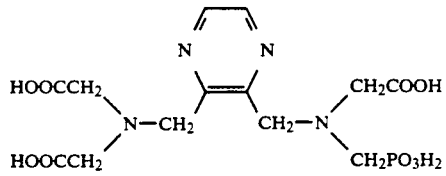
70.
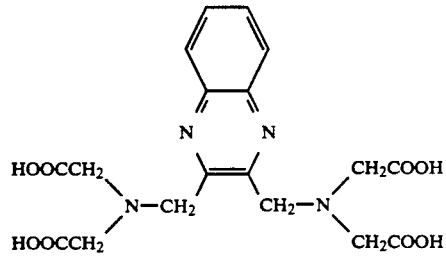
71.
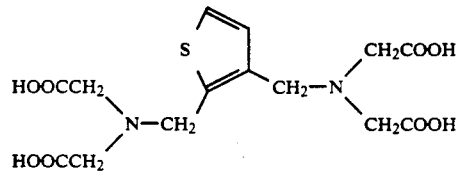

-continued
72.
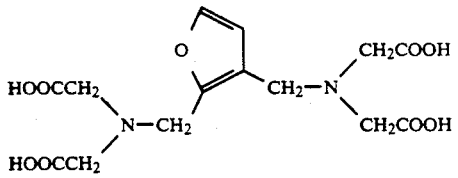
73.
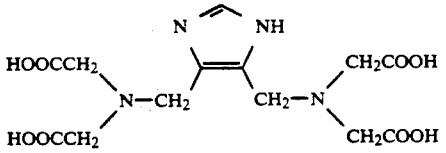
74.
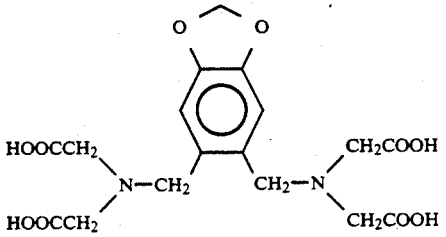
75.
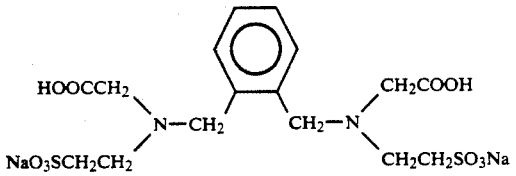
76.
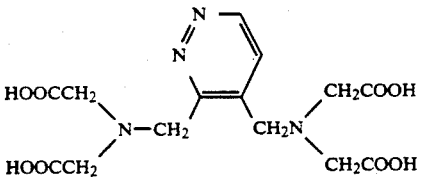
77.
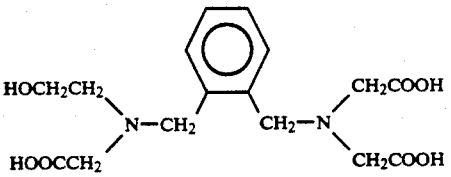
78.
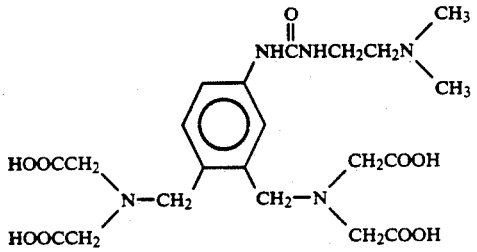

-continued
79.
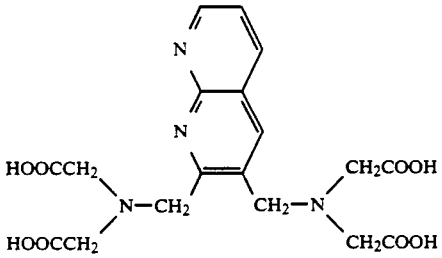
80.
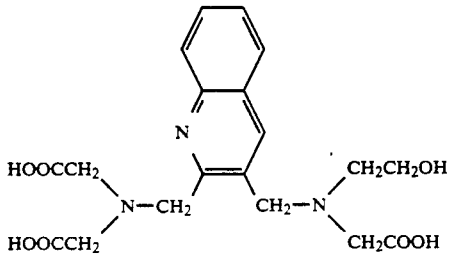
81.
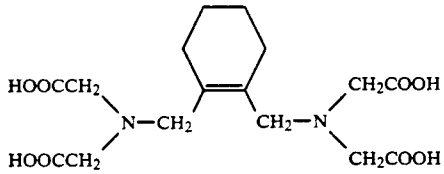
82.
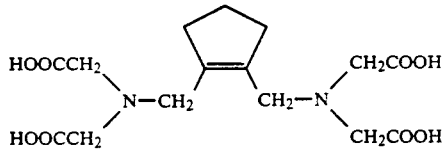
83.
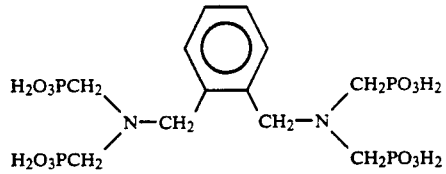
84.
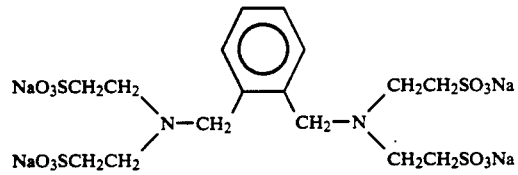
85.
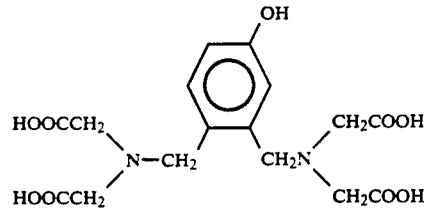

-continued
86.
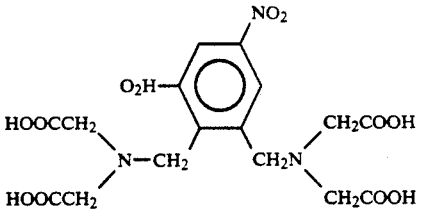
87.
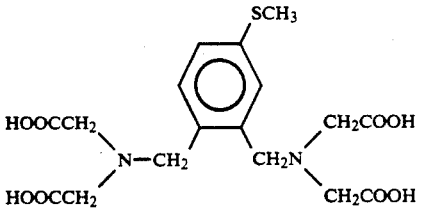
88.
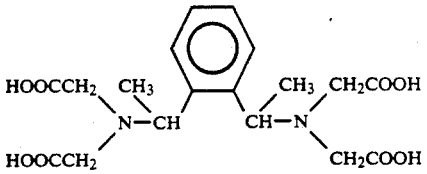
89.
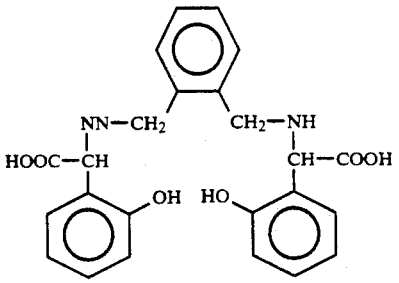
90.
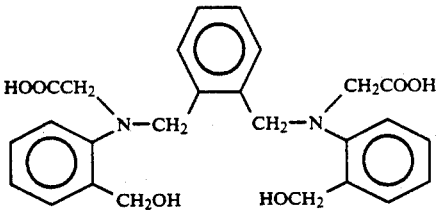
91.
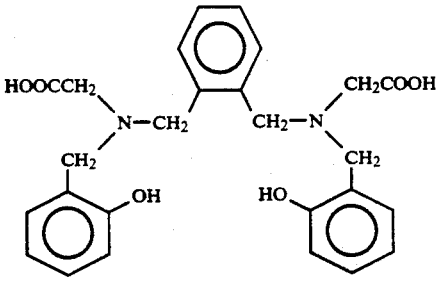
92.
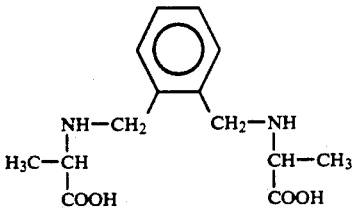

-continued
93.
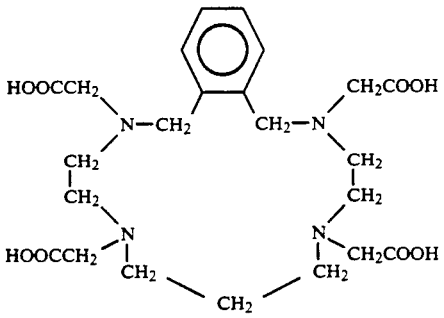
94.
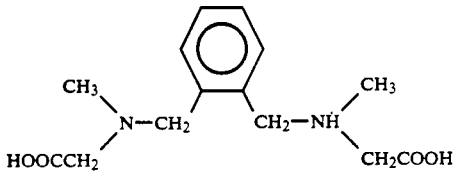
95.
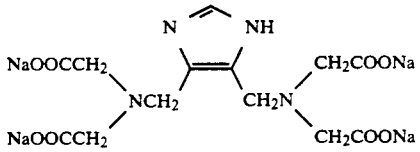
96.
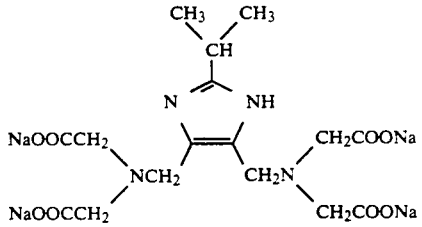
The synthesis of the compound represented by the general formula (I) can be accomplished on the basis of the description in Kagehira Ueno, *Chelate Chemistry*, Vol. 5, Nankodo, 1975, Chapter 5.
Specific examples of the synthesis of typical compounds of the present invention will be set forth below:
SYNTHESIS EXAMPLE 1
Synthesis of Compound 3
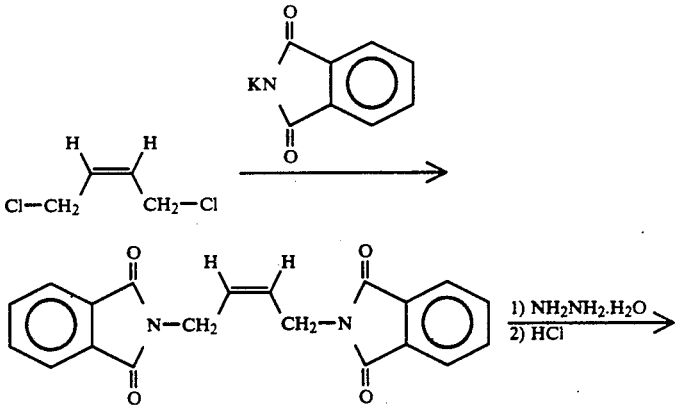
3a -continued

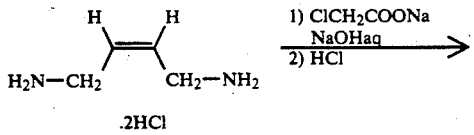

3b

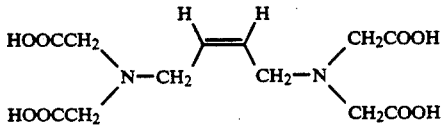

3

SYNTHESIS EXAMPLE 1-(1)

Synthesis of Compound 3a 100 g (0.80 mol) of cis-1,4-dichloro-2-butene and 350 g (1.89 mol) of the potassium salt of phthalimide were dissolved in 1.5 of dimethyl formamide. The solution was then heated to a temperature of 80° C. with stirring for 2 hours. 2 l of water was added to the material. The material was further stirred for 20 minutes. The resulting solid was filtered off, washed with water, and then dried with air to obtain 268 g (0.775 mol) of the desired compound 3a. (Yield: 97%)

SYNTHESIS EXAMPLE 1-(2)

Synthesis of Compound 3b 258 g (0.746 mol) of Compound 3a obtained in Synthesis Example 1-(1) and 93.1 g (1.86 mol) of hydrazine monohydrate were dissolved in 1 l of methanol. The reaction system was then heated under reflux for 3 hours. The resulting solid was removed by filtration. The filtrate was then concentrated under reduced pressure. 200 ml (2.33 mol) of concentrated hydrochloric acid was added to the material. 500 ml of acetonitrile was then added to the material with stirring at room temperature. The resulting solid was filtered off, washed with acetonitrile, and then dried to obtain 113 g (0.711 mol) of the desired compound 3b. (Yield: 95%)

SYNTHESIS EXAMPLE 1-(3)

Synthesis of Compound 3

45.5 g (0.286 mol) of Compound 3b obtained in Synthesis Example 1-(2) was dissolved in 100 ml of water. 22.9 g (0.573 mol) of sodium hydroxide was then added to the solution. 200 ml of an aqueous solution of 140 g (1.20 mol) of sodium chloroacetate and 100 ml of an aqueous solution of 48.0 g (1.20 mol) of sodium hydroxide were graudally added to the reaction system. During this process, the reaction temperature was kept at 50° to 55° C. A small amount of phenolphthalein was added to the reaction system as pH indicator to keep the reaction system light red. The reaction system was further heated with stirring for 1 hour, and then allowed to cool. 122 g (1.20 mol) of concentrated hydrochloric acid was added to the system. The reaction solution was concentrated under reduced pressure to about one third of the original volume. The resulting salts were filtered by filtration. The filtrate was cooled over night (about 5° C.). The resulting solid was filtered off, and then recrystallized from a mixture of water and methanol to obtain 42.0 g (0.132 mol) of the desired compound 3. (Yield: 46%; m.p. 179°-180° C. (decomposition))

SYNSTHESIS EXAMPLE 2

Synthesis of Compound 51

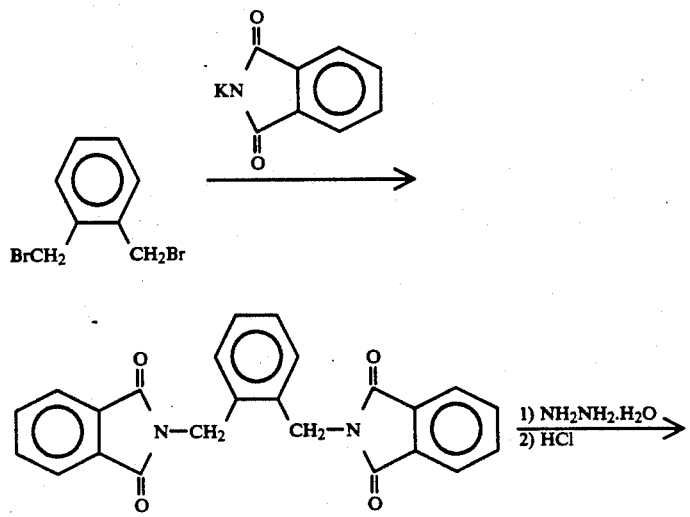

51a

-continued

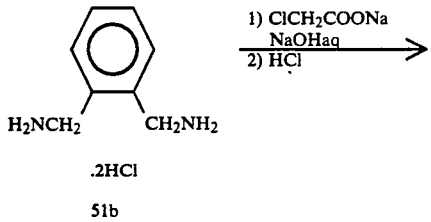

51b

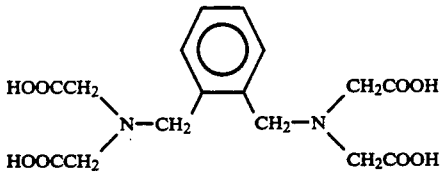

51

SYNTHESIS EXAMPLE 2-(1)

Synthesis of Compound 51a 134 g (0.507 mol) of a,a'-dibromo-oxylene and 210 g (1.13 mol) of the potassium salt of phthalimide were dissolved in 1.5 l of dimethyl formamide. The solution was then heated to a temperature of 80° C. with stirring for 2 hours. 2 l of water was added to the material. The material was further stirred for 20 minutes. The resulting solid was filtered off, washed with water, and then dried with air to obtain 191 g (0.482 mol) of the desired compound 51a. (Yield: 95%)

SYNTHESIS EXAMPLE 2-(2)

Synthesis of Compound 51b 173 g (0.436 mol) of Compound 51a obtained in Synthesis Example 2-(1) and 60.0 g (1.20 mol) of hydrazine monohydrate were dissolved in 1 l of methanol. The reaction system was then heated under reflux for 3 hours. The resulting solid was removed by filtration. The filtrate was then concentrated under reduced pressure. 122 g (1.20 mol) of concentrated hydrochloric acid was added to the material. 500 ml of acetonitrile was then added to the material with stirring at room temperature. The resulting solid was filtered off, washed with acetonitrile, and then dried to obtain 169 g (0.809 mol) of the desired compound 51b. (Yield: 95%)

SYNTHESIS EXAMPLE 2-(3)

Synthesis of Compound 51

59.9 g (0.286 mol) of Compound 51b obtained in Synthesis Example 2-(2) was dissolved in 100 ml of water. 22.9 g (0.573 mol) of sodium hydroxide was then added to the solution. 200 ml of an aqueous solution of 140 g (1.20 mol) of sodium chloroacetate and 100 ml of an aqueous solution of 48.0 g (1.20 mol) of sodium hydroxide were graudally added to the reaction system. During this process, the reaction temperature was kept at 50° to 55° C. A small amount of phenolphthalein was added to the reaction system as a pH indicator to keep the reaction system light red. The reaction system was further heated with stirring for 1 hour, and then allowed to cool. 122 g (1.20 mol) of concentrated hydrochloric acid was added to the system. The resulting solid was filtered off, dissolved in 600 ml of an aqueous solution of 45.6 g (1.14 mol) of sodium hydroxide, and then filtered. 116 g (1.14 mol) of concentrated hydrochloric acid was added to the filtrate. The resulting white crystal was filtered off, thoroughly washed with water, and then dried by airation to obtain 75.1 g (0.204 mol) of the desired compound 51. (Yield: 71%; m.p. 247°-249° C. (decomposition))

SYNTHESIS EXAMPLE 3

Synthesis of Compound 95

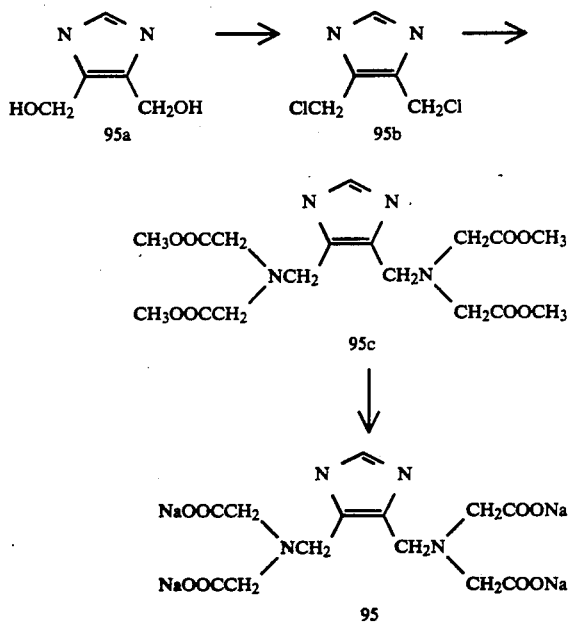

SYNTHESIS EXAMPLE 3-(1)

Synthesis of Compound 95b 12.7 g ($9.91\times10^{-2}$ mol) of imidazole-4,5-dimethanol) (Compound 95a) was suspended in 100 ml of dichloromethane. The suspension was cooled to lower than 5° C., and 47.2 g ($3.97\times10^{-1}$ mol) of thionylchloride was added thereto dropwise. After allowing to stand at room temperature for one night, the product was concentrated under reduced pressure. The concentrated product was washed with dichloromethane and then dried to obtain 16.0 g ($9.70\times10^{-2}$ mol) of white-yellow solid of Compound 95b. (Yield: 98%)

SYNTHESIS EXAMPLE 3-(2)

Synthesis of Compound 95c 16.0 g ($9.70\times10^{-2}$ mol) of Compound 95b obtained in SYNTHESYS EXAMPLE 3-(1), 64.7 ($3.27\times10^{-1}$ mol) of iminodiacetic acid dimethyl hydrochlride, and 200 g (1.45 mol) potassium carbonate were suspended in a mixture of 1 l acetnitrile and 100 ml of dimethylformamide. The suspension was heated under reflux for 4 hours. The reaction product was filtered, and the filtrate was concentrated. The concentrated product was purified by silica gel chromatography (developer: methanol/dichloromethane=1/10 (vol/vol)) to obtain 21.0 g ($5.07\times10^{-2}$ mol) of sticky oily product of Compound 95c. (Yield: 52%)

SYNTHESIS EXAMPLE 3-(3)

Synthesis of Compound 95

6.80 g ($1.64\times10^{-2}$ mol) of Compound 95 obtained in SYNTHESIS EXAMPLE 3-(2) was dissolved in 80 ml of an aqueous solution of 14.1 g (0.353 mol) of sodium hydroxide. The solution thus obtained was allowed to react for two hours at room temperature. The reaction mixture was then concentrated under reduced pressure. Methanol was added to the mixture. The resulting solid was filtered off, and then recrystallized from a mixture of water, methanol and ethanol to obtain 3.2 ($7.17\times10^{-3}$ mol) of white solid of dihydrate of Compound 95. (Yield: 44%; m.p. 253°-255° C. (decomposition)

SYNTHESIS EXAMPLE 4

Synthesis Compound 96

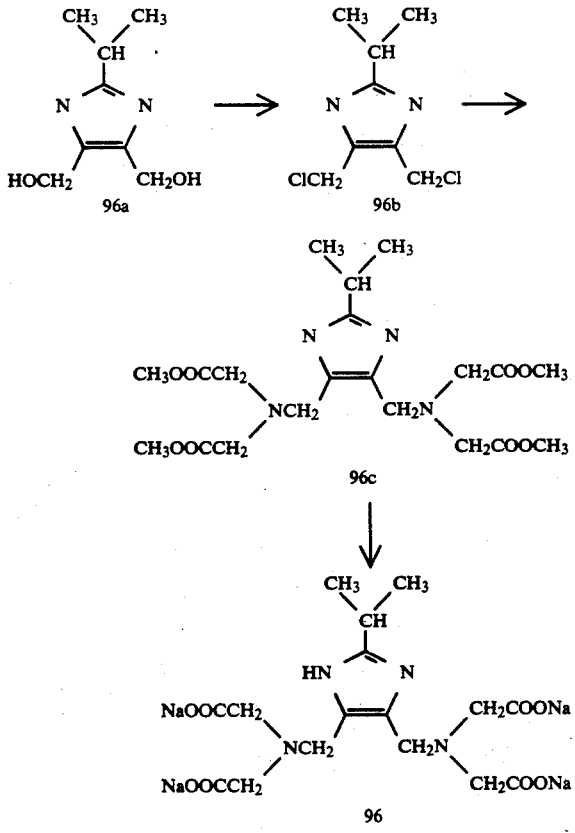

SYNTHESIS EXAMPLE 4-(1)

Synthesis of Compound 96b 100 g (0.588 mol) of 2-isopropylimidazole-4,5-dimethanol (Compound 96a) was suspended in 500 ml of dichloromethane. The solution obtained was cooled to lower than 5° C., and 280 g (2.35 mol) of thionylchloride was added thereto dropwise. Then in the same manner as SYNTHESIS EXAMPLE 3-(1), 117 g (0.565 mol) of white-yellow solid of Compound 96b was obtained. (Yield 96%)

SYNTHESIS EXAMPLE 4-(2)

Synthesis of Compound 96c 8.9 g ($4.30\times10^{-2}$ mol) of Compound 96b obtained in SYSNTHESIS EXAMPLE 4-(1), 18.8 g ($9.51\times10^{-2}$ mol) of iminodiacetic acid dimethyl hydrochloride, and 100 g ($7.24\times10^{-1}$ mol) of potassium carbonate was suspended in 500 ml of acetnitrile. Then in the same manner as SYNTHESIS EXAMPLE 3-(2), 5.1 g ($1.12\times10^{-2}$ mol) of sticky oily product of Compound 96c was obtained. (Yield 26%)

SYNTHESIS EXAMPLE 4-(3)

Synthesis of Compound 96

5.0 g ($1.09\times10^{-2}$ mol) of Compound 96c obtained in SYNTHESIS EXAMPLE 4-(2) was dissolved in 30 ml of an aqueous solution of 9.40 g (0.235 mol) of sodium hydroxide. After then in the same manner as in SYNTHESIS EXAMPLE 3-(3), 2.40 g ($4.28\times10^{-3}$ mol) of white solid of tetrahydrate of Compound 96 was obtained. (Yield 39%; m.p. 250°-253° C. (decomposition))

Metal salts which constitute the metal chelate compound of the present invention are selected from the group consisting of salts of Fe(III), Mn(III), Co(III), Rh(II), Rh(III), Au(II), Au(III) and Ce(IV). Preferred among these metals are Fe(III), Mn(III), and Ce(IV). Particularly preferred among these metals is Fe(III).

Anions or cations which form these metal salts are preferably $SO_4^{--}$, $Cl^-$, $NO_3^-$, $NH_4^+$ or $PO_4^-$. It is preferable that an ion(s) is selected so that it form a water soluble chelate compound.

As the metal chelate compound for use in the present invention may be isolated as metal chelate compound. However, the chelate compound is not necessary to be isolated. In practical use, it is convenient from the point of view of easy handling, to directly use a chelate forming reaction product of the compound represented by general formula (I) and the metal salt.

Two or more kinds of metal chelate compounds of the present invention can be used in combination.

It goes without saying that the compound represented by the general formula (I) and the above mentioned metal salt such as ferric sulfate, ferric chloride, ferric nitrate, ferric ammonium sulfate and ferric phosphate can be reacted with each other in a solution in the present invention. The compound represented by the general formula (I) may be used in a molar ratio of 1.0 or more based on metal ion. If the stability of the metal chelate compound is low, this ratio is preferably high. In general, this ratio is in the range of 1 to 30.

A preferred concentration of the metal ion is 0.05 to 1 mol/l. The reaction temperature is preferably 5° to 80° C. and more preferably 15° to 45° C.

Specific examples of compounds to be used as the metal chelate compounds of the present invention are set forth below, but the present invention should not be construed as being limited thereto.

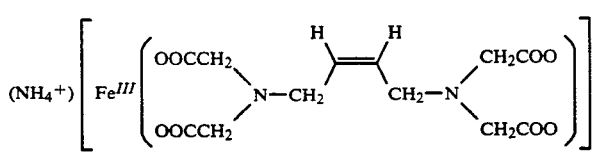

K-3

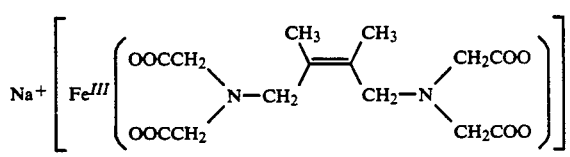

K-4

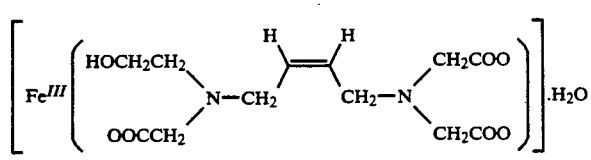

K-8

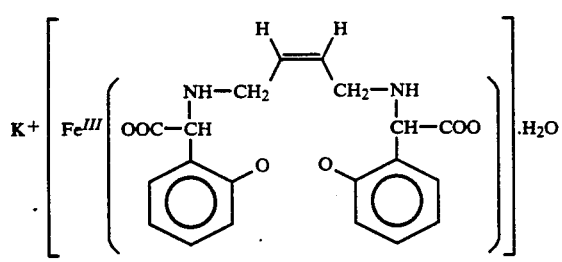

K-19

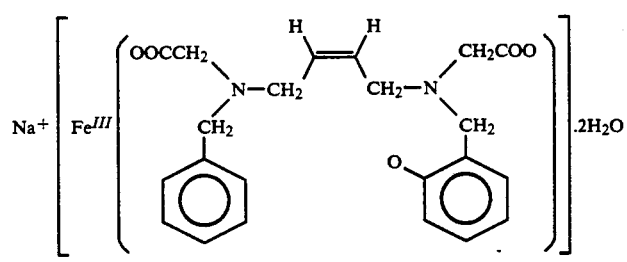

K-21

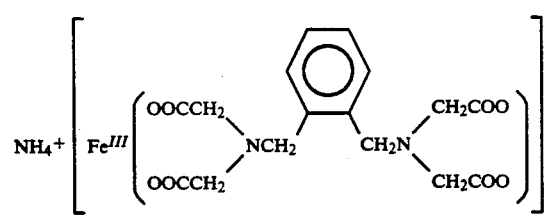

K-51

A specific example of synthesis of typical metal chelate compound of the present invention will be set forth below.

SYNTHESIS EXAMPLE 5

Synthesis of Compound K-3

12.1 g (0.03 mol) of ferric nitrate nonahydrate and 10.5 g (0.033 mol) of Compound 3 were dissolved in 100 ml water under heating. The pH of the solution was adjusted with an aqueous ammonia and acetic acid to 5. Water in the solution was gradually evaporated at room temperature until the amount of the solution become 30 ml. The resulted solid was filtered off, washed with cooled water, and dried under reduced pressure to obtain 6.1 g (0.016 mol) of yellow-green solid of Compound K-3. (Yield: 53%; m.p. higher than 240° C. (decomposition))

Elementary Analysis:

| | H | C | N |
|---|---|---|---|
| Calculated (%) | 4.67 | 37.13 | 10.83 |
| Measured (%) | 4.52 | 36.98 | 10.79 |

SYNTHESIS EXAMPLE 6

Synthesis of Compound K-51

4.04 g (0.010 mol) of ferric nitrate nonahydrate and 4.05 g (0.011 mol) of Compound 51 were dissolved in 100 ml water under heating. The pH of the solution was adjusted with an aqueous ammonia and acetic acid to 5. Water in the solution was gradually evaporated at room temperature until the amount of the solution become 10 ml. The resulted solid was filtered off, washed with cooled water, and dried under reduced pressure to obtain 2.94 g ($6.71\times10^{-3}$ mol) of yellow solid of Compound K-51. (Yield: 67%; m.p. higher than 270° C. (decomposition))

Elementary Analysis:

| | H | C | N |
|---|---|---|---|
| Calculated (%) | 4.60 | 43.86 | 9.59 |
| Measured (%) | 4.63 | 43.96 | 9.70 |

The metal chelate compound of the present invention may be incorporated in the fixing solution or an interbath (e.g., bleach acceleration bath) provided between color development process and desilvering process in a small amount. The metal chelate compound of the present invention can be incorporated in the bleaching solution or blix solution in an amount of 0.05 to 1 mol/l to effectively serve as a bleaching agent.

Preferred embodiments of processing solution having a bleaching power (general term for bleaching solution or blix solution) will be described hereinafter. As mentioned above, the metal chelate compound of the present invention can be incorporated in the processing solution having a bleaching capacity in an amount of 0.05 to 1 mol/l to effectively serve as bleaching agent. More preferably, the metal chelate compound of the present invention can be incorporated in the processing solution having a bleaching power in an amount of 0.1 to 0.5 mol/l.

In other embodiments of the present invention, the processing solution having a bleaching power may preferably contain an organic acid in addition to the above mentioned metal chelate compound. The acid is preferably used for controlling the pH of the processing solution.

Preferred examples of the organic acid to be used in the present invention include a monobasic acid such as formic acid, acetic acid, propionic acid, glycolic acid, monochloroacetic acid, monobromoacetic acid, monochloropropionic acid, lactic acid, pyruvic acid, acrylic acid, butyric acid, isobutyric acid, pivalic acid, aminoacetic acid, valeric acid, isovaleric acid, benzoic acid, chloro and hydroxy mono-substituted benzoic acid, and nicotinic acid, amino acid compound such as asparagine, aspartic acid, alanine, arginine, ethionine, glycine, glutamine, cystein, serine, methionine, and leucine, dibasic acid such as oxalic acid, malonic acid, succinic acid, glutaric acid, tartaric acid, malic acid, oxaloacetic acid, phthalic acid, isophthalic acid, and terephthalic acid, tribasic acid such as citric acid, sulfonic acid, sulfinic acid, imide, and aromatic sulfonamide (which are able to be decomposed to form acids), levulinic acid and ureidopropionic acid. The present invention should not be construed as being limited to these exemplary compounds. The acids may be present in the composition as water soluble salts.

In the present invention, among these organic acids, those having a pKa value of 1.5 to 6.5 may be preferably used. More preferably, organic acids with a pKa value of 2.0 to 5.5 and containing carboxyl group may be used. Particularly preferred among these organic acids are monobasic acids. Most preferred among these monobasic acids are acetic acid and/or glycolic acid.

In the present invention, the amount of such an organic acid to be used is preferably 0 to 3.0 mol, more preferably 0.05 or more and not more than to 2.0 mol per l of processing solution having a bleaching power or its replenisher.

Two or more of these organic acids may be used in admixture. In stead of these organic acids, their salts may be used in combination with inorganic acids.

When the metal chelate compound of the present invention is used as bleaching agent to be incorporated in the processing solution having a bleaching capacity, it may be used in combination with other bleaching agents so far as the effects of the present invention can be attained. The amount of the other bleaching agent is preferably 1/10 to 10 mol per mol of the metal chelate compound. Examples of such bleaching agents include bleaching agents of Fe(III), Co(III) or Mn(III) chelates of the compounds set forth below, peroxodisulfate, hydrogen peroxide, and bromate.

Examples of compounds which constitute the above mentioned chelate bleaching agents include ethylenediaminetetraacetic acid, disodium ethylenediaminetetraacetate, diammonium ethylenediaminetetraacetate, tetra(trimethylammonium) ethylenediaminetetraacetate, tetrapotassium ethylenediaminetetraacetate, tetrasodium ethylenediaminetetraacetate, trisodium ethylenediaminetetraacetate, diethylenetriaminepentaacetic acid, pentasodium diethylenetriaminepentaacetate, ethylenediamine-N-(β-oxyethyl)-N,N',N'-triacetic acid, trisodium ethylenediamine-N-(β-oxyethyl)-N,N',N'-triacetate, triammonium ethylenediamine-N-(β-oxyethyl)-N,N',N'-triacetate, 1,2-diaminopropanetetraacetic acid, disodium 1,2-diaminopropanetetraacetate, 1,3-diaminopropanetetraacetic acid, diammonium 1,3-diaminopropanetetraacetate, nitrilotriacetic acid, trisodium nitrotriacetate, cyclohexanediaminetetraacetic acid, disodium cyclohexanediaminetetraacetate, iminodiacetic acid, dihydroxyethyl glycine, ethyletherdiaminetetraacetic acid, glycoletherdiaminetetraacetic acid, ethylenediaminetetrapropionic acid, phenylenediaminetetraacetic acid, 1,3-diaminopropanol-N,N,N',N'-tetramethylenephosphonic acid, ethylenediamine-N,N,N',N'-tetramethylenephosphonic acid, and 1,3-propylenediamine-N,N,N',N'-tetramethylenephosphonic acid. The present invention should not be construed as being limited to these exemplary compounds.

The processing solution having a bleaching power containing the present metal chelate compound may preferably comprise a halide such as chloride, bromide or iodide as a rehalogenating agent for accelerating oxidation of silver in addition to the metal chelate compound and the above mentioned organic acid. The amount of the rehalogenating agent is generally in the range of 0.01 to 2.0 mol/l. In place of such a halide, an organic ligand which forms a difficultly soluble silver salt may be incorporated in the processing solution. The halide may be incorporated in the processing solution in the form of an alkaline metal salt, ammonium salt, guanidine salt or amine salt. Specific examples of such salts include sodium bromide, ammonium bromide, potassium chloride, and guanidine chloride. Preferred among these salts is ammonium bromide. The amount of the rehalogenating agent to be incorporated in the bleaching solution is in the range of 0.1 to 2.0 ml/l, preferably 0.3 to 1.5 mol/l.

The blix solution containing the present metal chelate compound or the metal an organic acid may comprise a fixing agent as described later and optionally the above mentioned rehalogenating agent, in addition to the metal chelate compound. The amount of the rehalogenating agent to be incorporated in the blix solution is in the range of 0.001 to 2.0 mol/l, preferably 0.01 to 1.0 mol/l.

The bleaching solution or blix solution of the present invention may further comprise a bleach accelerator, a corrosion inhibitor for inhibiting the corrosion of the processing bath, a buffer for maintaining the processing solution at a desired pH range, a fluorescent brightening agent, an antifoaming agent or the like if desired.

As such a bleach accelerator there can be used a compound containing a mercapto group or disulfide group as disclosed in U.S. Pat. Nos. 3,893,858 and 1,138,842, German Patent 1,290,812, JP-A-53-95630 (the term "JP-A" as used herein means an "unexamined published Japanese patent application"), and Research Disclosure No. 17129 (1978), the thiazoline derivative as disclosed in JP-A-50-140129, the thiourea derivatives as disclosed in U.S. Pat. No. 3,706,561, the polyethylene oxide as disclosed in German Patent 2,748,430, the polyamine compound as disclosed in JP-B-45-8836 (the term "JP-B" as used herein means an "examined Japanese patent publication"), the imidazole compound as disclosed in JP-A-49-40493, or the like. Particularly preferred among these compounds is the mercapto compound as disclosed in U.S. Pat. No. 1,138,842.

As corrosion inhibitor there may be preferably used nitrate such as ammonium nitrate and potassium nitrate. The amount of the nitrate to be incorporated in the processing solution is in the range of 0.05 to 0.5 mol/l, preferably 0.01 to 2.0 mol/l, more preferably 0.05 to 0.5 mol/l.

The pH value of the bleaching solution or blix solution of the present invention is in the range of 2.0 to 8.0, preferably 3.0 to 7.5. If the color development step is immediately followed by bleach or blix step, the processing solution is preferably used at a pH range of 6.0 or less, more preferably 5.5 or less, in order to inhibit bleach fogging. If the pH value of the processing solution falls below 2.0, the metal chelate according to the present invention becomes unstable. Therefore, the pH value of the processing solution is preferably in the range of 2.0 to 5.5.

In order to adjust the pH value of the processing solution having a bleaching capacity to the above mentioned range, the above mentioned organic acid can be used in combination with an alkaline agent (e.g., aqueous ammonia, KOH, NaOH, imidazole, monoethanolamine, diethanolamine). Particularly preferred among these alkaline agents is aqueous ammonia.

In the processing step, the processing solution containing complex salt of iron (III) and having a bleaching power which has been used is preferably aerated to oxidize the resulting ferrous complex. This regenerates the bleaching agent, keeping the photographic properties extremely stable.

The bleach or blix step may be effected generally at a temperature of 30° to 50° C., preferably 35° to 45° C. For light-sensitive materials for picture taking, the bleaching or blix time generally ranges from 10 seconds to 5 minutes, preferably from 10 seconds to 60 seconds, more preferably from 10 seconds to 30 seconds. For light-sensitive materials for printing, the bleaching time generally ranges from 5 seconds to 70 seconds, preferably 5 seconds to 50 seconds, more preferably 5 seconds to 30 seconds, and particularly preferably 5 seconds to 15 seconds. Under these preferred processing conditions, excellent results, for example, rapid processing and no increase in stain can be provided.

The fixing solution or blix solution may comprise a fixing agent. Examples of such a fixing agent include a thiosulfate, a thiocyanate, a thioether, an amine, a mercapto, a thione, a thiourea, and an iodide. Specific examples of these compounds include ammonium thiosulfate, sodium thiosulfate, potassium thiosulfate, guanidine thiosulfate, potassium thiocyanate, dihydroxyethylthioether, 3,6-dithia-1,8-octanediol, and imidazole. Among these compounds, thiosulfate, especially ammonium thiosulfate may be preferably used for rapid fixing. Further, two or more kinds of fixing agents can be used in combination for rapid fixing. For example, ammonium thiosulfate may be preferably used in combination with ammonium thiocyanate, imidazole, thiourea, thioether or the like. In this case, the secondary fixing agent may be used generally in an amount of 0.01 to 100 mol % based on ammonium thiosulfate.

The amount of the fixing agent to be incorporated in the fixing solution or blix solution is generally in the range of 0.1 to 3.0 mol/l, preferably 0.5 to 2.0 mol/l. The pH value of the fixing solution depends on the kind of the fixing agent contained therein and is normally in the range of 3.0 to 9.0. In particular, if a thiosulfate is used, the pH value of the fixing solution is preferably in the range of 6.5 to 8.0 for stable fixing properties.

The fixing solution and/or blix solution may comprise a preservative to enhance the aging stability thereof. The fixing solution or blix solution containing a thiosulfate may effectively comprise a sulfite and/or hydroxylamine, hydrazine or aldehyde-bisulfite adduct (e.g., acetaldehyde-bisulfite adduct, particularly aromatic aldehyde-bisulfite adduct as described in JP-A-1-298935) as a preservative. Further, sulfinic compounds as described in JP-A-62-143048 may be preferably used.

The fixing solution and/or blix solution may preferably comprise a buffer to keep the pH value thereof constant. Examples of such a buffer include a phosphate, an imidazole such as imidazole, 1-methylimidazole, 2-methylimidazole, and 1-ethylimidazole, triethanolamine, N-allylmorpholine, and N-benzoylpiperadine. The fixing solution may comprise various chelating agents to opacify iron ions brought by the bleaching solution to improve the stability thereof. Preferred examples of such chelating agents include 1-hydroxyethylidene-1,1-diphosphonic acid, ethylenediamine-N,N,N',N'-tetramethylenephosphonic acid, nitrilotrimethylenephosphonic acid, ethylenediaminetetraacetic acid, diethylenetriaminepentaacetic acid, cyclohexanediaminetetraacetic acid, and 1,2-propanediaminetetraacetic acid.

The fixing step may be effected generally at a temperature of 30° to 50° C., preferably 35° to 45° C. For light-sensitive materials for picture taking, the fixing time generally ranges from 35 seconds to 2 minutes, preferably from 40 seconds to 100 seconds. For light-sensitive materials for printing, the fixing time ranges from 10 seconds to 70 secons, preferably 10 seconds to 30 seconds.

The desilvering step may consist of a bleach step and/or blix step in combination. Typical examples of such a combination include:

i. Bleach - fixing ii. Bleach - blix iii. Bleach - rinse - fixing
iv. Blix
v. Fixing - blix
vi. Fixing - blix - fix Light-sensitive materials for picture taking may be preferably subjected to the combination i, ii, iii, or iv, more preferably i, ii or iii. Light-sensitive material for print may be preferably subjected to the combination v.

The present invention can be applied to any desilvering step which is effected after color development through the stop step, the rinse step or the like.

In the present desilvering step such as bleaching, blix and fixing, the agitation is preferably intensified as much as possible to more effectively accomplish the effects of the present invention.

In particular, the agitation can be intensified by various methods. For example, the processing solution may be jetted to the surface of the emulsion layer of the light-sensitive material as described in JP-A-62-183460 and 62-183461. The agitating effect can be improved by a rotary means as described in JP-A-62-183461. Furthermore, the agitating effect can be improved by moving the light-sensitive material with the emulsion surface in contact with a wiper blade provided in the bath so that a turbulence occurs on the emulsion surface. Moreover, the agitation can be intensified by increasing the total circulated amount of processing solution. Such an agitation improving method can be effectively applied to the bleaching bath, blix bath or fixing bath. The improvement in agitation effect expedites the supply of a bleaching agent, fixing agent or the like into the emulsion film, resulting in an improvement in desilvering rate.

The above mentioned agitation improving method is more effective when a bleach accelerator is used. In this case, the agitation improving method can remarkably enhance the bleach accelerating effect or eliminate the effect of inhibiting fixation by the bleach accelerator.

The above mentioned strong agitation may be used in the color development, rinse with water or stabilization.

The color developer used in the present color development may comprise a known aromatic primary amine color developing agent. Preferred examples of such an aromatic primary amine color developing agent include p-phenylenediamine derivatives. Specific examples of such p-phenylenediamine derivatives will be set forth below, but the present invention should not be construed as being limited thereto.

D-1: N,N-diethyl-p-phenylenediamine
D-2: 4-Amino-N,N-diethyl-3-methylaniline
D-3: 4-Amino-N-(β-hydroxyethyl)-N-methylaniline
D-4: 4-Amino-N-ethyl-N-(β-hydroxyethyl)aniline
D-5: 4-Amino-N-ethyl-N-(β-hydroxyethyl)-3-methylaniline
D-6: 4-Amino-N-ethyl-N-(3-hydroxypropyl)-3-methylaniline
D-7: 4-Amino-N-ethyl-N-(4-hydroxybutyl)-3-methylaniline
D-8: 4-Amino-N-ethyl-N-(β-methanesulfonamideethyl)-3-methylaniline
D-9: 4-Amino-N,N-diethyl-3-(β-hydroxyethyl)aniline
D-10: 4-Amino-N-ethyl-N-(β-methoxyethyl)-3-methylaniline
D-11: 4-Amino-N-(β-ethoxyethyl)-3-N-ethylmethylaniline
D-12: 4-Amino-N-(3-carbamoylpropyl-N-n-propyl-3-methylaniline
D-13: 4-Amino-N-(4-carbamoylbutyl-N-n-propyl-3-methylaniline
D-14: N-(4-amino-3-methylphenyl)-3-hydroxypyrrolidine
D-15: N-(4-amino-3-methylphenyl)-3-(hydroxymethyl) pyrrolidine
D-16: N-(4-amino-3-methylphenyl)-3-pyrrolidinecarboxamide
D-17: 4-Amino-N-ethyl-N-(β-hydroxyethyl)-3-methoxyaniline Particularly preferred among these p-phenylenediamine derivatives are Exemplary Compounds D-5, D-6, D-7, D-8, D-12, and D-17.

These p-phenylenediamine derivatives may be used in the form of salt such as a sulfate, a hydrochloride, a sulfite and a p-toluenesulfonate. The amount of the aromatic primary amine color developing agent to be used is generally in the range of 0.0002 to 0.2 mol, more preferably about 0.001 to 0.1 mol, more preferably 0.01 to 0.06 per l of color developer.

If necessary, the color developer may comprise as preservative a sulfite such as sodium sulfite, potassium sulfite, sodium bisulfite, potassium bisulfite, sodium metasulfite and potassium metasulfite or a carbonyl-sulfurous acid addition product.

Furthermore, the color developer may preferably comprise as a compound for directly preserving the aromatic primary amine color developing agent various hydroxylamines as disclosed in JP-A-63-5341 and 63-106655, preferably those containing sulfo group or carboxyl group, hydroxamic acids as described in JP-A-63-43138, hydrazines and hydrazides as described in JP-A-63-146041, phenols as described in JP-A-63-44657 and 63-58443, α-hydroxyketones and α-aminoketones as described in JP-A-63-44656, and/or various saccharides as described in JP-A-63-36244. These compounds may be preferably used in combination with monoamines as described in JP-A-63-4235, JP-A-63-24254, JP-A-63-21647, JP-A-63-146040, JP-A-63-27841, and JP-A-63-25654, diamines as described in JP-A-63-30845, 63-14640, and 63-43139, polyamines as described in JP-A-63-21647, and 63-26655, polyamines as described in JP-A-63-44655, nitroxy radicals as described in JP-A-63-53551, alcohols as described in JP-A-63-43140 and JP-A-63-53549, oxims as described in JP-A-63-56654, and tertiary amines as described in JP-A-63-239447.

Other examples of preservatives which can be incorporated in the color developer if desired include various metals as described in JP-A-57-44148 and 57-3749, salicylic acids as described in JP-A-59-180588, alkanolamines as described in JP-A-54-3582, polyethyleneimines as described in JP-A-56-94349, and aromatic polyhydroxy compounds as described in U.S. Pat. No. 3,746,544. In particular, aromatic polyhydroxy compounds may be preferably used.

The amount of such a preservative to be incorporated in the color developer is generally in the range of 0.005 to 0.2 mol/l, preferably 0.01 to 0.05 mol/l.

The color developer to be used in the present invention preferably has a pH value of 9 to 12, more preferably 9.5 to 11.5. The color developer may further comprise compounds which have been known to constitute color developers.

In order to maintain the above specified pH range, various buffers may be preferably used.

Specific examples of such buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium terraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). However, the present invention should not be construed as being limited to these compounds.

The amount of the buffer to be incorporated in the color developer is preferably in the range of 0.1 mol/l or more, particularly 0.1 to 0.4 mol/l.

The color developer may further comprise various chelating agents as a precipitation inhibiting agent for calcium or magnesium or to improve the stability of the color developer.

As such chelating agents there can be preferably used organic acid compounds. Examples of such organic acid compounds include aminopolycarboxylic acids, organic phosphonic acids, and phosphonocarboxylic acids. Specific examples of such organic acid compounds include nitrilotriacetic acid, diethylenetriaminepentaacetic acid, ethylenediaminetetraacetic acid, N,N,N-trimethylenephosphonic acid, ethylenediamine-N,N,N',N'-tetramethylenephosphonic acid, transcyclohexanediaminetetraacetic acid, 1,2-diaminopropanetetraacetic acid, hydroxyethyliminodiacetic acid, glycoletherdiaminetetraacetic acid, ethylenediamineorthohydroxyphenylacetic acid, 2-phosphonobutane-1,2,4-tricarboxylic acid, 1-hydroxyethylidene-1,1-diphosphonic acid, and N,N'-bis(2-hydroxybenzyl)ethylenediamine-N,N'-diacetic acid.

Two or more such chelating agents can be used in combination if desired.

The proper amount of such a chelating agent to be incorporated in the color developer is such that it suffices to block metallic ions in the color developer, e.g., 0.001 to 0.05 mol/l, preferably 0.003 to 0.02 mol/l.

The color developer may optionally comprise any development accelerators.

Examples of development accelerators which can be incorporated in the color developer include thioether compounds as disclosed in JP-B-37-16088, JP-B-37-5987, JP-B-38-7826, JP-B-44-12380, and JP-B-45-9019, and U.S. Pat. No. 3,818,247, p-phenylenediamine compounds as disclosed in JP-A-52-49829 and JP-A-50-15554, quaternary ammonium salts as disclosed in JP-A-50-137726, JP-A-56-156826 and JP-A-52-43429, and JP-B-44-30074, amine compounds as disclosed in U.S. Pat. Nos. 2,494,903, 3,128,182, 4,230,796, 3,253,919, 2,482,546, 2,596,926 and 3,582,346 and JP-B-41-11431, polyalkylene oxides as disclosed in JP-B-37-16088, JP-B-42-25201, JP-B-41-11431, and JP-B-42-23883, and U.S. Pat. Nos. 3,128,183, and 3,532,501, and imidazoles such as 2-methylimidazole and imidazole.

As auxiliary developing agents there can be used 1-phenyl-3-pyrazolidones for rapid development. Examples of such auxiliary developing agents include compounds as set forth below:

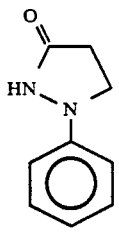
AD-1

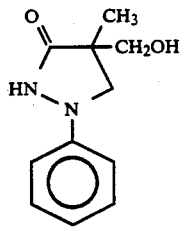
AD-2

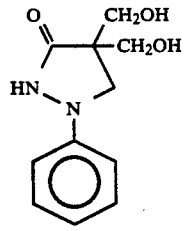
AD-3

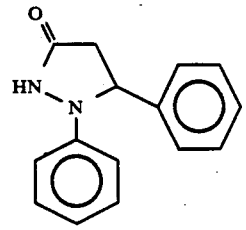
AD-4

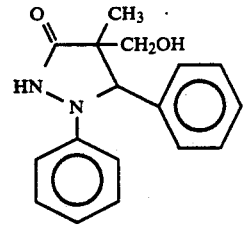
AD-5

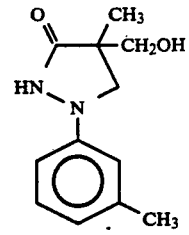
AD-6

The amount of such an auxiliary developing agent to be incorporated in the color developer is normally in the range of 0.0005 to 0.03 mol/l, preferably 0.001 to 0.01 mol/l.

The color developer to be used in the present invention can comprise any fog inhibitors as necessary. As such fog inhibitors there can be used a halide of alkaline metal such as sodium chloride, potassium bromide and potassium iodide or organic fog inhibitor. Typical examples of such an organic fog inhibitor include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolidine, and adenine.

The color developer to be used in the present invention may comprise a fluorescent brightening agent. As such a fluorescent brightening agent there can be preferably used 4,4'-diamino-2,2'-disulfostilbene compound. The amount of such a fluorescent brightening agent to be incorporated in the color developer is generally in the range of 0 to 5 g/l, preferably 0.1 to 4 g/l.

The color developer to be used in the present invention may comprise various surface active agents such as alkylsulfonic acid, arylsulfonic acid, aliphatic carboxylic acid and aromatic carboxylic acid if desired.

The temperature at which the present processing is effected with the color developer is generally in the range of 20° to 55° C., preferably 30° to 55° C. The time during which the present processing is effected with the color developer is generally in the range of 20 seconds to 5 minutes, preferably 30 seconds to 200 seconds, more preferably 60 seconds to 150 seconds.

The present processing method can also be applied to color reversal processing. The black-and-white developer to be used in the color reversal processing is a 1st black-and-white developer to be used in the reversal processing of commonly known color light-sensitive materials. Well known various additives which have been incorporated in black-and-white developers which have been widely used for processing solutions for black-and-white silver halide photographic materials can be incorporated in the 1st black-and-white developer for color reversal light-sensitive materials.

Typical examples of such additives include developing agents such as 1-phenyl-3-pyrazolidone, methol and hydroquinone, preservatives such as sulfite, accelerators comprising alkali such as sodium hydroxide, sodium carbonate and potassium carbonate, inorganic or organic inhibitors such as potassium bromide, 2-methylbenzimidazole and methylbenzthiazole, water softners such as polyphosphoric acid, and development inhibitors comprising iodides (in a slight amount) or mercapto compound.

The present processing process essentially consists of the above mentioned color development step and the subsequent desilvering step, preferably followed by rinse step and/or stabilizing step.

The rinsing water to be used in the rinsing step can comprise various surface active agents to inhibit unevennes due to waterdrop at the time of drying the light-sensitive material after processing. Examples of these surface active agents include polyethylene glycol type nonionic surface active agents, polyvalent alcohol type nonionic surface active agents, alkylbenzenesulfonate type anionic surface active agents, higher alcohol sulfuric ester type anionic surface active agents, alkylnaphthalene sulfonate type anionic surface active agents, quaternary ammonium salt type cationic surface active agents, amine salt type cationic surface active agents, amino acid type amphoteric surface active agents, and betaine type amphoteric surface active agents. However, ionic surface active agents can react with various ions introduced into the system upon processing to form insoluble substances. Therefore, nonionic surface active agents may be preferably used. In particular, alkylphenol-ethylene oxide adducts may be preferably used. Particularly preferred examples of such alkylphenols include octyl, nonyl, dodecyl, and dinonylphenol. The molar amount of ethylene oxide to be added is preferably 8 to 14. In addition, silicone surface active agents, which exhibit a high antifoaming effect, may be preferably used.

The rinsing solution may contain various anti-bacterial agents and anti-fungal agents to inhibit the formation of fur and the proliferation of mold on the light-sensitive material which has been processed. Examples of these anti-bacterial agents and anti-fungal agents include thiazolylbenzimidazole compounds as disclosed in JP-A-57-157244 and 58-105145, isothiazolone compounds as disclosed in JP-A-54-27424 and 57-8542, chlorophenolic compounds such as trichlorophenol, bromophenolic compounds, organic tin or zinc compounds, thiocyanic or isothiocyanic compounds, acid amide compounds, diazine or triazine compounds, thiourea compounds, benzotriazolealkyl guanidine compounds, quaternary ammonium salts such as benzammonium chloride, antibiotics such as penicilline, and general-purpose anti-fungal agents as described in Journal of Antibacterial and Antifungal Agents", Vol. 1, No. 5, p 207–223 (1983). Two or more of these antibacterial or antifungal agents can be used in combination.

Various germicides as described in JP-A-48-83820 can be used.

Various chelating agents may be preferably incorporated in the system.

Preferred examples of these chelating agents include aminopolycarboxylic acid such as ethylenediaminetetraacetic acid and diethylenetriaminepentaacetic acid, organic phosphonic acid such as 1-hydroxyethylidene-1,1-diphosphonic acid and ethylenediamine-N,N,N',N'-tetramethylenephosphonic acid, and hydrolyzates of anhydrous maleic polymers as described in European Patent 345172A1.

Preservatives which can be incorporated in the above mentioned fixing solution or blix solution may be preferably incorporated in the rinsing solution.

As the stabilizing solution to be used in the stabilizing step there can be used a processing solution for stabilizing dye images. Examples of such a processing solution include solution preferably with a pH value of 3 to 6 having a buffering capability, and solution containing an aldehyde (e.g., formalin, glutaraldehyde), hexamethylenetetramine compound, hexahydrotriazine compound or N-methylol compound disclosed in JP-A-2-153348 and U.S. Pat. No. 4,859,574. The stabilizing solution may contain all compounds which can be incorporated in the rinsing solution. The stabilizing solution may optionally further contain an ammonium compound such as ammonium chloride and ammonium sulfite, metallic compound such as Bi and Al, fluorescent brightening agent, various dye stabilizers such as N-methylol compound as described in JP-A-2-153350 and JP-A-2-153348, and U.S. Pat. No. 4,859,574, film hardener, and alkanolamine as described in U.S. Pat. No. 4,786,581. A stabilization method using the above mentioned dye stabilizers may also be used.

The rinsing step or stabilizing step is preferably effected in a multistage countercurrent process. The number of stages is preferably 2 to 4. The replenishment rate of the rinsing solution or stabilizing solution is generally 1 to 50 times, preferably 2 to 30 times, more preferably 2 to 15 times the amount of the solution to be brought over from the preceding bath per unit area.

As water to be used in the rinsing step or stabilizing step there may be preferably used tap water, water obtained by deionizing water with an ion exchange resin so that Ca and Mg concentrations are each reduced to 5 mg/l or less, and water sterilized by halogen, ultraviolet ray, etc.

As water for making up for the evaporation loss there may be used tap water, preferably the above mentioned deionized or sterilized water which can be preferably used in the the rinsing step or stabilizing step.

In the present invention, in order to correct for the concentration due to evaporation in the bleaching solution and blix solution as well as other processing solutions, a proper amount of water or correcting solution or processing replenisher may be preferably supplied into the system.

The overflow solution from the rinsing step or stabilizing step can be flown into a preceding bath having a fixing capability to reduce the amount of the processing solution to be discharged.

The processing method of the present invention may be preferably effected by means of an automatic developing machine. Conveying methods in such an automatic developing machine are described in JP-A-60-191257, JP-A-60-191258, and JP-A-60-191259. In order to speed up the processing, the crossover time between processing baths in the automatic developing machine is preferably minimized. An automatic developing machine with a crossover time of 10 seconds or less is described in JP-A-1-319038.

When a continuous processing is effected by means of an automatic developing machine in accordance with the processing method of the present invention, a replenisher may be preferably supplied into the system depending on the amount of the light-sensitive material which has been processed in order to make up for the consumption of components of the processing solution accompanied by the processing of the light-sensitive material or inhibit the accummulation of undesired components eluted from the light-sensitive material in the processing solution. Further, two or more procesing baths may be provided in each processing step. In this case, a countercurrent process may be preferably used wherein a replenisher flows from one bath to its preceding bath. In particular, the rinse step and the stabilizing step may be preferably effected in a 2- to 4-stage cascade system.

The amount of the replenisher to be supplied may be preferably reduced so far as the change in the composition of each processing solution doesn't cause any deterioration of photographic properties or other troubles such as solution contamination.

For color light-sensitive materials for picture taking, the amount of the color developer replenisher to be supplied is generally in the range of 100 ml to 1,500 ml, preferably 100 ml to 1,000 ml per $m^2$ of light-sensitive material. For color light-sensitive materials for print, the amount of the color developer replenisher to be supplied is generally in the range of 20 ml to 500 ml, preferably 30 ml to 200 ml per $m^2$ of light-sensitive material.

For color light-sensitive materials for picture taking, the amount of the bleaching solution replenisher to be supplied is generally in the range of 10 ml to 500 ml, preferably 10 ml to 160 ml per $m^2$ of light-sensitive material. For color light-sensitive materials for print, the amount of the bleaching solution replenisher to be supplied is generally in the range of 20 ml to 300 ml, preferably 50 ml to 150 ml per $m^2$ of light-sensitive material.

For color light-sensitive materials for picture taking, the amount of the blix solution replenisher to be supplied is generally in the range of 100 ml to 3,000 ml, preferably 200 ml to 1,300 ml per $m^2$ of light-sensitive material. For color light-sensitive materials for print, the amount of the blix solution replenisher to be supplied is generally in the range of 20 ml to 300 ml, preferably 50 ml to 200 ml per $m^2$ of light-sensitive material. The blix solution replenisher may be supplied as monobath or separately as bleaching composition and fixing composition. Alternatively, the overflow solution from the bleaching bath and/or the fixing bath may be mixed to provide a blix solution replenisher.

For color light-sensitive materials for picture taking, the amount of the fixing solution replenisher to be supplied is generally in the range of 300 ml to 3,000 ml, preferably 300 ml to 1,000 ml per $m^2$ of light-sensitive material. For color light-sensitive materials for print, the amount of the fixing solution replenisher to be supplied is in the range of 20 ml to 300 ml, preferably 50 ml to 200 ml per $m^2$ of light-sensitive material.

The replenishment rate of the rinsing solution or stabilizing solution is generally 1 to 50 times, preferably 2 to 30 times, more preferably 2 to 15 times the amount of the solution to be brought over from the preceding bath per unit area.

In order to further reduce the replenishment rate for environmental protection, various regeneration methods may be preferably used in combination. The regeneration of the processing solution may be effected while the processing solution is circulated in the automatic developing machine. Alternatively, the processing solution may be removed from the processing bath, subjected to a proper regeneration treatment, and then returned to the processing bath as replenisher.

The regeneration of the developer can be accomplished by the ion exchange with an anionic exchange resin, the removal of accummulated substances by electrodialysis and/or the addition of a chemical as regenerant. The percent regeneration is preferably 50% or more, more preferably 70% or more. As such an anionic exchange resin there may be used one commercially available. An ion exchanger having a high selectivity as disclosed in JP-A-63-11005 may be preferably used.

The metal chelate bleaching agent contained in the bleaching solution and/or blix solution becomes a reduced state upon bleach. When the metal chelate of the reduced state is accummulated, the bleaching capacity is lowered. In some cases, the image dye becomes a leuco dye, causing a drop in the image density. Therefore, the bleaching solution and/or blix solution may be preferably subjected to a continuous regeneration treatment in linkage with processing. Specifically, an air pump may be preferably used to blow air through the bleaching solution and/or blix solution so that the metal chelate of the reduced state is reoxidized with oxygen (so-called aeration). The regeneration of the processing solution may also be accomplished by the addition of an oxidizing agent such as hydrogen peroxide, persulfate and bromate.

The regeneration of the fixing solution or blix solution can be accomplished by electrolytic reduction of accummulated silver ions. Accummulated halogen ions may be preferably removed by an anionic exchange resin to maintain the desired fixing properties.

In order to reduce the amount of rinsing solution to be used, ion exchange or ultrafiltration may be used. In particular, ultrafiltration may be preferably used.

The photographic light-sensitive material adapted for the present processing can comprise at least one blue-sensitive layer, at least one green-sensitive layer and at least one red-sensitive layer on a support. The number of silver halide emulsion layers and light-insensitive layers and the order of arrangement of these layers are not specifically limited. In a typical embodiment, the silver halide photographic material comprises light-sensitive layers consisting of a plurality of silver halide emulsion layers having substantially the same color sensitivity and different light sensitivities on a support. The light-sensitive layers are unit light-sensitive layers having a color sensitivity to any of blue light, green light and red light. In the multi-layer silver halide color photographic material, these unit light-sensitive layers are normally arranged in the order of red-sensitive layer, green-sensitive layer and blue-sensitive layer as viewed from the support side. However, the order of arrangement can be optionally reversed depending on the purpose of application. Alternatively, two unit light-sensitive layers having the same color sensitivity can be arranged with a unit light-sensitive layer having a different color sensitivity interposed therebetween.

Light-insensitive layers such as various interlayers can be provided between these silver halide light-sensitive layers and on the uppermost layer and lowermost layer.

These interlayers can comprise couplers, DIR compounds or the like as described in JP-A-61-43748, JP-A-59-113438, JP-A-59-113440, JP-A-61-20037 and JP-A-61-20038. These interlayers can further comprise a color stain inhibitor, ultraviolet absorbent, stain inhibitor, etc. as commonly used.

The plurality of silver halide emulsion layers constituting each unit light-sensitive layer can be preferably in a two-layer structure, i.e., high sensitivity emulsion layer and low sensitivity emulsion layer, as described in West German Patent 1,121,470 and British Patent 923,045. In general, these layers are preferably arranged in such an order that the light sensitivity becomes lower towards the support. Furthermore, a light-insensitive layer can be provided between these silver halide emulsion layers. As described in JP-A-57-112751, JP-A-62-200350, JP-A-62-206541, and JP-A-62-206543, a low sensitivity emulsion layer can be provided remote from the support while a high sensitivity emulsion layer can be provided nearer to the support.

In an embodiment of such an arrangement, a low sensitivity blue-sensitive layer (BL), a high sensitivity blue-sensitive layer (BH), a high sensitivity green-sensitive layer (GH), a low sensitivity green-sensitive layer (GL), a high sensitivity red-sensitive layer (RH), and a low sensitivity red-sensitive layer (RL) can be arranged in this order remote from the support. In another embodiment, BH, BL, GL, GH, RH, and RL can be arranged in this order remote from the support. In a further embodiment, BH, BL, GH, GL, RL, and RH can be arranged in this order remote from the support.

As described in JP-B-55-34932, a blue-sensitive layer, GH, RH, GL, and RL can be arranged in this order remote from the support. Alternatively, as described in JP-A-56-25738 and JP-A-62-63936, a blue-sensitive layer, GL, RL, GH, and RH can be arranged in this order remote from the support.

As described in JP-B-49-15495, a layer arrangement can be used such that the uppermost layer is a silver halide emulsion layer having the highest sensitivity, the middle layer is a silver halide emulsion layer having a lower sensitivity, and the lowermost layer is a silver halide emulsion layer having a lower sensitivity than that of the middle layer. In such a layer arrangment, the light sensitivity becomes lower towards the support. Even if the layer structure comprises three layers having different light sensitivities, a middle sensitivity emulsion layer, a high sensitivity emulsion layer and a low sensitivity emulsion layer can be arranged in this order remote from the support in a color-sensitive layer as described in JP-A-59-2024643.

As described above, various layer structures and arrangements can be selected depending on the purpose of light-sensitive material.

Any of these layer arrangements can be applied to the color light-sensitive material of the present invention. In the present invention, the dried thickness of all the constituting layers of the color light-sensitive material except for support and its subbing layer is preferably in the range of 20.0 μm or less, more preferably 18.0 μm or less to accomplish the objects of the present invention.

The specification of the dried film thickness is based on the color developing agent to be incorporated into these constituting layers during and after processing. This means that bleach fogging or stain during the storage of images after processing depends greatly on the amount of the remaining color developing agent. In respect to the occurrence of bleach fogging or stain, the increase in magenta color probably due to the green-sensitive layer is greater than that in cyan and yellow colors.

The lower limit of the specified film thickness is preferably lowered from the above mentioned specification to such an extent that the properties of the light-sensitive material is not remarkably deteriorated. The lower limit of the total dried thickness of the layers constituting the light-sensitive material except support and its subbing layer is 12.0 μm. The lower limit of the total dried thickness of the constituting layers provided between the light-sensitive layer nearest to the support and the subbing layer of the support is 1.0 μm.

The reduction of the film thickness may be effected in either light-sensitive layer or light-insensitive layer.

The film thickness of the multilayer color light-sensitive material of the present invention can be determined in accordance with the following method:

The light-sensitive material specimen is stored at a temperature of 25° C. and a relative humidity of 50% for 7 days. The total thickness of the specimen is determined. The coating layers are then removed from the support. The thickness of the support is determined. The difference in the two measurements is the total thickness of the coating layers. The measurement of the film thickness can be accomplished by means of a contact type thickness meter comprising a piezoelectric element (e.g., K-402B Stand, available from Anritus Electric Co., Ltd.). The removal of the coating layers from the support can be effected by the use of an aqueous solution of sodium hypochlorite.

A section of the specimen is photographed by a scanning type electron microscope preferably at 3,000 power or more. The total thickness of the coating layers on the support and the thickness of each of these coating layers are measured and compared to the measured value of the toal thickness of the coating layers obtained by the film thickness meter (absolute value of the measured thickness) to calculate the thickness of each of these coating layers.

The percent swelling of the light-sensitive material of the present invention [determined by (equilibrium swollen film thickness in water at 25° C.—total dried film thickness at 25° C., 55% RH/total dried film thickness at 25° C., 55% RH)×100] is preferably in the range of 50 to 200%, more preferably 70 to 150%. If this value deviates from the above specified range, the remaining amount of the color developing agent increases, giving adverse effects on photographic properties, desilvering property and other picture qualities, and film physical properties such as film strength.

The swelling rate of the light-sensitive material of the present invention (as determined by T1/2, which is defined by the time required to reach half the saturated swollen film thickness (90% of the maximum swollen film thickness in the color developer (at a temperature of 30° C., 195 seconds) ) is preferably in the range of 15 seconds or less, more preferably 9 seconds or less.

The silver halide to be incorporated in the photographic emulsion layer in the color light-sensitive material of the present invention may be any silver halide composition such as silver chloride, silver bromide, silver bromochloride, silver bromoiodide, silver chloroiodide and silver bromochloroiodide.

Silver halide grains in the photographic emulsions may be so-called regular grains having a regular crystal form, such as cube, octahedron and tetradecahedron, or those having an irregular crystal form such as sphere and tabular, those having a crystal defect such as twinning plane, or those having a combination of these crystal forms.

The silver halide grains may be either fine grains of about 0.2 μm or smaller in diameter or giant grains having a projected area diameter of up to about 10 μm. The emulsion may be either a monodisperse emulsion or a polydisperse emulsion.

The preparation of the silver halide photographic emulsion which can be used in the present invention can be accomplished by any suitable method as described in *Research Disclosure* No. 17643 (December 1978), pp. 22–23, and No. 307105 (November 1989), pp. 863–865, "I. Emulsion Preparation and Types", and No. 18716 (November 1979), page 648, Glafkides, "Chimie et Physique Photographique", Paul Montel (1967), G. F. Duffin, "Photographic Emulsion Chemistry", Focal Press, 1966, and V. L. Zelikman et al., "Making and Coating Photographic Emulsion Focal Press", 1964.

Furthermore, monodisperse emulsions as described in U.S. Pat. Nos. 3,574,628 and 3,655,394, and British Patent 1,413,748 can be preferably used in the present invention.

Tabular grains having an aspect ratio of about 5 or more can also be used in the present invention. The preparation of such tabular grains can be easily accomplished by any suitable method as described in Gutoff, "Photograpahic Science and Engineering", vol. 14, pp. 248–257, 1970, U.S. Pat. Nos. 4,434,226, 4,414,310, 4,433,048, and 4,439,520, and British Patent 2,112,157.

The individual silver halide crystals may have either a homogeneous structure or a heterogeneous structure composed of an inner portion and an outer portion differing in halogen composition, or may have a layered structure. Furthermore, the grains may have fused thereto a silver halide having a different halogen composition or a compound other than silver halide, e.g., silver thiocyanate, lead oxide, etc. by an epitaxial junction.

Mixtures of grains having various crystal forms may also be used.

The silver halide emulsion to be used in the present invention is normally subjected to physical ripening, chemical ripening and spectral sensitization. Additives to be used in these steps are described in *Research Disclosure* Nos. 17643, 18716 and 307105 as tabulated below.

Known photographic additives which can be used in the present invention are described in the above-cited three *Research Disclosures* as tabulated below.

| Kind of additive | RD17643 [Dec. '78] | RD18716 [Nov. '79] | RD307105 [No. '89] |
|---|---|---|---|
| 1. Chemical sensitizer | p. 23 | p. 648 right column (RC) | p. 866 |
| 2. Sensitivity increasing agent | | p. 648 right column (RC) | |
| 3. Spectral sensitizer | pp. 23–24 | p. 648 RC–p. 649 RC | pp. 866–868 |
| 4. Brightening agent | p. 24 | p. 647 RC | p. 868 |
| 5. Antifoggant and stabilizer | pp. 24–25 | p. 649 RC | pp. 868–870 |
| 6. Light absorbent, filter dye, and ultraviolet absorbent | pp. 25–26 | p. 649 RC–p. 650 LC | p. 873 |
| 7. Stain inhibitor | p. 25 RC | p. 650 LC-RC | p. 872 |
| 8. Dye image stabilizer | p. 25 | p. 650 LC | " |
| 9. Hardening agent | p. 26 | p. 651 LC | pp. 874–875 |
| 10. Binder | p. 26 | p. 650 LC | pp. 873–874 |
| 11. Plasticizer and lubricant | p. 27 | p. 650 RC | p. 876 |
| 12. Coating aid and surface active agent | pp. 26–27 | " | pp. 875–876 |
| 13. Antistatic agent | p. 27 | " | pp. 876"877 |
| 14. Matting agent | | | pp. 878–879 |

couplers are described in the patents described in the above cited Research Disclosure No. 17643, VII-C to G and No. 307105, VII-C to G.

Preferred yellow couplers include those described in U.S. Pat. Nos. 3,933,501, 4,022,620, 4,326,024, 4,401,752, 4,248,961, 3,973,968, 4,314,023, and 4,511,649, JP-B-58-10739, British Patents 1,425,020 and 1,476,760, and European Patent 249,473A.

Preferred magenta couplers include 5-pyrazolone compounds and pyrazoloazole compounds. Particularly preferred are those described in U.S. Pat. Nos. 4,310,619, 4,351,897, 3,061,432, 3,725,064, 4,500,630, 4,540,654, and 4,556,630, European Patent 73,636, JP-A-60-33552, JP-A-60-43659, JP-A-61-72238, JP-A-60-35730, JP-A-55-118034, and JP-A-60-185951, RD Nos. 24220 (June 1984) and 24230 (June 1984), and WO(PCT)88/04795. The effects of the present invention on bleach fogging and stain become remarkable particularly with pyrazoloazole couplers.

Cyan couplers include naphthol and phenol couplers. Preferred are those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, 4,327,173, 3,446,622, 4,333,999, 4,753,871, 4,451,559, 4,427,767, 4,690,889, 4,254,212, and 4,296,199, West German Patent Disclosure No. 3,329,729, European Patents 121,365A and 249,453A, and JP-A-61-42658.

Colored couplers for correction of unnecessary absorptions of the developed color preferably include those described in Research Disclosure No. 17643, VII-G, U.S. Pat. Nos. 4,163,670, 4,004,929, and 4,138,258, JP-B-57-39413, and British Patent 1,146,368. Furthermore, couplers for correction of unnecessary absorptions of the developed color by a fluorescent dye released upon coupling as described in U.S. Pat. No. 4,774,181 and couplers containing as a separatable group a dye precursor group capable of reacting with a developing agent to form a dye as described in U.S. Pat. No. 4,777,120 can be preferably used.

Couplers which form a dye having moderate diffusibility preferably include those described in U.S. Pat. No. 4,366,237, British Patent 2,125,570, European Patent 96,570, and West German Patent Publication No. 3,234,533.

Typical examples of polymerized dye-forming couplers are described in U.S. Pat. Nos. 3,451,820, 4,080,211, 4,367,282, 4,409,320, and 4,576,910, and British Patent 2,102,173.

Couplers capable of releasing a photographically useful residual upon coupling can also be used in the present invention. Preferred examples of DIR couplers which release a developing inhibitor are described in the patents cited in RD 17643, VII-F, JP-A-57-151944, JP-A-57-154234, JP-A-60-184248, and JP-A-63-37346, and U.S. Pat. Nos. 4,248,962, and 4,782,012.

Couplers capable of imagewise releasing a nucleating agent or a developing accelerator at the time of development preferably include those described in British Patents 2,097,140 and 2,131,188, and JP-A-59-57638 and JP-A-59-170840.

In addition to the foregoing couplers, the photographic material according to the present invention can further comprise competing couplers as described in U.S. Pat. No. 4,130,427, polyequivalent couplers as described in U.S. Pat. Nos. 4,283,472, 4,338,393, and 4,310,618, DIR redox compound-releasing couplers, DIR coupler releasing couplers, DIR coupler-releasing redox compound or DIR redox-releasing redox compound as described in JP-A-60-185950 and JP-A-62-24252, couplers capable of releasing a dye which returns to its original color after release as described in European Patent 173,302A, couplers capable of releasing a bleach accelerator as described in RD Nos. 11449 and 24241, and JP-A-61-201247, couplers capable of releasing a ligand as described in U.S. Pat. No. 4,553,477, couplers capable of releasing a leuco dye as described in JP-A-63-75747, and couplers capable of releasing a fluorescent dye as described in U.S. Pat. No. 4,774,181.

The incorporation of these couplers in the light-sensitive material can be accomplished by any suitable known dispersion method.

Examples of high boiling solvents to be used in the oil-in-water dispersion process are described in U.S. Pat. No. 2,322,027. Specific examples of high boiling organic solvents having a boiling point of 175° C. or higher at normal pressure which can be used in the oil-in-water dispersion process include phthalic esters (e.g., dibutyl phthalate, dicylcohexyl phthalate, di-2-ethylhexyl phthalate, decyl phthalate, bis(2,4-di-t-amylphenyl)phthalate, bis(2,4-di-t-amylphenyl) isophthalate, bis(1,1-diethylpropyl)phthalate), phosphoric or phosphonic esters (e.g., triphenyl phosphate, tricresyl phosphate, 2-ethylhexyl diphenyl phosphate, tricyclohexyl phosphate, tri-2-ethylhexyl phosphate, tridodecyl phosphate, tributoxy ethyl phosphate, trichloropropyl phosphate, di-2-ethylhexyl phenyl phospionate), benzoic esters (e.g., 2-ethylhexyl benzoate, dodecyl benzoate, 2-ethylhexyl-p-hydroxy benzoate), amides (e.g., N,N-diethyldodecanamide, N,N-diethyllaurylamide, N-tetradecylpyrrolidone), alcohols or phenols (e.g., isostearyl alcohol, 2,4-di-tert-amylphenol), aliphatic carboxylic esters (e.g., bis(2-ethylhexyl)sebacate, dioctyl azerate, glycerol tributylate, isostearyl lactate, trioctyl citrate), aniline derivatives (N,N-dibutyl-2-butoxy-5-tert-octylaniline), and hydrocarbons (e.g., paraffin, dodecylbenzene, diisopropyl naphthalene). As an auxiliary solvent there can be used an organic solvent having a boiling point of about 30° C. or higher, preferably 50° C. to about 160° C. Typical examples of such an organic solvent include ethyl acetate, butyl acetate, ethyl propionate, methyl ethyl ketone, cyclohexanone, 2-ethoxyethyl acetate, and dimethylformamide.

The process and effects of latex dispersion method and specific examples of latexes to be used in dipping are described in U.S. Pat. No. 4,199,363, West German Patent Application (OLS) 2,541,274, and 2,541,230.

These couplers can impregnate a loadable latex polymer (as described in U.S. Pat. No. 4,203,716) in the presence or absence of the above mentioned high boiling organic solvent or can be dissolved in a water-insoluble and organic solvent-soluble polymer before being emulsion-dispersed in an aqueous solution of hydrophilic colloid.

Preferably, homopolymers or copolymers as described in International Patent Disclosure No. W088/00723, pp. 12–30 can be used. In particular, acrylamide polymers may be preferably used for the purpose of stabilizing dye images or like purposes.

Suitable supports which can be used in the present invention are described in the above cited RD 17643 (page 28) and 18716 (right column on page 647 to left column on page 648).

The present invention can be applied to various color light-sensitive materials such as color negative films for motion picture, color reversal film for slide or television, color paper, direct positive color paper, color positive film and color reversal paper. The color reversal film may be of the so-called coupler-in-emulsion type (coupler incorporated in the light-sensitive material) or the so-called coupler-in-developer type (coupler incorporated in the developer).

The present invention will be further described in the following examples, but the present invention should no be construed as being limited thereto.

EXAMPLE 1

A multilayer color light-sensitive material was prepared as Specimen 101 by coating on a undercoated cellulose triacetate film support various layers having the following compositions.

Composition of Photographic Layer

The coated amount of silver halide and colloidal silver is represented in g/m$^2$ calculated in terms of the amount of silver. The coated amount of couplers, additives and gelatin is represented in g/m$^2$. The coated amount of sensitizing dye is represented in mols per mol of silver halide contained in the same layer.

| 1st Layer: anti-halation layer | |
|---|---|
| Black colloidal silver (coated silver amount) | 0.20 |
| Gelatin | 2.20 |
| UV-1 | 0.11 |
| UV-2 | 0.20 |
| Cpd-1 | $4.0 \times 10^{-2}$ |
| Cpd-2 | $1.9 \times 10^{-2}$ |
| Solv-1 | 0.30 |

-continued

| | |
|---|---|
| Solv-2 | $1.2 \times 10^{-2}$ |
| 2nd Layer: interlayer | |
| Finely divided silver bromide grains (AgI content: 1.0 mol %; diameter: 0.07 μm as calculated in terms of sphere) (coated silver amount) | 0.15 |
| Gelatin | 1.00 |
| ExC-4 | $6.0 \times 10^{-2}$ |
| Cpd-3 | $2.0 \times 10^{-2}$ |
| 3rd layer: 1st red-sensitive emulsion layer | |
| Silver bromoiodide emulsion (AgI content: 5.0 mol%; high surface AgI type; diameter: 0.9 μm (as calculated in terms of sphere); coefficient of fluctuation in grain diameter: 21% (as calculated in terms of sphere); tabular grains; diameter/thickness ratio: 7.5) (coated silver amount) | 0.42 |
| Silver bromoiodide emulsion (AGI content: 4.0 mol %; high internal AgI type; diameter: 0.4 μm (as calculated in terms of sphere); coefficient of fluctuation in grain diameter: 18% (as calculated in terms of sphere); tetra-decahedral grains) (coated silver amount) | 0.40 |
| Gelatin | 1.90 |
| ExS-1 | $4.5 \times 10^{-4}$ mol |
| ExS-2 | $1.5 \times 10^{-4}$ mol |
| ExS-3 | $4.0 \times 10^{-5}$ mol |
| ExC-1 | 0.65 |
| ExC-3 | $1.0 \times 10^{-2}$ |
| ExC-4 | $2.3 \times 10^{-2}$ |
| Solv-1 | 0.32 |
| 4th Layer: 2nd red-sensitive emulsion layer | |
| Silver bromoiodide emulsion (AgI content: 8.5 mol %; high internal AgI type; diameter: 1.0 μm (as calculated in terms of sphere); coefficient of fluctuation in grain diameter: 25% (as calculated in terms of sphere); tabular grains; diameter/thickness ratio: 3.0) (coated silver amount) | 0.85 |
| Gelatin | 0.91 |
| ExS-1 | $3.0 \times 10^{-4}$ mol |
| ExS-2 | $1.0 \times 10^{-4}$ mol |
| ExS-3 | $3.0 \times 10^{-5}$ mol |
| ExC-1 | 0.13 |
| ExC-2 | $6.2 \times 10^{-2}$ |
| ExC-4 | $4.0 \times 10^{-2}$ |
| Solv-1 | 0.10 |
| 5th Layer: 3rd red-sensitive emulsion layer | |
| Silver bromoiodide emulsion (AgI content: 11.3 mol %; high internal AgI type; diameter: 1.4 μm (as calculated in terms of sphere); coefficient of fluctuation in grain diameter: 28% (as calculated in terms of sphere); tabular grains; diameter/thickness ratio: 6.0) (coated silver amount) | 1.50 |
| Gelatin | 1.20 |
| ExS-1 | $2.0 \times 10^{-4}$ mol |
| ExS-2 | $6.0 \times 10^{-5}$ mol |
| ExS-3 | $2.0 \times 10^{-5}$ mol |
| ExC-2 | $8.5 \times 10^{-2}$ |
| ExC-5 | $7.3 \times 10^{-2}$ |
| Solv-1 | 0.12 |
| Solv-2 | 0.12 |
| 6th Layer: interlayer | |
| Gelatin | 1.00 |
| Cpd-4 | $8.0 \times 10^{-2}$ |
| Solv-1 | $8.0 \times 10^{-2}$ |
| 7th Layer: 1st green-sensitive emulsion layer | |
| Silver bromoiodide emulsion (AgI content: 5.0 mol %; high surface AgI type; diameter: 0.9 μm (as calculated in terms of sphere); coefficient of fluctuation in grain diameter: 21% (as calculated in terms of sphere); tabular grains; diameter/thickness ratio: 7.0) (coated silver amount) | 0.28 |
| Silver bromoiodide emulsion (AgI content: 4.0 mol %; high internal AgI type; diameter: 0.4 μm (as calculated in terms of sphere); coefficient of fluctuation in grain diameter: 18% 18% (as calculated in terms of sphere); tetra-decahtedral grains) (coated silver amount) | 0.16 |
| Gelatin | 1.20 |

-continued

| | |
|---|---|
| ExS-4 | $5.0 \times 10^{-4}$ mol |
| ExS-5 | $2.0 \times 10^{-4}$ mol |
| ExS-6 | $1.0 \times 10^{-4}$ mol |
| ExM-1 | 0.50 |
| ExM-2 | 0.10 |
| ExM-5 | $3.5 \times 10^{-2}$ |
| Solv-1 | 0.20 |
| Solv-3 | $3.0 \times 10^{-2}$ |
| 8th layer: 2nd green-sensitive emulsion layer | |
| Silver bromoiodide emulsion (AgI content: 8.5 mol %; high internal AgI type; diameter: 1.0 μm (as calculated in terms of sphere); coefficient of fluctuation in grain diameter: 25% (as calculated in terms of sphere); tabular grains; diameter/thickness ratio: 3.0) (coated silver amount) | 0.57 |
| Gelatin | 0.45 |
| ExS-4 | $3.5 \times 10^{-4}$ mol |
| ExS-5 | $1.4 \times 10^{-4}$ mol |
| ExS-6 | $7.0 \times 10^{-5}$ mol |
| ExM-1 | 0.12 |
| ExM-2 | $7.1 \times 10^{-3}$ |
| ExM-3 | $3.5 \times 10^{-2}$ |
| Solv-1 | 0.15 |
| Solv-3 | $1.0 \times 10^{-2}$ |
| 9th Layer: interlayer | |
| Gelatin | 0.50 |
| Solv-1 | $2.0 \times 10^{-2}$ |
| 10th Layer: 3rd green-sensitive emulsion layer | |
| Silver bromoiodide emulsion (AgI content: 11.3 mol %; high internal AgI type; diameter: 1.4 μm (as calculated in terms of sphere); coefficient of fluctuation in grain diameter: 28% (as calculated in terms of sphere); tabular grains; diameter/thickness ratio: 6.0) (coated silver amount) | 1.30 |
| Gelatin | 1.20 |
| ExS-4 | $2.0 \times 10^{-4}$ mol |
| ExS-5 | $8.0 \times 10^{-5}$ mol |
| ExS-6 | $8.0 \times 10^{-5}$ mol |
| ExM-4 | $4.5 \times 10^{-2}$ |
| ExM-6 | $1.0 \times 10^{-2}$ |
| ExC-2 | $4.5 \times 10^{-2}$ |
| Cpd-5 | $1.0 \times 10^{-2}$ |
| Solv-1 | 0.25 |
| 11th Layer: yellow filter layer | |
| Gelatin | 0.50 |
| Cpd-6 | $5.2 \times 10^{-2}$ |
| Solv-1 | 0.12 |
| 12th Layer: interlayer | |
| Gelatin | 0.45 |
| Cpd-3 | 0.10 |
| 13th Layer: 1st blue-sensitive layer | |
| Silver bromoiodide emulsion (AgI content: 2 mol %; uniform AgI type; diameter: 0.55 μm (as calculated in terms of sphere); coefficient of fluctuation in grain diameter: 25% (as calculated in terms of sphere); tabular grains; diameter/thickness ratio: 7.0) (coated silver amount) | 0.20 |
| Gelatin | 1.00 |
| ExS-7 | $3.0 \times 10^{-4}$ mol |
| ExY-1 | 0.60 |
| ExY-2 | $2.3 \times 10^{-2}$ |
| Solv-1 | 0.15 |
| 14th Layer: 2nd blue-sensitive emulsion layer | |
| Silver bromoiodide emulsion (AgI content: 19.0 mol %; high internal AgI type; diameter: 1.0 μm (as calculated in terms of sphere); coefficient of fluctuation in grain diameter: 16% (as calculated in terms of sphere); octahedral grains) (coated silver amount) | 0.19 |
| Gelatin | 0.35 |
| ExS-7 | $2.0 \times 10^{-4}$ mol |
| ExY-1 | 0.22 |
| Solv-1 | $7.0 \times 10^{-2}$ |
| 15th Layer: interlayer | |
| Finely divided silver bromoiodide (AgI content: 2 mol %; uniform AgI type; grain diameter: 0.13 μm as calculated in terms of sphere) | 0.20 |

-continued

| | |
|---|---|
| (coated silver amount) | |
| Gelatin | 0.36 |
| 16th layer: 3rd blue-sensitive emulsion layer | |
| Silver bromoiodide emulsion (AgI content: 14.0 mol %; high internal AgI type; grain diameter: 1.7 μm as calculated in terms of sphere; coefficient of fluctuation in grain diameter: 28% as calculated in terms of sphere; tabular grains; diameter/thickness ratio: 5.0) (coated silver amount) | 1.55 |
| Gelatin | 1.00 |
| ExS-8 | $1.5 \times 10^{-4}$ mol |
| ExY-1 | 0.21 |
| Solv-1 | $7.0 \times 10^{-2}$ |
| 17th layer: 1st protective layer | |
| Gelatin | 1.80 |
| UV-1 | 0.13 |
| UV-2 | 0.21 |
| Solv-1 | $1.0 \times 10^{-2}$ |
| Solv-2 | $1.0 \times 10^{-2}$ |
| 18th layer: 2nd protective layer | |

-continued

| | |
|---|---|
| Finely divided silver bromide grains (grain diameter: 0.07 μm as calculated in terms of sphere) (coated silver amount) | 0.36 |
| Gelatin | 0.70 |
| B-1 (diameter: 1.5 μm) | $2.0 \times 10^{-2}$ |
| B-2 (diameter: 1.5 μm) | 0.15 |
| B-3 | $3.0 \times 10^{-2}$ |
| W-1 | $2.0 \times 10^{-2}$ |
| H-1 | 0.35 |
| Cpd-7 | 1.00 |

In addition to the above mentioned components, 1,2-benzisothiazoline-3-one, n-butyl-p-hydroxybenzoate, and 2-phenoxyethanol were incorporated in the specimen in amounts of 200 ppm on the average, about 1,000 ppm and about 10,000 ppm based on gelatin, respectively. The specimen further comprised B-4, B-5, W-2, W-3, F-1, F-2, F-3, F-4, F-5, F-6, F-7, F-8, F-9, F-10, F-11, F-12, F-13, and iron salts, lead salts, gold salts, platinum salts, iridium salts, and rhodium salts.

UV-1

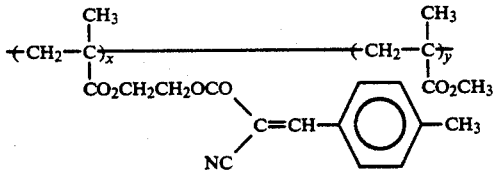

x/y = 7/3 (by weight)

UV-2

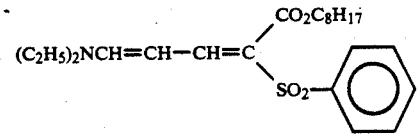

ExC-1

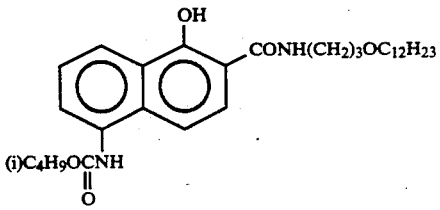

ExC-2

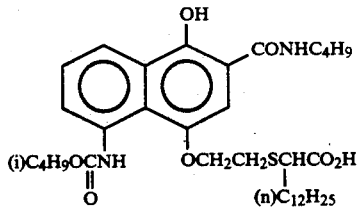

ExC-3

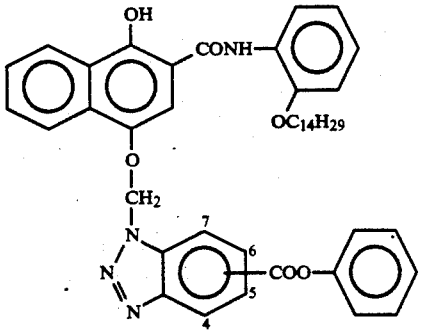

(a mixture of 5- and 6-substituted compound; the same hereinafter)

-continued
ExC-4
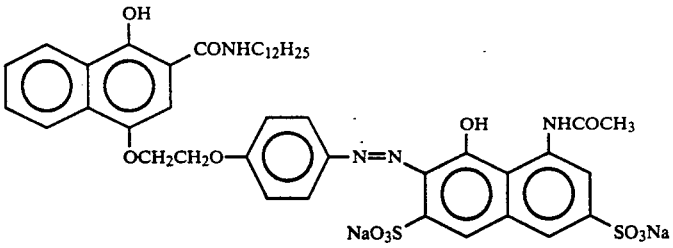
ExC-5
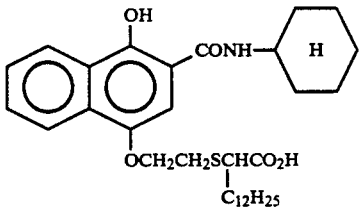
ExM-1
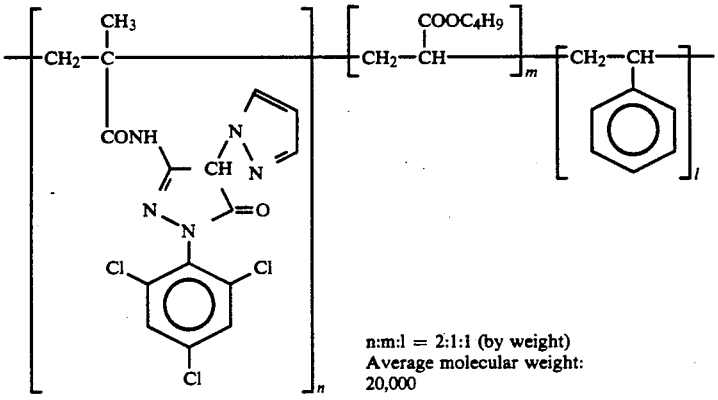
n:m:l = 2:1:1 (by weight)
Average molecular weight:
20,000
ExM-2
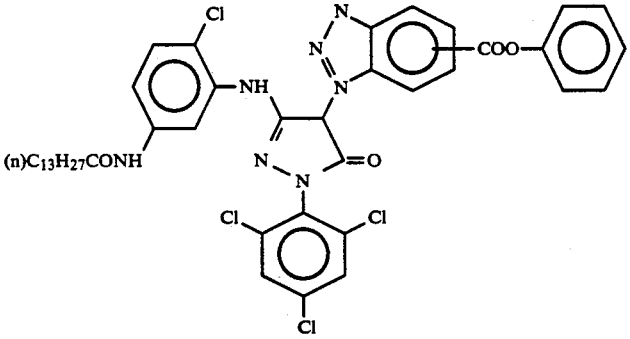
ExM-3
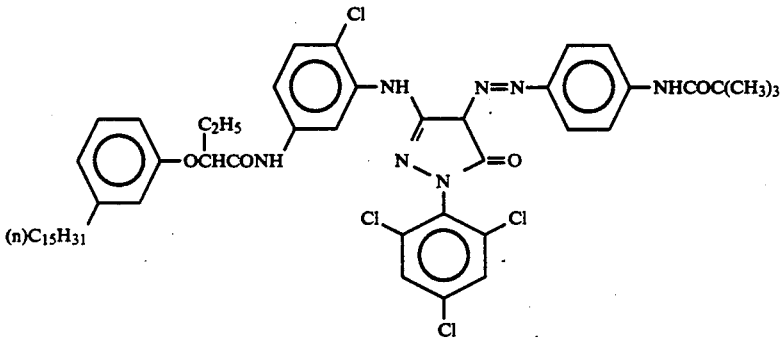

-continued
ExM-4
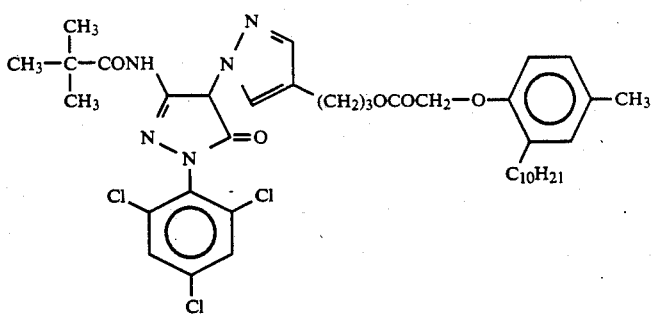
ExM-5
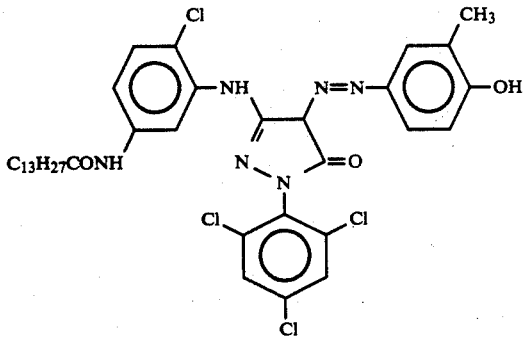
ExM-6
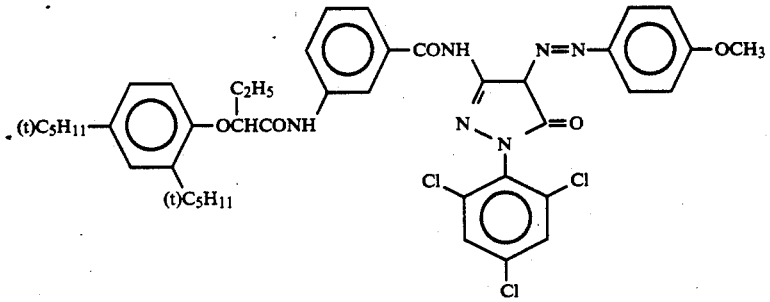
ExY-1
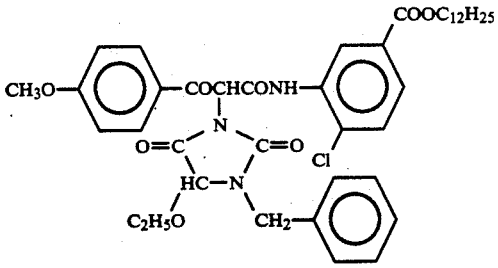
ExY-2
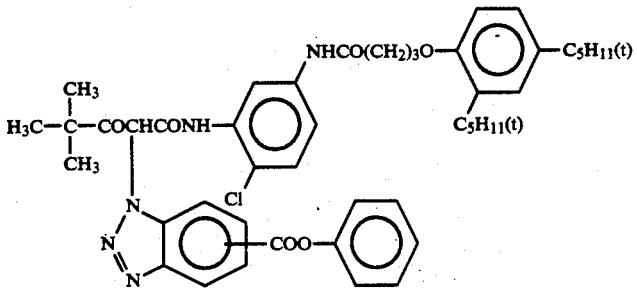

-continued
Cpd-1
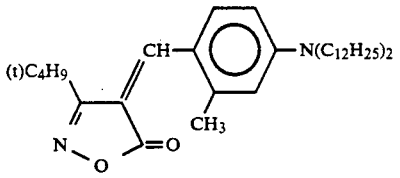
Cpd-2
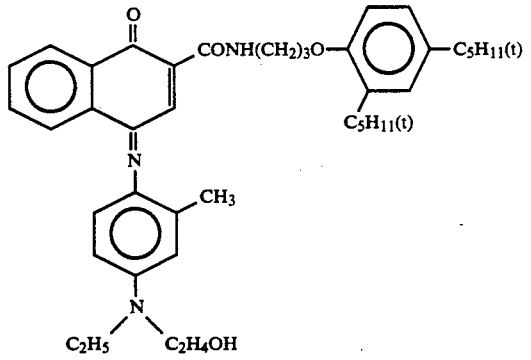
Cpd-3
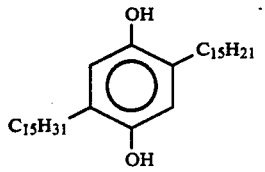
Cpd-4
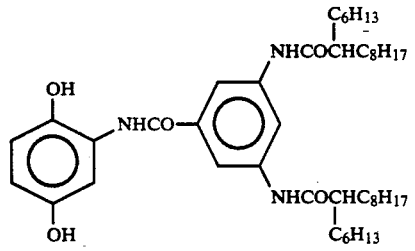
Cpd-5
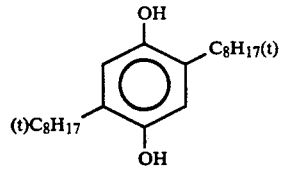
Cpd-6
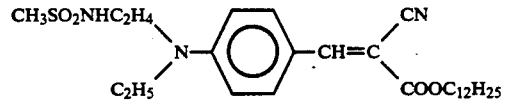
Cpd-7
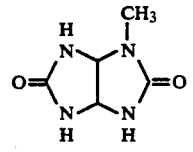
Solv-1
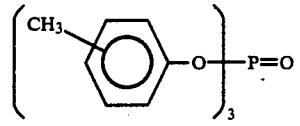

-continued
Solv-2
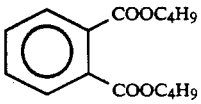
Solv-3
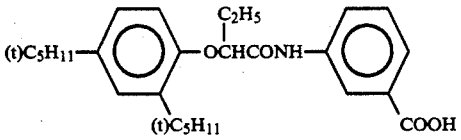
ExS-1
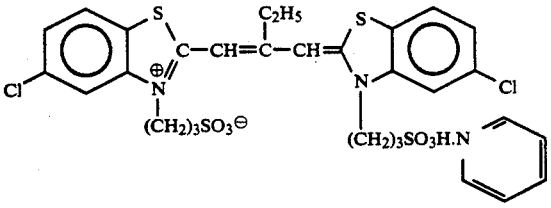
ExS-2
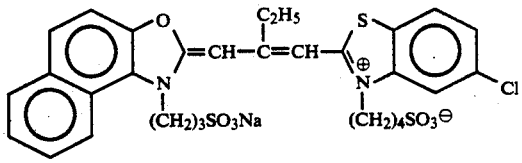
ExS-3
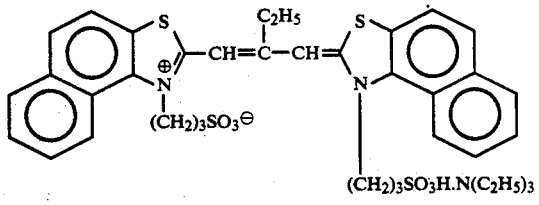
ExS-4
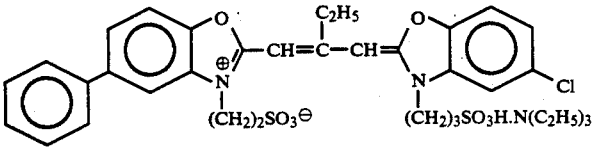
ExS-5
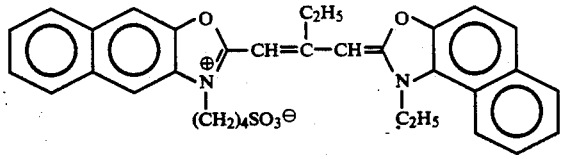
ExS-6
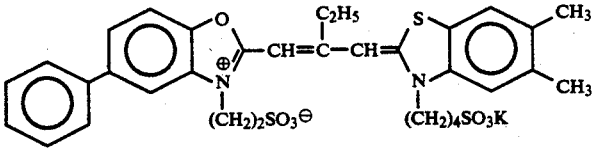
ExS-7
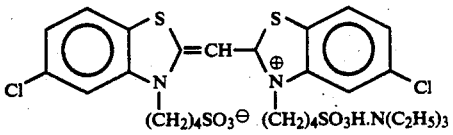

-continued
ExS-8
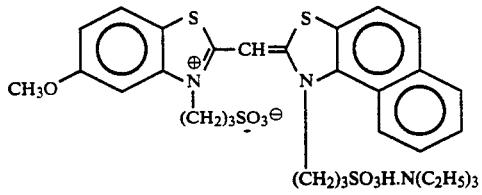
B-1
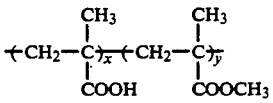
x/y = 10/90 (by mol)
B-2
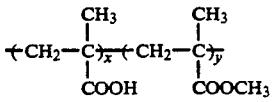
x/y = 40/60 (by mol)
B-3
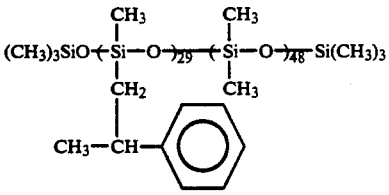
B-4
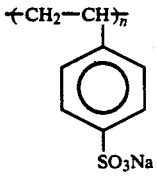
B-5
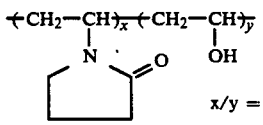
x/y = 70/30 (by mol)
$C_8P_{17}SO_2NHCH_2CH_2CH_2OCH_2CH_2\overset{\oplus}{N}(CH_3)_3$
W-1
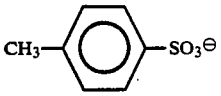
W-2
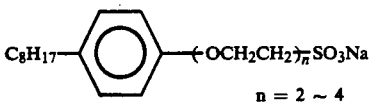
n = 2 ~ 4
W-3
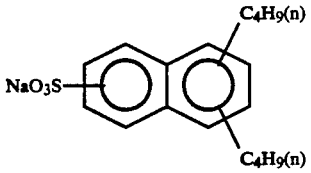
H-1
$CH_2{=}CH{-}SO_2{-}CH_2{-}CONH{-}CH_2$
$CH_2{=}CH{-}SO_2{-}CH_2{-}CONH{-}CH_2$
F-1
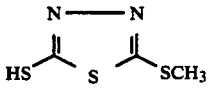

-continued
F-2
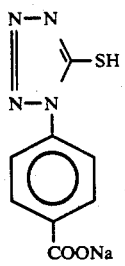
F-3
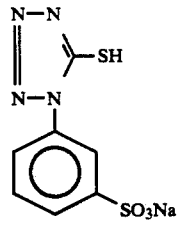
F-4
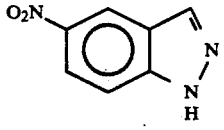
F-5
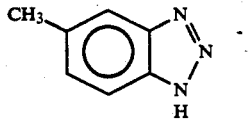
F-6
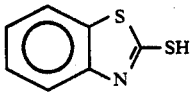
F-7
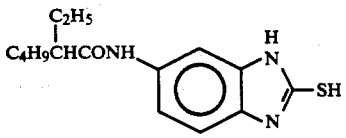
F-8
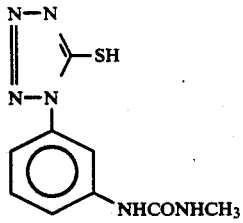
F-9
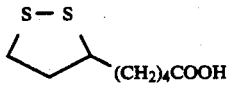
F-10
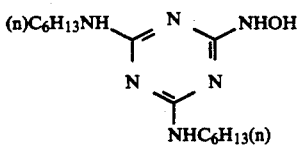

-continued

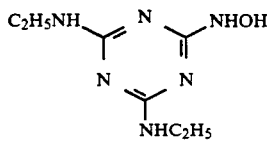

F-11

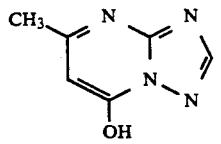

F-12

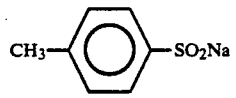

F-13

Specimen 101 thus prepared was exposed to white light (color temperature of light source: 4,800° K.) through an optical wedge, and then processed by means of an automatic developing machine for motion picture in the following process. The processing was continued until the accumulated replenishment of each processing solution reached 2.5 times the capacity of the tank. The processing properties set forth below were the results of the processing which was effected at that time.

| | | Processing step | | |
|---|---|---|---|---|
| Step | Time | Temperature | Replenishment rate* | Tank capacity |
| Color development | 3 min. 15 sec. | 38.0° C. | 23 ml | 15 l |
| Bleach | 50 sec. | 38.0° C. | 5 ml | 5 l |
| Blix | 50 sec. | 38.0° C. | — | 5 l |
| Fixing | 50 sec. | 38.0° C. | 16 ml | 5 l |
| Washing (1) | 30 sec. | 38.0° C. | — | 3 l |
| Washing (2) | 20 sec. | 38.0° C. | 34 ml | 3 l |
| Stabilization | 20 sec. | 38.0° C. | 20 ml | 3 l |
| Drying | 1 min. | 55° C. | | |

*Determined per 35-mm width and 1-m length

The washing step was effected in a countercurrent process wherein the washing water flows from (2) to (1). The oveflow solution from the washing tank was all introduced into the fixing bath. The bleaching bath was provided with a subtank through which air was blown into the bleaching bath at a rate of about 200 ml/min. to aerate the bleaching solution. The processing baths were each provided with an agitating means as described in JP-A-62-183460 so that a jet of the processing solution was allowed to collide with the emulsion surface of the light-sensitive material. The replenishment of the blix bath was accomplished by replenishing the bleaching bath and the fixing bath in such an arrangement that the upper portion of the bleaching bath and the lower portion of the blix bath, and the upper portion of the fixing bath and the lower portion of the blix bath were connected to each other via a pipe in the automatic developing machine so that the overflow solution from the bleaching bath and the fixing bath resulted by replenishing was all introduced into the blix bath. The amount of the developer to be brought over to the bleaching bath, the amount of the bleaching solution to be brought over to the blix bath, the amount of the blix solution to be brought over to the fixing bath, and the amount of the fixing solution to be brought over to the washing bath were 2.5 ml, 2.0 ml, 2.0 ml, and 2.0 ml per m of 35-mm wide light-sensitive material, respectively.

The time for crossover was 5 seconds in all the steps. This crossover time is included in the processing time at the previous step.

The various processing solutions had the following compositions:

| | Mother Solution | Replenisher |
|---|---|---|
| Diethylenetriamine-pentaacetic acid | 2.0 g | 2.2 g |
| 1-Hydroxyethylidene-1,1-diphosphonic acid | 3.3 g | 3.3 g |
| Sodium sulfite | 3.9 g | 5.2 g |
| Potassium carbonate | 37.5 g | 39.0 g |
| Potassium bromide | 1.4 g | 0.4 g |
| Potassium iodide | 1.3 mg | |
| Hydroxylamine sulfate | 2.4 g | 3.3 g |
| 2-methyl-4-[4-ethyl-N-(β-hydroxyethyl)amino]-aniline sulfate | 4.5 g | 6.1 g |
| Water to make | 1.0 l | 1.0 l |
| pH | 10.05 | 10.15 |

Bleaching Solution

| | Mother Solution | Replenisher |
|---|---|---|
| Compound as set forth in Table 1 | 0.383 mol | 0.547 mol |
| Ferric nitrate nonahydrate | 0.370 mol | 0.528 mol |
| Ammonium bromide | 84.0 g | 120.0 g |
| Ammonium nitrate | 17.5 g | 25.0 g |
| Hydroxyacetic acid | 63.0 g | 90.0 g |
| Acetic acid | 33.2 g | 47.4 g |
| Water to make | 1.0 l | 1.0 l |
| pH adjusted with aqueous ammonia | 3.60 | 2.80 |

Mother Solution for Blix Bath

A mixture of 15:85 of the above mentioned mother solution of bleaching solution and the above mentioned mother solution of fixing solution.

Fixing Solution

| | Mother Solution | Replenisher |
|---|---|---|
| Ammonium sulfite | 19.0 g | 57.0 g |
| Aqueous solution of ammonium thiosulfate (700 g/l) | 280.0 ml | 840 ml |
| Imidazole | 28.5 g | 85.5 g |
| Ethylenediaminetetraacetic acid | 12.5 g | 37.5 g |

-continued

| | Mother Solution | Replenisher |
|---|---|---|
| acid | | |
| Water to make | 1.0 l | 1.0 l |
| pH adjusted with aqueous ammonia and acetic acid | 7.40 | 7.45 |

Washing Solution (The Mother Solution Was Used Also As Replenisher)

Tap water was passed through a mixed bed column packed with an H-type strongly acidic cation exchange resin (Amberlite IR-120B available from Rohm & Haas) and an OH-type strongly basic anion exchange resin (Amberlite IRA-400 available from the same company) so that the calcium and magnesium ion concentrations were each reduced to 3 mg/l or less. Dichlorinated sodium isocyanurate and sodium sulfate were then added to the solution in amounts of 20 mg and 150 mg/l, respectively.

The washing solution thus obtained had a pH value of 6.5 to 7.5.

Stabilizing Solution (The mother solution was used also as replenisher)

| | |
|---|---|
| 37% Formalin | 2.0 ml |
| Polyoxyethylene-p-monononylphenylether (mean polymerization degree: 10) | 0.3 |
| Disodium ethylenediaminetetraacetic acid | 0.05 |
| Water to make | 1.0 l |
| pH | 5.0–8.0 |

Specimen 101 thus processed was measured for the remaining amount of silver on the maximum density portion by means of a fluorescent X-ray analyzer. The results are set forth in Table 1. The specimen was also measured for green density on the minimum density portion. Furthermore, another Specimen 101 was processed in the same manner as mentioned above except that the bleaching solution to be used in the automatic developing machine was replaced by the following reference bleaching solution causing no bleach fogging. The difference in the density on Dmin portion from that obtained by using the reference bleaching solution was determined as bleach fogging. The results are set forth in Table 1.

Reference Bleaching Solution

| | |
|---|---|
| Ferric sodium ethylenediamine-tetraacetate trihydrate | 100 g |
| Disodium ethylenediamine-tetraacetate | 10 g |
| Ammonium bromide | 100 g |
| Ammonium nitrate | 30 g |
| 27% Aqueous ammonia | 6.5 ml |
| Water to make | 1.0 l |
| pH | 6.0 |

The above mentioned specimen was stored at a temperature of 60° C. and a relative humidity of 70% for 4 weeks, and then measured for the green density on Dmin portion. The results are set forth in Table 1.

TABLE 1

| No. | Compound | Remaining amount of silver [μg/cm²] | Bleach fogging ΔDmin (G) | Increase in stain ΔD (G) |
|---|---|---|---|---|
| 101 | Comparative Compound A | 14.0 | 0.00 | 0.30 |
| 102 | Comparative Compound B | 0.8 | 0.10 | 0.16 |
| 103 | Comparative Compound C | 0.7 | 0.11 | 0.16 |
| 104 | Present Compound 1 | 0.9 | 0.04 | 0.06 |
| 105 | Present Compound 2 | 0.8 | 0.03 | 0.05 |
| 106 | Present Compound 3 | 0.3 | 0.02 | 0.02 |
| 107 | Present Compound 4 | 0.4 | 0.02 | 0.02 |
| 108 | Present Compound 5 | 0.4 | 0.04 | 0.03 |
| 109 | Present Compound 7 | 0.7 | 0.00 | 0.03 |
| 110 | Present Compound 8 | 0.6 | 0.03 | 0.03 |
| 111 | Present Compound 11 | 0.7 | 0.03 | 0.02 |
| 112 | Present Compound 16 | 0.8 | 0.02 | 0.04 |
| 113 | Present Compound 19 | 0.5 | 0.03 | 0.03 |
| 114 | Present Compound 21 | 0.5 | 0.02 | 0.04 |
| 115 | Present Compound 28 | 0.3 | 0.02 | 0.02 |
| 116 | Present Compound 29 | 0.6 | 0.04 | 0.03 |
| 117 | Present Compound 30 | 0.4 | 0.03 | 0.06 |
| 118 | Present Compound 33 | 0.4 | 0.04 | 0.05 |
| 119 | Present Compound 40 | 0.4 | 0.02 | 0.04 |
| 120 | Comparative Compound G | 6.0 | 0.19 | 0.24 |

(Note: Specimens 101 to 103 and 120 are comparative while the others are according to the present invention)

Comparative Compound A: Ethylenediamine tetraacetic acid
Comparative Compound B: 1,3-Diaminopropanetetraacetic acid
Comparative Compound C: 1,4-Diaminobutanetetraacetic acid
Comparative Compound G:

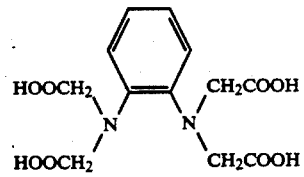

The results set forth in Table 1 show that as compared to the processing solutions comprising the comparative compounds the processing solution having a bleaching capacity comprising the chelate compounds of the present invention can reduce the remaining amount of silver and cause little bleach fogging and little increase in stain after processing.

EXAMPLE 2

A multilayer color light-sensitive material was prepared as Specimen 102 by coating on a undercoated cellulose triacetate film support various layers having the following compositions.

Composition of Photographic Layer

The coated amount of each component is represented in g/m². The coated amount of silver halide is represented in g/m² as calculated in terms of amount of silver. The coated amount of sensitizing dye is represented in mol per mol of silver halide contained in (Specimen 102)

| | |
|---|---|
| 1st layer: antihalation layer | |
| Black colloidal silver (silver) | 0.18 |
| Gelatin | 1.40 |
| 2nd Layer: interlayer | |
| 2,5-Di-t-pentadecylhydroquinone | 0.18 |
| EX-1 | 0.070 |
| EX-3 | 0.020 |
| EX-12 | $2.0 \times 10^{-3}$ |
| U-1 | 0.060 |
| U-2 | 0.080 |
| U-3 | 0.10 |
| HBS-1 | 0.10 |
| HBS-2 | 0.020 |
| Gelatin | 1.04 |
| 3rd layer: 1st red-sensitive emulsion layer | |
| Emulsion A (silver) | 0.25 |
| Emulsion B (silver) | 0.25 |
| Sensitizing dye I | $6.9 \times 10^{-5}$ |
| Sensitizing dye II | $1.8 \times 10^{-5}$ |
| Sensitizing dye III | $3.1 \times 10^{-4}$ |
| EX-2 | 0.34 |
| EX-10 | 0.020 |
| U-1 | 0.070 |
| U-2 | 0.050 |
| HBS-1 | 0.060 |
| Gelatin | 0.87 |
| 4th layer: 2nd red-sensitive emulsion layer | |
| Emulsion G (silver) | 1.00 |
| Sensitizing dye I | $5.1 \times 10^{-5}$ |
| Sensitizing dye II | $1.4 \times 10^{-5}$ |
| Sensitizing dye III | $2.3 \times 10^{-4}$ |
| EX-2 | 0.40 |
| EX-3 | 0.050 |
| EX-10 | 0.015 |
| U-1 | 0.070 |
| U-2 | 0.050 |
| U-3 | 0.070 |
| Gelatin | 1.30 |
| 5th Layer: 3rd red-sensitive emulsion layer | |
| Emulsion D (silver) | 1.60 |
| Sensitizing dye I | $5.4 \times 10^{-5}$ |
| Sensitizing dye II | $1.4 \times 10^{-5}$ |
| Sensitizing dye III | $2.4 \times 10^{-4}$ |
| EX-2 | 0.097 |
| EX-3 | 0.010 |
| EX-4 | 0.080 |
| HBS-1 | 0.22 |
| HBS-2 | 0.10 |
| Gelatin | 1.63 |
| 6th Layer: interlayer | |
| EX-5 | 0.040 |
| HBS-1 | 0.020 |
| Gelatin | 0.80 |
| 7th layer: 1st green-sensitive emulsion layer | |
| Emulsion A (silver) | 0.15 |
| Emulsion B (silver) | 0.15 |
| Sensitizing dye IV | $3.0 \times 10^{-5}$ |
| Sensitizing dye V | $1.0 \times 10^{-4}$ |
| Sensitizing dye VI | $3.8 \times 10^{-4}$ |
| EX-1 | 0.021 |
| EX-6 | 0.26 |
| EX-7 | 0.030 |
| EX-8 | 0.025 |
| HBS-1 | 0.10 |
| HBS-3 | 0.010 |
| Gelatin | 0.63 |

-continued

| | |
|---|---|
| 8th Layer: 2nd green-sensitive emulsion layer | |
| Emulsion C (silver) | 0.45 |
| Sensitizing dye IV | $2.1 \times 10^{-5}$ |
| Sensitizing dye V | $7.0 \times 10^{-5}$ |
| Sensitizing dye VI | $2.6 \times 10^{-4}$ |
| EX-6 | 0.094 |
| EX-7 | 0.026 |
| EX-8 | 0.018 |
| HBS-1 | 0.16 |
| HBS-3 | $8.0 \times 10^{-3}$ |
| Gelatin | 0.50 |
| 9th Layer: 3rd green-sensitive emulsion layer | |
| Emulsion E (silver) | 1.20 |
| Sensitizing dye IV | $3.5 \times 10^{-5}$ |
| Sensitizing dye V | $8.0 \times 10^{-5}$ |
| Sensitizing dye VI | $3.0 \times 10^{-4}$ |
| EX-1 | 0.025 |
| EX-11 | 0.10 |
| EX-13 | 0.015 |
| HBS-1 | 0.25 |
| HBS-2 | 0.10 |
| Gelatin | 1.54 |
| 10th Layer: yellow filter layer | |
| Yellow collidal silver (silver) | 0.050 |
| EX-5 | 0.080 |
| HBS-1 | 0.030 |
| Gelatin | 0.95 |
| 11th Layer: 1st blue-sensitive emulsion layer | |
| Emulsion A (silver) | 0.080 |
| Emulsion B (silver) | 0.070 |
| Emulsion F (silver) | 0.070 |
| Sensitizing dye VII | $3.5 \times 10^{-4}$ |
| EX-8 | 0.042 |
| EX-9 | 0.72 |
| HBS-1 | 0.28 |
| Gelatin | 1.10 |
| 12th Layer: 2nd blue-sensitive emulsion layer | |
| Emulsion G (silver) | 0.45 |
| Sensitizing dye VII | $2.1 \times 10^{-4}$ |
| EX-9 | 0.15 |
| EX-10 | $7.0 \times 10^{-3}$ |
| HBS-1 | 0.050 |
| Gelatin | 0.78 |
| 13th Layer: 3rd blue-sensitive emulsion layer | |
| Emulsion H (silver) | 0.77 |
| Sensitizing dye VII | $2.2 \times 10^{-4}$ |
| EX-9 | 0.20 |
| HBS-1 | 0.070 |
| Gelatin | 0.69 |
| 14th Layer: 1st protective layer | |
| Emulsion I (silver) | 0.20 |
| U-4 | 0.11 |
| U-5 | 0.17 |
| HBS-1 | $5.0 \times 10^{-2}$ |
| Gelatin | 1.00 |
| 15th Layer: 2nd protective layer | |
| H-1 | 0.40 |
| B-1 (diameter: 1.7 μm) | $5.0 \times 10^{-2}$ |
| B-2 (diameter: 1.7 μm) | 0.10 |
| B-3 | 0.10 |
| S-1 | 0.20 |
| Gelatin | 1.20 |

In addition to the above mentioned components, W-1, W-2, W-3, B-4, B-5, F-1, F-2, F-3, F-4, F-5, F-6, F-7, F-8, F-9, F-10, F-11, F-12, F-13 and iron salts, lead salts, gold salts, platinum salts, iridium salts, and rhodium salts were incorporated in all these layers.

TABLE 1

| | Mean AgI content (%) | Mean grain diameter (μm) | Grain diameter fluctuation coefficient (%) | Diameter/thickness ratio | Ratio of amount of silver (% AgI content) | |
|---|---|---|---|---|---|---|
| Emulsion A | 4.0 | 0.45 | 27 | 1 | Core/shell = 1/3(13/1); | double structure |
| Emulsion B | 8.9 | 0.70 | 14 | 1 | Core/shell = 3/7(25/2); | double structure |
| Emulsion C | 10 | 0.75 | 30 | 2 | Core/shell = 1/2(24/3); | double structure |

TABLE 1-continued

| | Mean AgI content (%) | Mean grain diameter (μm) | Grain diameter fluctuation coefficient (%) | Diameter/ thickness ratio | Ratio of amount of silver (% AgI content) | |
|---|---|---|---|---|---|---|
| Emulsion D | 16 | 1.05 | 35 | 2 | Core/shell = 4/6(40/0); | double structure |
| Emulsion E | 10 | 1.05 | 35 | 3 | Core/shell = 1/2(24/3); | double structure |
| Emulsion F | 4.0 | 0.25 | 28 | 1 | Core/shell = 1/3(13/1); | double structure |
| Emulsion G | 14.0 | 0.75 | 25 | 2 | Core/shell = 1/2(42/0); | double structure |
| Emulsion H | 14.5 | 1.30 | 25 | 3 | Core/shell = 37/63(34/3); | double structure |
| Emulsion I | 1 | 0.07 | 15 | 1 | Uniform grain | |

EX-1

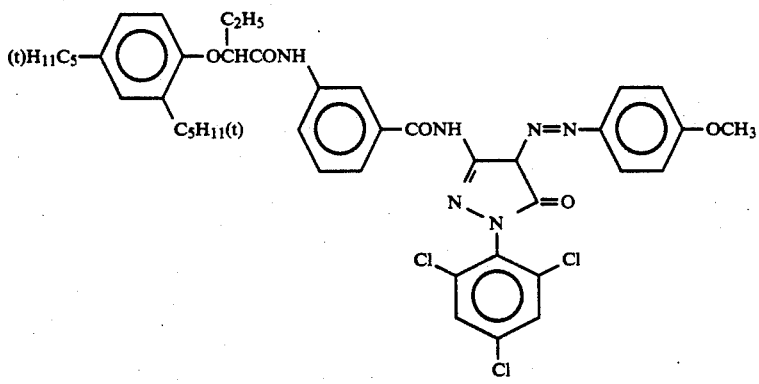

EX-2

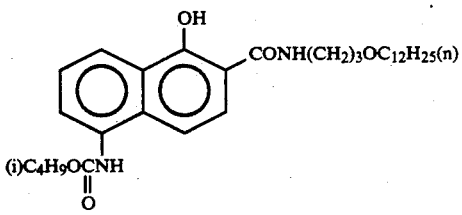

EX-3

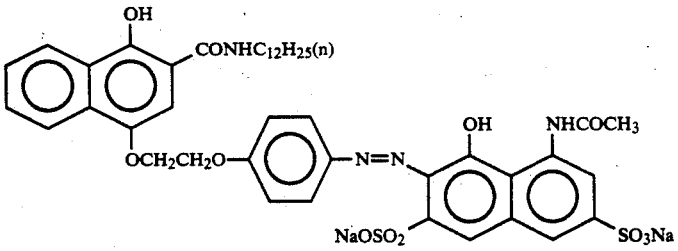

EX-4

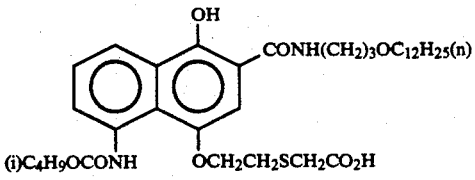

EX-5

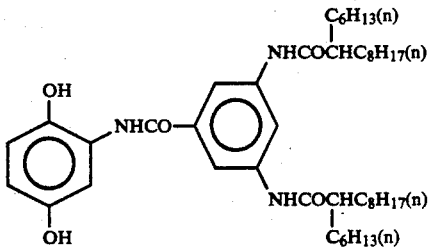

-continued
EX-6
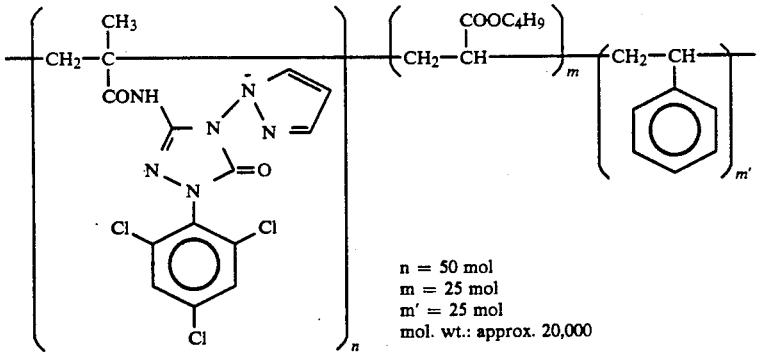
EX-7
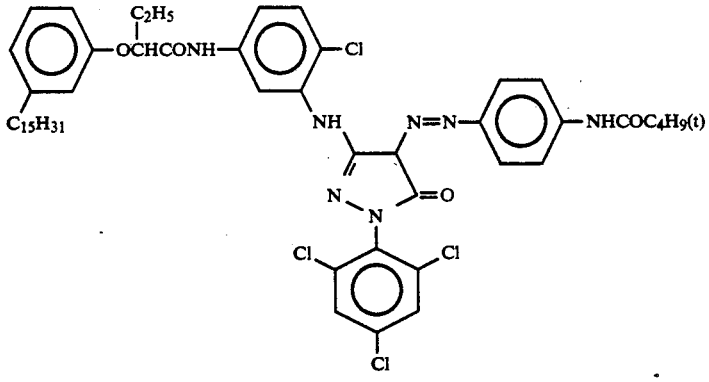
EX-8
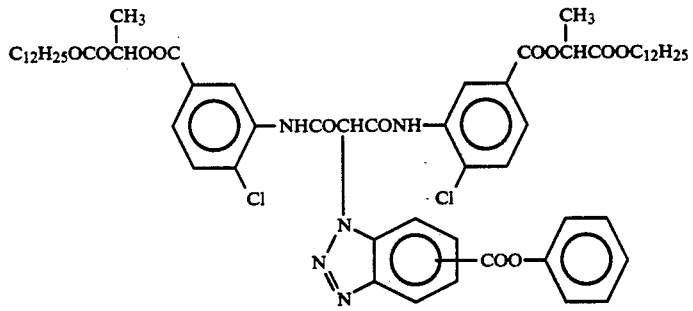
EX-9
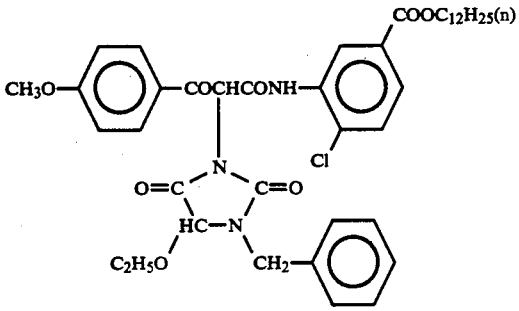

-continued
EX-10
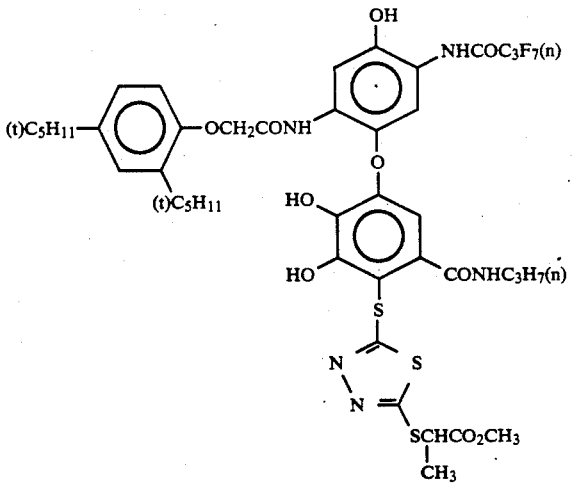
EX-11
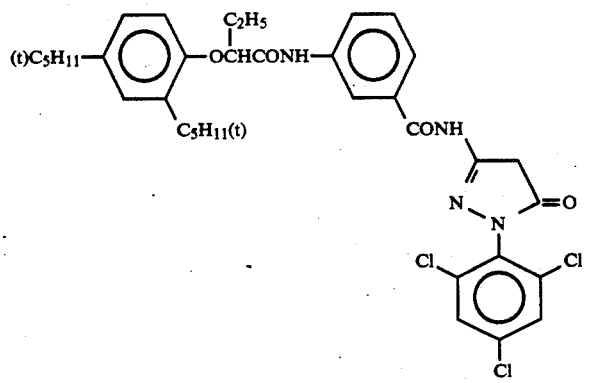
EX-12
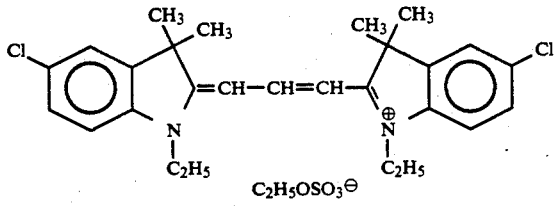
EX-13
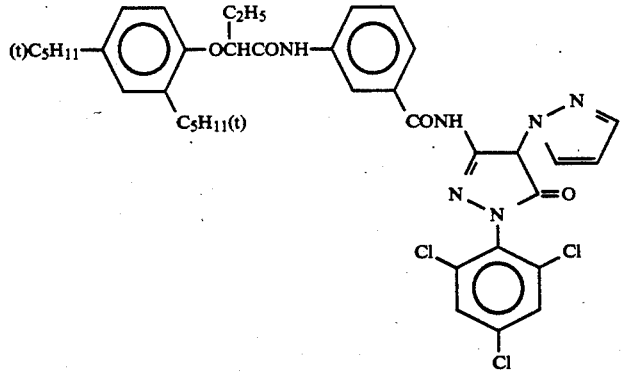
U-1
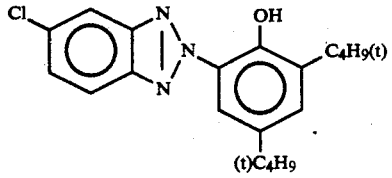

-continued
U-2
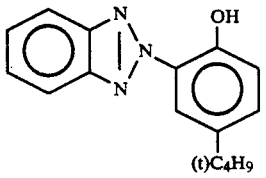
U-3
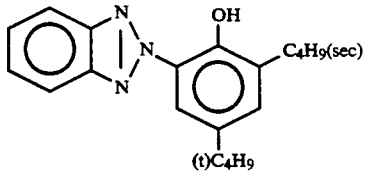
U-4
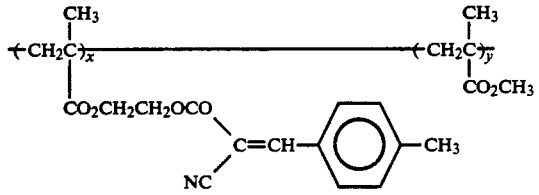
x:y = 70:30 (wt %)
U-5
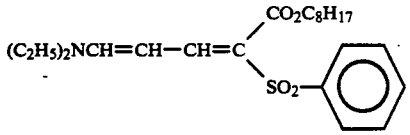
HBS-1: Triscresyl phosphate
HBS-2: Di-n-butyl phthalate
HBS-3
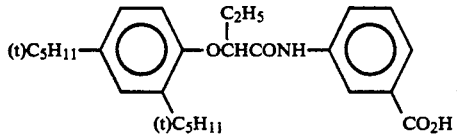
Sensitizing Dye I
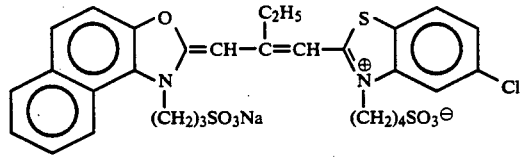
Sensitizing Dye II
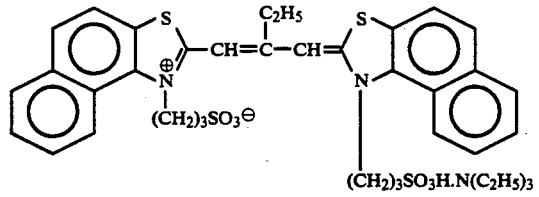
Sensitizing Dye III
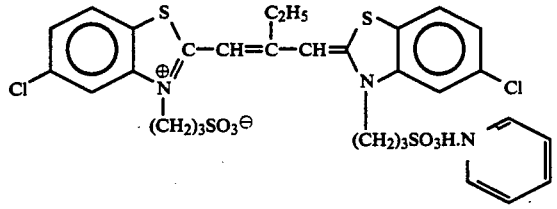

-continued
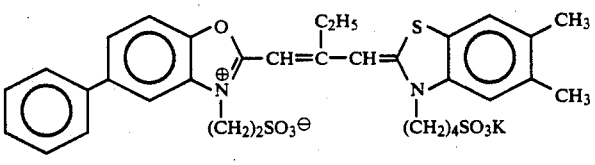
Sensitizing Dye IV
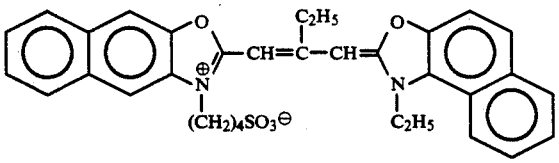
Sensitizing Dye V
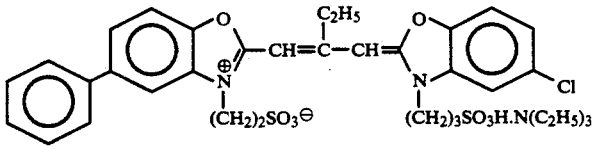
Sensitizing Dye VI
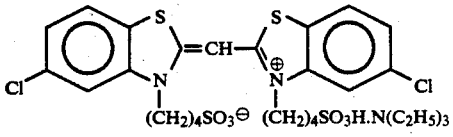
Sensitizing Dye VII
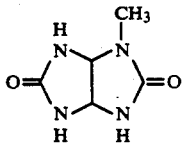
S-1
$CH_2{=}CH{-}SO_2{-}CH_2{-}CONH{-}CH_2$
$CH_2{=}CH{-}SO_2{-}CH_2{-}CONH{-}CH_2$
H-1
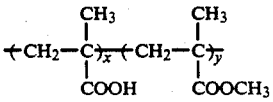
x/y = 10/90 (by mol)
B-1
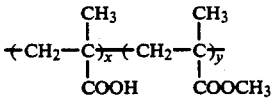
x/y = 40/60 (by mol)
B-2
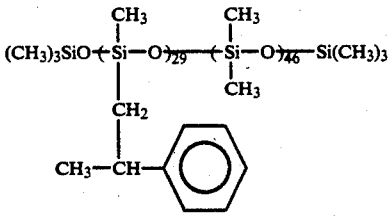
B-3
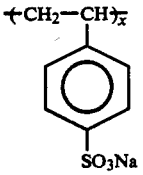
B-4

-continued
B-5
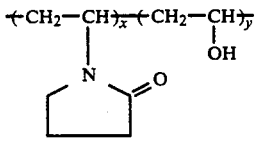
x/y = 70/30 (by mol)
W-1
$C_8F_{17}SO_2NHCH_2CH_2CH_2OCH_2CH_2\overset{\oplus}{N}(CH_3)_3$
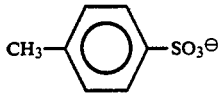
W-2
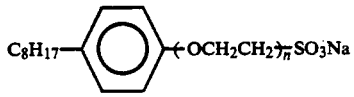
n = 2~4
W-3
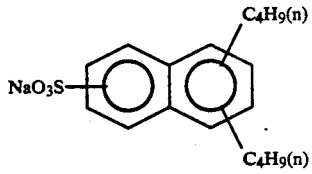
F-1
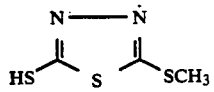
F-2
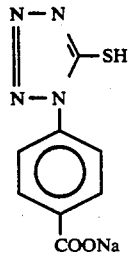
F-3
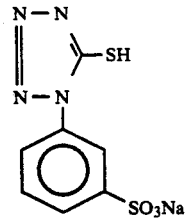
F-4
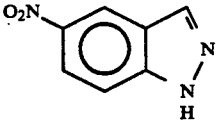
F-5
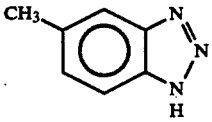
F-6
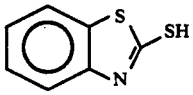

-continued

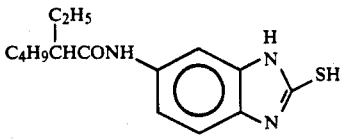

F-7

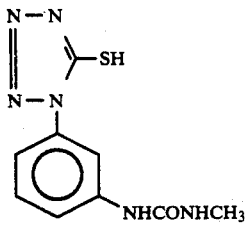

F-8

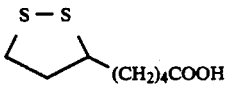

F-9

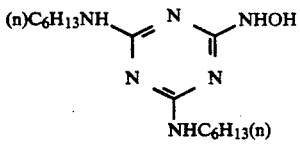

F-10

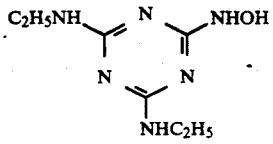

F-11

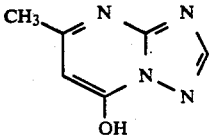

F-12

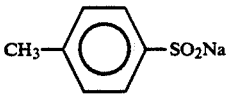

F-13

Specimen 102 thus prepared was exposed to white light (color temperature of light source: 4,800° K.) through an optical wedge, and then processed by means of an automatic developing machine for motion picture in the following process. The processing was continued until the accumulated replenishment of each processing solution reached 2.5 times the capacity of the running tank. The processing properties set forth below were the results of the processing which was effected at that time.

| | Processing step | | | |
|---|---|---|---|---|
| Step | Time | Temperature | Replenishment rate* | Tank capacity |
| Color development | 1 min. | 45.0° C. | 10 ml | 2 l |
| Bleach 1 | 40 sec. | 43.0° C. | 5 ml | 1 l |
| Bleach 2 | 20 sec. | " | | |
| Fixing | 40 sec. | " | 30 ml | 1 l |
| Washing with water | 20 sec. | " | 30 ml | 1 l |

-continued

| | Processing step | | | |
|---|---|---|---|---|
| Step | Time | Temperature | Replenishment rate* | Tank capacity |
| Drying | 40 sec. | 70° C. | | |

*Determined per 35-mm width and 1-m length

The aeration of the bleaching bath was effected in the same manner as in Example 1. The agitation in each processing bath was effected in the same manner as in Example 1. The amount of the processing solution to be brought over from each processing bath to its subsequent bath was 2.2 ml per m of 35-mm wide light-sensitive material. The time for crossover was 6 seconds in all the steps.

Color Developer

| | Mother Solution | Replenisher |
|---|---|---|
| Diethylenetriamine- | 2.2 g | 2.2 g |

-continued

| | Mother Solution | Replenisher |
|---|---|---|
| pentaacetic acid | | |
| 1-Hydroxyethylidene-1,1-diphosphonic acid | 3.0 g | 3.2 g |
| Sodium sulfite | 4.1 g | 4.9 g |
| Potassium carbonate | 38 g | 40 g |
| Potassium iodide | 1.3 mg | — |
| Hydroxylamine sulfate | 2.4 g | 3.3 g |
| 2-methyl-4-[4-ethyl-N-(β-hydroxyethyl)amino] aniline sulfate | 13.8 g | 17.0 g |
| 2-Methyl-imidazole | 820 mg | 820 mg |
| 5-Nitrobenzimidazole | 30 g | 31 g |
| 1-Phenyl-4-methyl-4-hydroymethyl-3-pyrazolidone | 50 mg | 50 mg |
| Water to make | 1,000 ml | 1,000 ml |
| pH (25° C.) | 10.30 | 10.51 |

Bleaching Solution

| | Running Solution | Replenisher |
|---|---|---|
| Chelate compound as set forth in Table 2 | 0.37 mol | 0.50 mol |
| Ammonium bromide | 80 g | 114 g |
| Ammonium nitrate | 15 g | 21.4 g |
| 90% Acetic acid | 42 g | 60 g |
| Water to make | 1,000 ml | 1,000 ml |
| pH | 4.5 | 4.5 |

Fixing Solution (Mother Solution Was Used Also As Replenisher)

| | |
|---|---|
| 70% Ammonium thiosulfate | 280 ml |
| Ethylenediaminetetraacetic acid | 10 g |
| Ammonium sulfite | 28 g |
| Water to make | 1,000 l |
| pH | 7.80 |

The specimen thus processed was then evaluated in the same manner as in Example 1. The results are set forth in Table 2.

TABLE 2

| No. | Metal chelate compound | Bleach time (sec.) | Remaining amount of silver ($\mu g/cm^2$) | Bleach fogging ΔDmin (G) | Stain with time ΔDmin (G) | Remarks |
|---|---|---|---|---|---|---|
| 201 | Comparative Compound D | 40 | 17.0 | 0.01 | 0.84 | Comparative |
| | | 20 | 41.3 | 0.01 | 0.95 | Comparative |
| 202 | Comparative Compound E | 40 | 1.1 | 0.30 | 0.30 | Comparative |
| | | 20 | 6.0 | 0.19 | 0.35 | Comparative |
| 203 | Comparative Compound F | 40 | 1.0 | 0.32 | 0.31 | Comparative |
| | | 20 | 5.9 | 0.21 | 0.37 | Comparative |
| 204 | Present Compound K-3 | 40 | 0.6 | 0.02 | 0.05 | Present Invention |
| | | 20 | 0.9 | 0.01 | 0.06 | Present Invention |
| 205 | Present Compound K-4 | 40 | 0.7 | 0.02 | 0.07 | Present Invention |
| | | 20 | 1.1 | 0.01 | 0.09 | Present Invention |
| 206 | Present Compound K-8 | 40 | 0.9 | 0.03 | 0.07 | Present Invention |
| | | 20 | 1.0 | 0.02 | 0.09 | Present Invention |
| 207 | Present Compound K-19 | 40 | 0.8 | 0.01 | 0.06 | Present Invention |
| | | 20 | 1.0 | 0.01 | 0.08 | Present Invention |
| 208 | Present Compound K-21 | 40 | 0.8 | 0.06 | 0.07 | Present Invention |
| | | 20 | 1.2 | 0.05 | 0.08 | Present Invention |

Table 2 shows that as compared to the comparative bleaching solutions the bleaching solutions comprising the present metal chelate compounds as bleaching agents can exhibit a sufficient bleaching capacity even upon short time bleach and cause little bleach fogging and little increase in stain with time.

Comparative Compound D

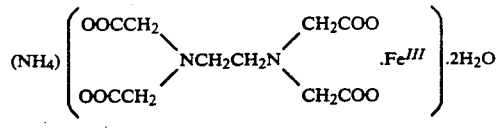

Comparative Compound E

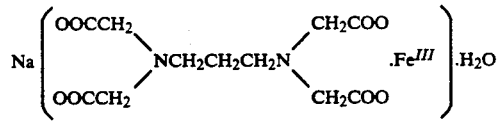

Comparative Compound F

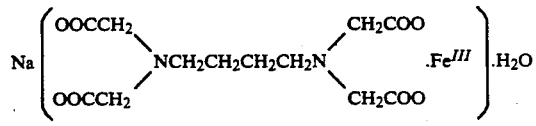

EXAMPLE 3

A multilayer color photographic paper specimen was prepared by coating on a polyethylene both sides-laminated paper support which had been corona-discharged and then provided with a gelatin subbing layer containing sodium dodecylbenzenesulfonate various photographic constiuent layers having the following compositions. The coating liquids for these layers were prepared as follows:

Coating Liquid for 1st Layer 19.1 g of a yellow coupler (ExY), 4.4 g of a dye stabilizer (Cpd-1) and 0.7 g of a dye stabilizer (Cpd-7) were dissolved in 27.2 ml of ethyl acetate, 4.1 g of a solvent (Solv-3) and 4.1 g of a solvent (Solv-7). The solution thus obtained was then emulsion-dispersed in 185 ml of a 10% aqueous solution of gelatin containing 8 ml of 10% sodium dodecylbenzensulfonate to prepare Emulsion Dispersion A. On the other hand, a silver bromochloride emulsion A (3:7 mixture (ratio of molar amount of silver) of a large size emulsion A of cubic grains with a mean grain size of 0.88 μm and a grain size distribution fluctuation coefficient of 0.08 and a small size emulsion A of cubic grains with a mean grain size of 0.70 μm and a grain size distribution fluctuation coefficient of 0.10, both having 0.3 mol % silver bromide localized on the surface thereof) was prepared by incorporating the blue-sensitive sensitizing dyes A and B as described later in amounts of $2.0\times10^{-4}$ mol and $2.5\times10^{-4}$ mol based on mol of silver in the large size emulsion A and the small size emulsion A, respectively, and then subjecting the material to chemical sensitization with a sulfur sensitizer and a gold sensitizer. Emulsion Dispersion A and Silver Bromochloride Emulsion A were then mixed and dissolved to prepare a coating liquid for the 1st layer having the following composition.

Coating liquids for the 2nd to 7th layers were prepared in the same manner as in the 1st layer coating liquid. There was incorporated in each layer a sodium salt of sodium salt of 1-oxy-3,5-dichloro-s-triazine as gelatin hardener.

To each of these layers were added Cpd-10 and Cpd-11 in amounts of 25.0 mg/m² and 50.0 mg/m², respectively.

In the silver bromochloride emulsion for each light-sensitive emulsion layer were incorporated the following spectral sensitizing dyes:

Sensitizing dye A for blue-sensitive emulsion layer

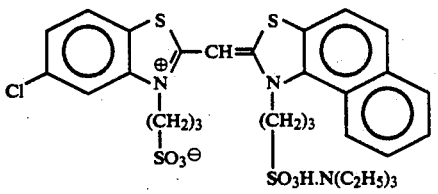

Sensitizing dye B for blue-sensitive emulsion layer

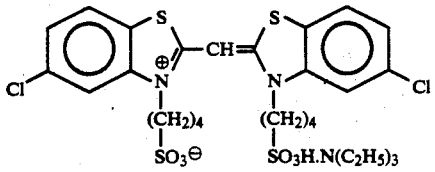

($2.0\times10^{-4}$ mol per mol of silver halide in the large size emulsion A and $2.5\times10^{-4}$ mol per mol of silver halide in the small size emulsion A)

Sensitizing dye C for green-sensitive emulsion layer

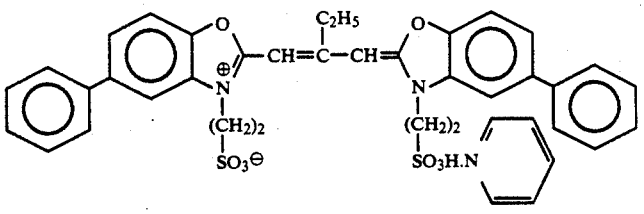

($4.0\times10^{-4}$ mol per mol of silver halide in the large size emulsion B and $5.6\times10^{-4}$ mol per mol of silver halide in the small size emulsion B)

Sensitizing dye D for green-sensitive emulsion layer

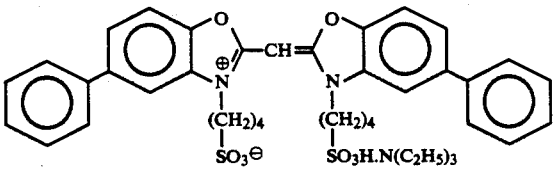

($7.0\times10^{-5}$ mol per mol of silver halide in the large size emulsion B and $1.0\times10^{-5}$ mol per mol of silver halide in the small size emulsion B)

Sensitizing dye E for red-sensitive emulsion layer

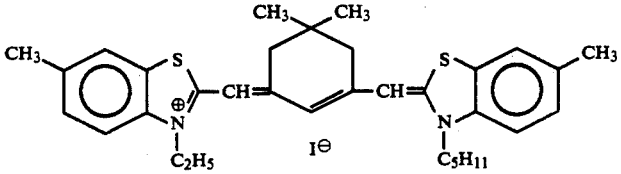

($0.9\times10^{-4}$ mol per mol of silver halide in the large size emulsion C and $1.1\times10^{-4}$ mol per mol of silver halide in the small size emulsion C)

In the red-sensitive emulsion layer was incorporated the following compound in an amount of $2.6\times10^{-3}$ mol per mol of silver halide:

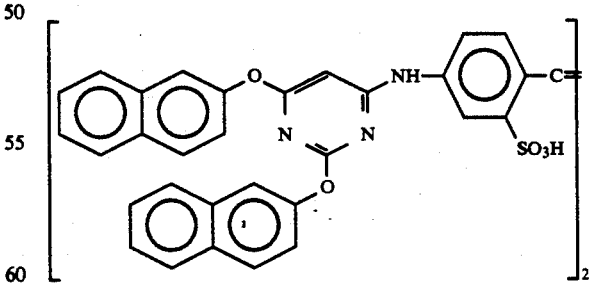

In the blue-sensitive emulsion layer, the green-sensitive emulsion layer and the red-sensitive emulsion layer was incorporated 1-(5-methylureidophenyl)-5-mercaptotetrazole in amounts of $8.5\times10^{-5}$ mol, $7.7\times10^{-4}$ mol and $2.5\times10^{-4}$ mol per mol of silver halide.

In the blue-sensitive emulsion layer and the green-sensitive emulsion layer was incorporated 4-hydroxy-6-methyl-1,3,3a,7-tetrazaindene in amounts of $1\times10^{-4}$ mol and $2\times10^{-4}$ mol per mol of silver halide.

In order to inhibit irradiation, the following dyes were incorporated in these emulsion layers (figure in parenthesis indicates coated amount).

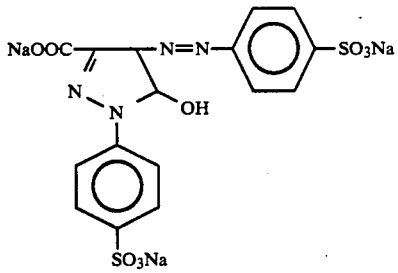

(10 mg/m²)

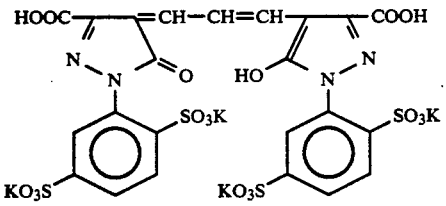

(10 mg/m²)

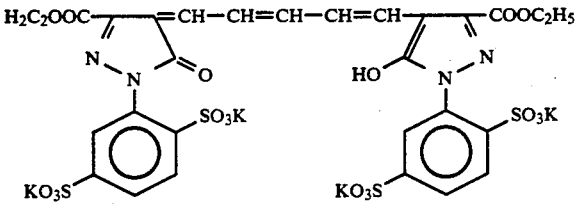

(40 mg/m²)

and

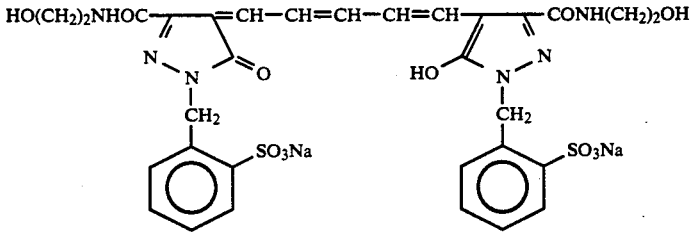

(20 mg/m²)

Layer Structure

The composition of these layers will be set forth below. The figure indicate coated amount in g/m². The coated amount of silver halide emulsion is represented as calculated in terms of amount of silver.

Support

Polyethylene-laminated paper [containing a white pigment ($TiO_2$) and a bluish dye (ultramarine) on the 1st layer side]

| | |
|---|---|
| 1st layer: blue-sensitive emulsion layer | |
| Silver bromochloride emulsion A as set forth above | 0.30 |
| Gelatin | 1.86 |
| Yellow coupler (ExY) | 0.82 |
| Dye stabilizer (Cpd-1) | 0.19 |
| Solvent (Solv-3) | 0.18 |
| Solvent (Solv-7) | 0.18 |
| Dye stabilizer (Cpd-7) | 0.06 |
| 2nd layer: color mixing inhibiting layer | |
| Gelatin | 0.99 |
| Color mixing inhibitor (Cpd-5) | 0.08 |

-continued

| | |
|---|---|
| Solvent (Solv-1) | 0.16 |
| Solvent (Solv-4) | 0.08 |
| 3rd layer: green-sensitive emulsion layer | |
| Silver bromochloride emulsion (1:3 mixture (ratio of molar amount of silver) of a large size emulsion B of cubic grains with a mean grain size of 0.55 μm and a grain size distribution fluctuation coefficient of 0.10 and a small size emulsion B of cubic grains with a mean grain size of 0.39 μm and a grain size distribution fluctuation coefficient of 0.08, both having 0.8 mol % silver bromide localized on the surface thereof) | 0.12 |
| Gelatin | 1.24 |
| Magenta coupler (ExM) | 0.23 |
| Dye image stabilizer (Cpd-2) | 0.03 |
| Dye image stabilizer (Cpd-3) | 0.16 |
| Dye image stabilizer (Cpd-4) | 0.02 |
| Dye image stabilizer (Cpd-9) | 0.02 |
| Solvent (Solv-2) | 0.40 |
| 4th layer: ultraviolet-absorbing layer | |
| Gelatin | 1.58 |
| Ultraviolet absorbent (UV-1) | 0.47 |
| Color mixing inhibitor (Cpd-5) | 0.05 |
| Solvent (Solv-5) | 0.24 |
| 5th layer: red-sensitive emulsion layer | |
| Silver bromochloride emulsion (1:4 mixture (ratio of molar amount of silver) of a large size emulsion C of cubic grains with a mean grain size of 0.58 μm and a grain size distribution fluctuation coefficient of 0.09 and a small size emulsion C of cubic grains with a mean grain size of 0.45 μm and a grain size distribution fluctuation coefficient of 0.11, both having 0.6 mol % silver bromide localized on the surface thereof) | 0.23 |
| Gelatin | 1.34 |
| Cyan coupler (ExC) | 0.32 |
| Dye image stabilizer (Cpd-2) | 0.03 |
| Dye image stabilizer (Cpd-4) | 0.02 |
| Dye image stabilizer (Cpd-6) | 0.18 |
| Dye image stabilizer (Cpd-7) | 0.40 |
| Dye image stabilizer (Cpd-8) | 0.05 |
| Solvent (Solv-6) | 0.14 |
| 6th layer: ultraviolet-absorbing layer | |
| Gelatin | 0.53 |
| Ultraviolet absorbent (UV-1) | 0.16 |
| Color stain inhibitor (Cpd-5) | 0.02 |
| Solvent (Solv-5) | 0.08 |
| 7th layer: protective layer | |
| Gelatin | 1.33 |
| Acryl-modified copolymer of polyvinyl alcohol (modified degree: 17%) | 0.17 |
| Liquid paraffin | 0.03 |

Yellow coupler (ExY)
1:1 (molar ratio) mixture of

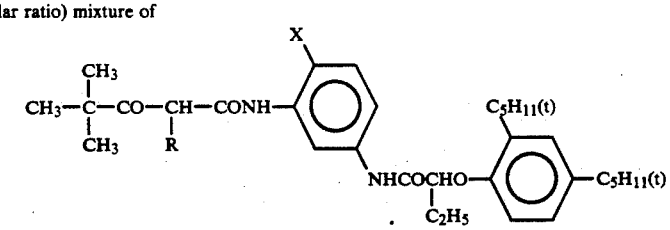

R =

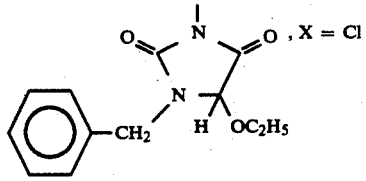

, X = Cl and

R =

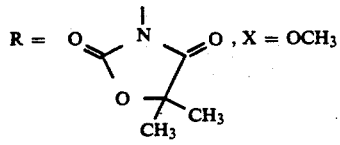

, X = $OCH_3$

Magenta coupler (ExM)

-continued
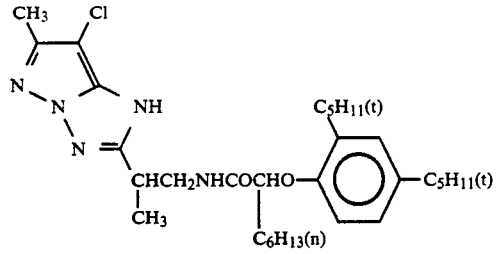
Cyan coupler (ExC)
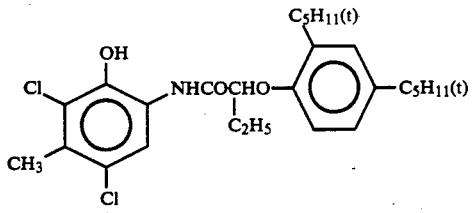
and
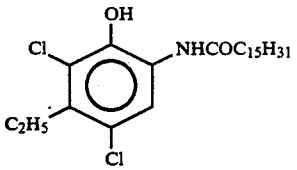
Dye image stabilizer (Cpd-1)
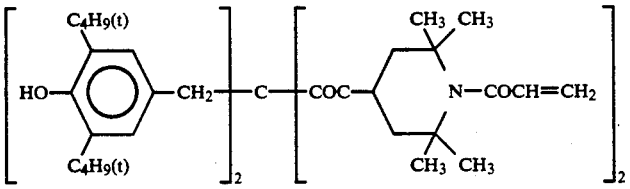
Dye image stabilizer (Cpd-2)
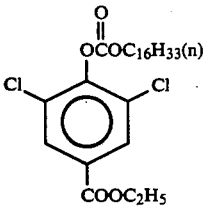
Dye image stabilizer (Cpd-3)
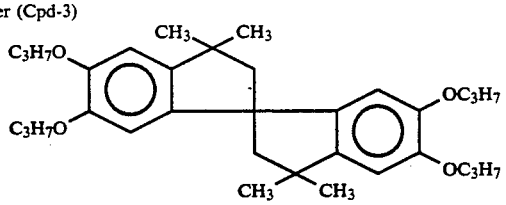
Dye image stabilizer (Cpd-4)
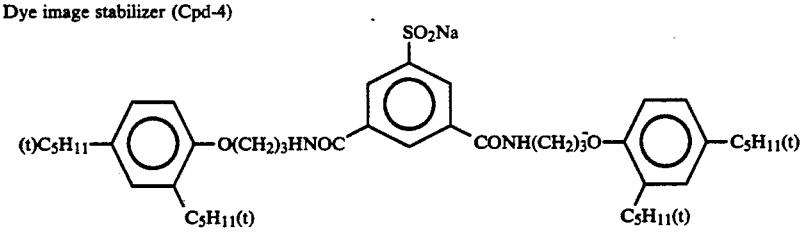
Color mixing inhibitor (Cpd-5)
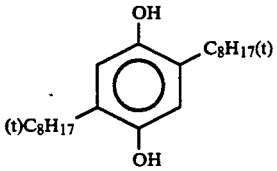

-continued
Dye image stabilizer (Cpd-6)
2:4:4 (weight ratio) mixture of:
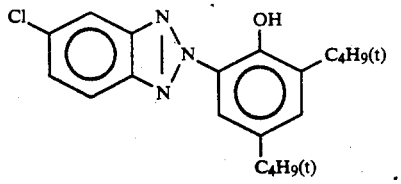
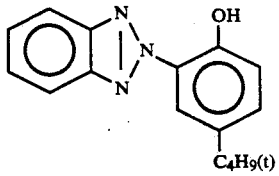
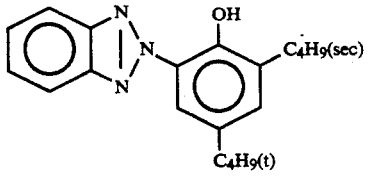
Dye image stabilizer (Cpd-7)
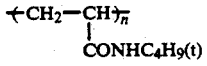
(Average MW 60,000)
Dye image stabilizer (Cpd-8)
1:1 (weight ratio) mixture of:
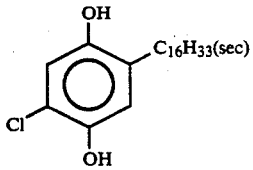
and
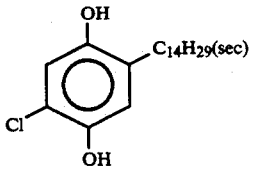
Dye image stabilizer (Cpd-9)
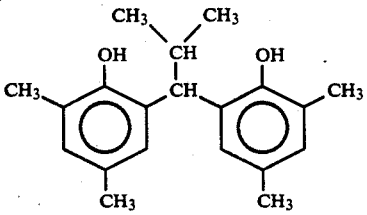
Antiseptic agent (Cpd-10)
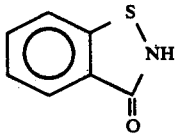
Antiseptic agent (Cpd-11)
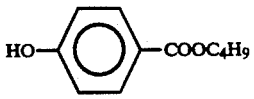
Ultraviolet absorbent (UV-1)
4:2:4 (weight ratio) mixture of:
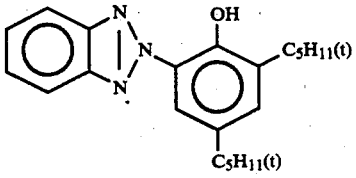

-continued

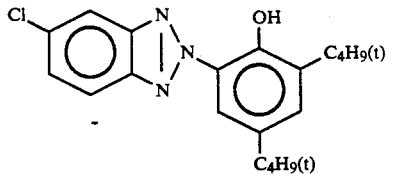

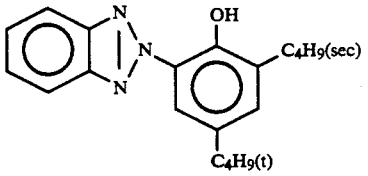

Solvent (Solv-1)

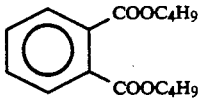

Solvent (Solv-2)
1:1 (by volume) mixture of:

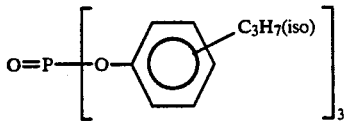

and

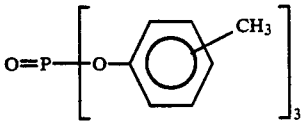

Solvent (Solv-3)

$O{=}P{+}O{-}C_9H_{19}(iso)]_3$

Solvent (Solv-4)

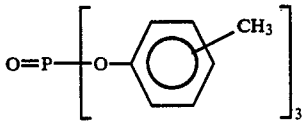

Solvent (Solv-5)

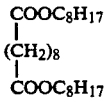

Solvent (Solv-6)
80:20 Mixture (by volume) of:

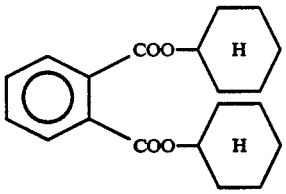

and

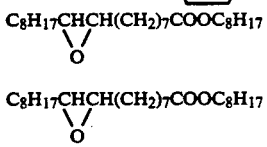

Solvent (Solv-7)

The specimen thus prepared was stepwise exposed to light (color temperature of light source: 3,800° K.) through an optical wedge, and then processed by means of an automatic developing machine in the following process. The processing was continued until the accumulated replenishment of each processing solution reached 3 times the capacity of the tank. The results of the processing which was effected at that time are set forth in Table 3.

The remaining amount of silver on the maximum density portion was measured by fluorescent X-ray analysis. The bleach fogging was determined as difference in the green density on Dmin portion from that obtained with the following reference bleaching solution causing no bleach fogging in stead of the blix solution. Furthermore, the specimen processed in the former processing solution was stored at a temperature of 80° C. and a relative humidity of 70% for 1 week, and then measured for increase in stain after processing.

| Step | Time | Processing step Temperature | Replenishment rate* | Tank capacity |
|---|---|---|---|---|
| Color development | 45 sec. | 39.0° C. | 70 ml | 20 l |
| Blix | 45 sec. | 35.0° C. | 60 ml** | 20 l |
| Rinse (1) | 20 sec. | 35.0° C. | — | 10 l |
| Rinse (2) | 20 sec. | 35.0° C. | — | 10 l |
| Rinse (3) | 20 sec. | 35.0° C. | 360 ml | 10 l |
| Drying | 60 sec. | 80° C. | | |

*Determined per $m^2$ of light-sensitive material
The rinse step was effected in a 3-tank countercurrent process wherein the washing water flows from (3) to (1).
**In addition to 60 ml, the solution from Rinse (1) was introduced into this step at a rate of 120 ml per $m^2$ of light-sensitive material.

Color Developer

| | Tank Solution | Replenisher |
|---|---|---|
| Water | 700 ml | 700 ml |
| Diethylenetriamine-pentaacetic acid | 0.4 g | 0.4 g |
| N,N,N-tris(methylene-phosphonic acid) | 4.0 g | 4.0 g |
| Disodium 1,2-dihydroxybenzene-4,6-disulfonate | 0.5 g | 0.5 g |
| Triethanolamine | 12.0 g | 12.0 g |
| Potassium chloride | 6.5 g | — |
| Potassium bromide | 0.03 g | — |
| Potassium carbonate | 27.0 g | 27.0 g |
| Fluorescent brightening agent (WHITEX 4B, available from Sumitomo Chemical Co., Ltd.) | 1.0 g | 3.0 g |
| Sodium sulfite | 0.1 g | 0.1 g |
| N,N-bis(sulfoethyl)-hydroxylamine | 10.0 g | 13.0 g |
| N-ethyl-N-(β-methane-sulfonamidoethyl)-3-methyl-4-aminoaniline sulfate | 5.0 g | 11.5 g |
| Water to make | 1,000 ml | 1,000 ml |
| pH | 10.10 | 11.10 |

Blix Solution

| | Tank Solution | Replenisher |
|---|---|---|
| Water | 600 ml | 150 ml |
| Ammonium thiosulfate (700 g/l) | 100 ml | 250 ml |
| Ammonium sulfite | 40 g | 100 g |
| Compound as set forth in Table 3 | 0.155 mol | 0.383 mol |
| Ferric nitrate nonahydrate | 0.138 mol | 0.340 mol |
| Ammonium bromide | 40 g | 75 g |
| Nitric acid (67%) | 30 g | 65 g |
| Water to make | 1,000 ml | 1,000 ml |
| pH (25° C.) adjusted with acetic acid and aqueous ammonia | 5.8 | 5.6 |

Reference Blix Solution for Evaluation of Bleach Fogging

| | |
|---|---|
| Water | 600 ml |
| Ammonium thiosulfate (70%) | 100 ml |
| Ammonium sulfite | 40 g |
| Ferric ammonium ethylenediamine-tetraacetate | 50 g |
| Ethylenediaminetetraacetic acid | 5 g |
| Ammonium bromide | 40 g |
| Acetic acid (67%) | 30 g |
| Water to make | 1,000 ml |
| pH (25° C.) | 5.8 |

TABLE 3

| No. | Compound | Remaining amount of silver [μg/cm²] | Bleach fogging ΔDmin (G) | Increase in stain ΔD (G) |
|---|---|---|---|---|
| 301 | Comparative Compound A | 2.8 | 0.00 | 0.12 |
| 302 | Comparative Compound B | 11.6 | 0.03 | 0.04 |
| 303 | Comparative Compound C | 11.4 | 0.04 | 0.03 |
| 304 | Present Compound 3 | 0.1 | 0.01 | 0.01 |
| 305 | Present Compound 4 | 0.2 | 0.01 | 0.03 |
| 306 | Present Compound 5 | 0.3 | 0.02 | 0.03 |
| 307 | Present Compound 8 | 0.9 | 0.01 | 0.03 |
| 308 | Present Compound 11 | 1.0 | 0.01 | 0.02 |
| 309 | Present Compound 19 | 0.6 | 0.00 | 0.02 |
| 310 | Present Compound 21 | 0.7 | 0.00 | 0.04 |
| 311 | Present Compound 29 | 0.8 | 0.01 | 0.04 |

(Note: Specimens 301 to 303 are comparative while the others are according to the present invention)
Comparative Compound A: Ethylenediaminetetraacetic acid
Comparative Compound B: 1,3-Diaminopropanetetraacetic acid
Comparative Compound C: 1,4-Diaminobutanetetraacetic acid The results set forth in Table 3 show that as compared to the blix solutions comprising the comparative compounds the blix solution having a bleaching capacity comprising the chelate compounds of the present invention can reduce the remaining amount of silver and cause little bleach fogging and little increase in stain after processing. The blix solution comprising Comparative Compound B exhibits a sufficient bleach capacity shortly after being prepared, but shows a rapid drop in the bleaching capacity and a remarkable stain in the solution after running. On the contrary, the blix solutions comprising the metal chelate compounds of the present invention cause little stain and remain stable.

EXAMPLE 4

The light-sensitive material specimen as prepared in Example 3 was stepwise exposed to light (color temperature of light source: 3,200° K.) through an optical wedge, and then processed with the following processing solutions in the following processing steps.

The remaining amount of silver on the maximum density portion was measured by fluorescent x-ray analysis. The blue density on the minimum density portion was also measured. The specimen was then stored at a temperature of 80° C. and a relative humidity of 70% for 8 days to determine the amount of stain with time.

| Processing Step | Temperature | Time |
|---|---|---|
| Color development | 40° C. | 15 sec. |
| Blix | 30–35° C. | (1) 20 sec.<br>(2) 10 sec. |
| Rinse 1 | " | 7 sec. |
| Rinse 2 | " | 7 sec. |
| Rinse 3 | " | 7 sec. |
| Rinse 4 | " | 7 sec. |
| Drying | 70–80° C. | 15 sec. |

The rinse step is effected in a 4-tank countercurrent process wherein the washing water flows from (4) to (1).

The various processing solutions had the following compositions:

Blix Solution

| | |
|---|---|
| Water | 400 ml |
| Ammonium thiosulfate (700 g/l) | 100 ml |
| Ammonium sulfite | 15 g |
| Compound as set forth in Table 4* | 0.21 mol |
| Ferric nitrate nonahydrate* | 0.19 mol |
| Ammonium bromide | 40 g |
| Water to make | 1,000 ml |
| pH (25° C.) | 6.2 |

(Note: The compound with symbol * was used in the form of solution in 200 ml of water)

Rinse Solution

Ion-exchanged water (calcium and magnesium concentrations: not more than 3 ppm each)

TABLE 4

| No. | Metal chelate compound* | Bleach time (sec.) | Remaining amount of silver ($\mu g/cm^2$) | Bleach fogging ΔDmin (G) | Stain with time ΔDmin (G) | Remarks |
|---|---|---|---|---|---|---|
| 401 | Comparative Compound D | 20 | 5.1 | 0.01 | 0.24 | Comparative |
| | | 10 | 9.9 | 0.01 | 0.28 | Comparative |
| 402 | Comparative Compound E | 20 | 3.3 | 0.09 | 0.19 | Comparative |
| | | 10 | 6.2 | 0.07 | 0.22 | Comparative |
| 403 | Comparative Compound F | 20 | 3.0 | 0.03 | 0.31 | Comparative |
| | | 10 | 5.8 | 0.02 | 0.42 | Comparative |
| 404 | Present Compound K-3 | 20 | 0.7 | 0.02 | 0.05 | Present Invention |
| | | 10 | 1.2 | 0.02 | 0.06 | Present Invention |
| 405 | Present Compound K-4 | 20 | 0.9 | 0.02 | 0.05 | Present Invention |
| | | 10 | 1.4 | 0.02 | 0.08 | Present Invention |
| 406 | Present Compound K-8 | 20 | 2.0 | 0.02 | 0.07 | Present Invention |
| | | 10 | 3.3 | 0.01 | 0.09 | Present Invention |
| 407 | Present Compound K-19 | 20 | 1.1 | 0.01 | 0.07 | Present Invention |
| | | 10 | 1.9 | 0.01 | 0.09 | Present Invention |
| 408 | Present Compound K-21 | 20 | 1.0 | 0.02 | 0.07 | Present Invention |
| | | 10 | 1.7 | 0.01 | 0.08 | Present Invention |

Color Developer

| | |
|---|---|
| Water | 700 ml |
| Diethylenetriaminopentaacetic acid | 0.4 g |
| N,N,N-tris(methylenephosphonic acid) | 4.0 g |
| 1-Hydroxyethylidene-1,1-diphosphonic acid | 0.4 g |
| Triethanolamine | 12.0 g |
| Potassium chloride | 4.9 g |
| Potassium bromide | 0.015 g |
| Potassium carbonate | 29 g |
| Fluorescent brightening agent (WHITEX 4B, available from Sumitomo Chemical Co., Ltd.) | 1.0 g |
| Sodium sulfite | 0.1 g |
| N,N-bis(sulfoethyl)hydroxylamine | 12.0 g |
| N-ethyl-N-(β-methanesulfonamidoethyl)-3-methyl-4-aminoaniline sulfate | 10.5 g |
| Water to make | 1,000 ml |
| pH (25° C.) | 10.15 |

Table 4 shows that as compared to the comparative blix solutions the blix solutions comprising the present compounds exhibit excellent desilvering properties and cause little bleach fogging and little stain with time.

EXAMPLE 5

A multilayer color light-sensitive material was prepared as Specimen 501 by coating on a undercoated cellulose triacetate film support various layers having the following compositions.

Composition of Photographic Layer

The coated amount of silver halide and colloidal silver is represented in $g/m^2$ calculated in terms of the amount of silver. The coated amount of couplers, additives and gelatin is represented in $g/m^2$. The coated amount of sensitizing dye is represented in mol per mol of silver halide contained in the same layer.

| | |
|---|---|
| 1st Layer: anti-halation layer | |
| Black colloidal silver | 0.2 |
| Gelatin | 2.2 |
| UV-1 | 0.1 |
| UV-2 | 0.2 |
| Cpd-1 | 0.05 |
| Solv-1 | 0.01 |
| Solv-2 | 0.01 |
| Solv-3 | 0.08 |
| 2nd Layer: interlayer | |
| Finely divided silver bromide grains (diameter: 0.07 μm as calculated | 0.15 |

-continued

| | |
|---|---|
| in terms of sphere) (coated silver amount) | |
| Gelatin | 1.0 |
| Cpd-2 | 0.2 |
| 3rd layer: 1st red-sensitive emulsion layer | |
| Silver bromoiodide emulsion (AgI content: 10.0 mol %; high internal AgI type; diameter: 0.7 μm (as calculated in terms of sphere); coefficient of fluctuation in grain diameter: 14% (as calculated in terms of sphere); tetradecahedral grains) (coated silver amount) | 0.26 |
| Silver bromoiodide emulsion (AgI content: 4.0 mole %; high internal AgI type; diameter: 0.4 μm (as calculated in terms of sphere); coefficient of fluctuation in grain diameter: 22% (as calculated in terms of sphere); tetradecahedral grains) (coated silver amount) | 0.2 |
| Gelatin | 1.0 |
| ExS-1 | $4.5 \times 10^{-4}$ mol |
| ExS-2 | $1.5 \times 10^{-4}$ mol |
| ExS-3 | $0.4 \times 10^{-4}$ mol |
| ExS-4 | $0.3 \times 10^{-4}$ mol |
| ExC-1 | 0.15 |
| ExC-7 | 0.15 |
| ExC-2 | 0.009 |
| ExC-3 | 0.023 |
| ExC-6 | 0.14 |
| 4th Layer: 2nd red-sensitive emulsion layer | |
| Silver bromoiodide emulsion (AgI content: 16 mol %; high internal AgI type; diameter: 1.0 μm (as calculated in terms of sphere); coefficient of fluctuation in grain diameter: 25% (as calculated in terms of sphere); tabtular grains; diameter/thickness ratio: 4.0) (coated silver amount) | 0.55 |
| Gelatin | 0.7 |
| ExS-1 | $3 \times 10^{-4}$ mol |
| ExS-2 | $1 \times 10^{-4}$ mol |
| ExS-3 | $0.3 \times 10^{-4}$ mol |
| ExS-4 | $0.3 \times 10^{-4}$ mol |
| ExC-3 | 0.05 |
| ExC-4 | 0.10 |
| ExC-6 | 0.08 |
| 5th Layer: 3rd red-sensitive emulsion layer | |
| Silver bromoiodide emulsion (AgI content: 10.0 mol %; high internal AgI type; diameter: 1.2 μm (as calculated in terms of sphere); coefficient of fluctuation in grain diameter: 28% (as calculated in terms of sphere); tabtular grains; diameter/thickness ratio: 6.0) (coated silver amount) | 0.9 |
| Gelatin | 0.6 |
| ExS-1 | $2 \times 10^{-4}$ mol |
| ExS-2 | $0.6 \times 10^{-4}$ mol |
| ExS-3 | $0.2 \times 10^{-4}$ mol |
| ExC-4 | 0.07 |
| ExC-5 | 0.06 |
| Solv-1 | 0.12 |
| Solv-2 | 0.12 |
| 6th Layer: interlayer | |
| Gelatin | 1.0 |
| Cpd-4 | 0.1 |
| 7th Layer: 1st green-sensitive emulsion layer | |
| Silver bromoiodide emulsion (AgI content: 10.0 mol %; high internal AgI type; diameter: 0.7 μm (as calculated in terms of sphere); coefficient of fluctuation in grain diameter: 14% (as calculated in terms of sphere); tetradecahtedral grains) (coated silver amount) | 0.2 |
| Silver bromoiodide emulsion (AgI content: 14.0 mol %; high | 0.1 |

-continued

| | |
|---|---|
| internal AgI type; diameter: 0.4 μm (as calculated in terms of sphere); coefficient of fluctuation in grain diameter: 22% (as calculated in terms of sphere); tetradecahtedral grains) (coated silver amount) | |
| Gelatin | 1.2 |
| ExS-5 | $5 \times 10^{-4}$ mol |
| ExS-6 | $2 \times 10^{-4}$ mol |
| ExS-7 | $1 \times 10^{-4}$ mol |
| ExM-1 | 0.20 |
| ExM-6 | 0.25 |
| ExM-2 | 0.10 |
| ExM-5 | 0.03 |
| Solv-1 | 0.40 |
| Solv-4 | 0.03 |
| 8th Layer: 2nd green-sensitive emulsion layer | |
| Silver bromoiodide emulsion (AgI content: 10.0 mol %; high internal iodine type; diameter: 1.0 μm (as calculated in terms of sphere); coefficient of fluctuation in grain diameter: 25% (as calculated in terms of sphere); tabular grains; diameter/thickness ratio: 3.0) (coated silver amount) | 0.4 |
| Gelatin | 0.35 |
| ExS-5 | $3.5 \times 10^{-4}$ mol |
| ExS-6 | $1.4 \times 10^{-4}$ mol |
| ExS-7 | $0.7 \times 10^{-4}$ mol |
| ExM-1 | 0.09 |
| ExM-3 | 0.01 |
| Solv-1 | 0.15 |
| Solv-4 | 0.03 |
| 9th Layer: interlayer | |
| Gelatin | 0.5 |
| 10th Layer: 3rd green-sensitive emulsion layer | |
| Silver bromoiodide emulsion (AgI content: 10.0 mol %; high internal AgI type; diameter: 1.2 μm (as calculated in terms of sphere); coefficient of fluctuation in grain diameter: 28% (as calculated in terms of sphere); tabular grains; diameter/thickness ratio: 6.0) (coated silver amount) | 1.0 |
| Gelatin | 0.8 |
| ExS-5 | $2 \times 10^{-4}$ mol |
| ExS-6 | $0.8 \times 10^{-4}$ mol |
| ExS-7 | $0.8 \times 10^{-4}$ mol |
| ExM-3 | 0.01 |
| ExM-4 | 0.04 |
| ExC-4 | 0.005 |
| Solv-1 | 0.02 |
| 11th Layer: yellow filter layer | |
| Cpd-3 | 0.05 |
| Gelatin | 0.5 |
| Solv-1 | 0.1 |
| 12th Layer: interlayer | |
| Gelatin | 0.5 |
| Cpd-2 | 0.1 |
| 13th Layer: 1st blue-sensitive layer | |
| Silver bromoiodide emulsion (AgI content: 10 mol %; high internal iodine type; diameter: 0.7 μm (as calculated in terms of sphere); coefficient of fluctuation in grain diameter: 14% (as calculated in terms of sphere); tetradecahedral grains) (coated silver amount) | 0.1 |
| Silver bromoiodide emulsion (AgI content: 4.0 mol %; high internal iodine type; diameter: 0.4 μm (as calculated in terms of sphere); coefficient of fluctuation in grain diameter: 22% (as calculated in terms of sphere); tetradecahedral grains) (coated silver amount) | 0.05 |
| Gelatin | 1.0 |
| ExS-8 | $3 \times 10^{-4}$ mol |

-continued

| | |
|---|---|
| ExY-1 | 0.25 |
| ExY-3 | 0.32 |
| ExY-2 | 0.02 |
| Solv-1 | 0.20 |
| 14th Layer: 2nd blue-sensitive emulsion layer | |
| Silver bromoiodide emulsion (AgI content: 19.0 mol %; high internal AgI type; diameter: 1.0 μm (as calculated in terms of sphere); coefficient of fluctuation in grain diameter: 16% (as calculated in terms of sphere); tetradecahedral grains) (coated silver amount) | 0.19 |
| Gelatin | 0.3 |
| ExS-8 | $2 \times 10^{-4}$ mol |
| ExY-1 | 0.22 |
| Solv-1 | 0.07 |
| 15th Layer: interlayer | |
| Finely divided silver bromoiodide (AgI content: 2 mol %; uniform type; grain diameter: 0.13 μm as calculated in terms of sphere) (coated silver amount) | 0.2 |
| Gelatin | 0.36 |
| 16th layer: 3rd blue-sensitive emulsion layer | |
| Silver bromoiodide emulsion (AgI content: 14.0 mol %; high internal AgI type: grain diameter: 1.5 μm as calculated in terms of sphere; coefficient of fluctuation in grain diameter: 28% as calculated in terms of sphere); tabular grains; diameter/thickness ratio: 5.0) (coated silver amount | 1.0 |
| Gelatin | 0.5 |
| ExS-8 | $1.5 \times 10^{-4}$ |
| ExY-1 | 0.2 |
| Solv-1 | 0.07 |
| 17th layer: 1st protective layer | |
| Gelatin | 1.8 |
| UV-1 | 0.1 |
| UV-2 | 0.2 |
| Solv-1 | 0.01 |
| Solv-2 | 0.01 |
| 18th layer: 2nd protective layer | |
| Finely divided silver bromide grains (grain diameter: 0.07 μm as calculated in terms of sphere) (coated silver amount) | 0.18 |
| Gelatin | 0.7 |
| Polymethyl methacrylate grains (grain diameter: 1.5 μm) | 0.2 |
| W-1 | 0.02 |
| H-1 | 0.4 |
| Cpd-5 | 1.0 |

UV-1

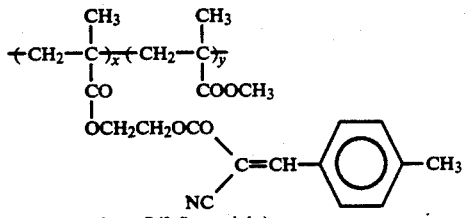

x/y = 7/3 (by weight)

UV-2

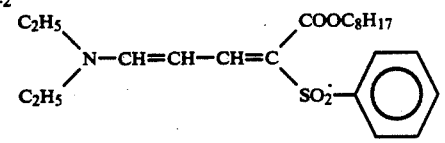

-continued
ExM-3
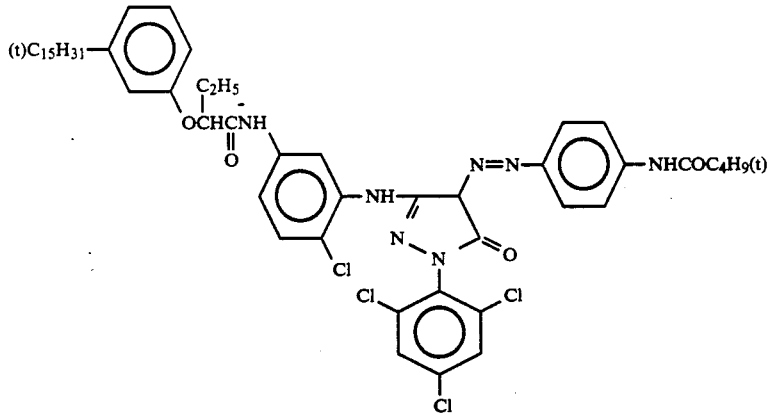
ExC-1
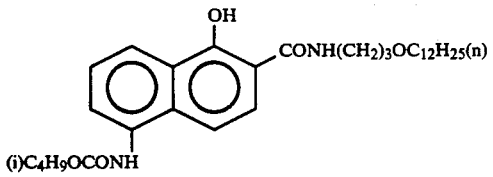
ExC-2
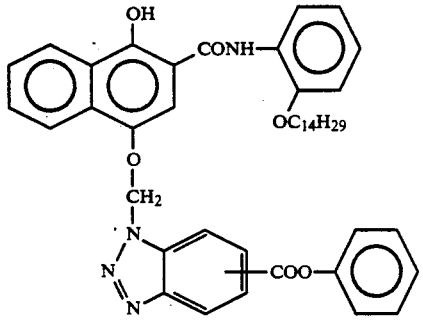
ExC-3
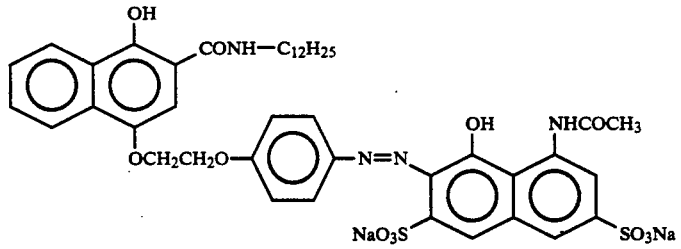
ExC-6
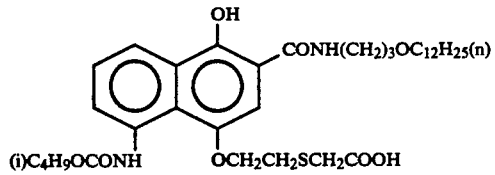
ExC-7
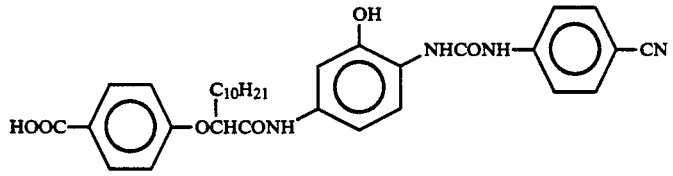

-continued
ExC-4
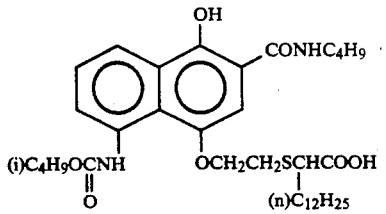
ExC-5
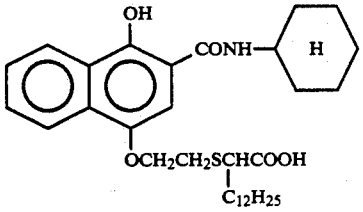
ExM-1
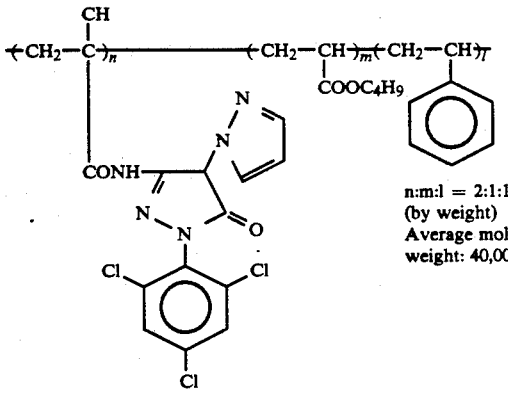
n:m:l = 2:1:1
(by weight)
Average molecular
weight: 40,000
ExM-2
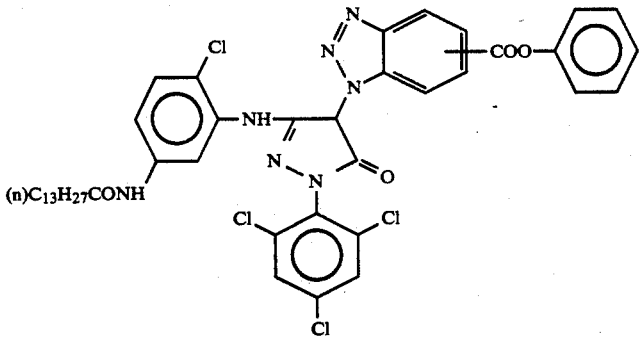
ExM-4
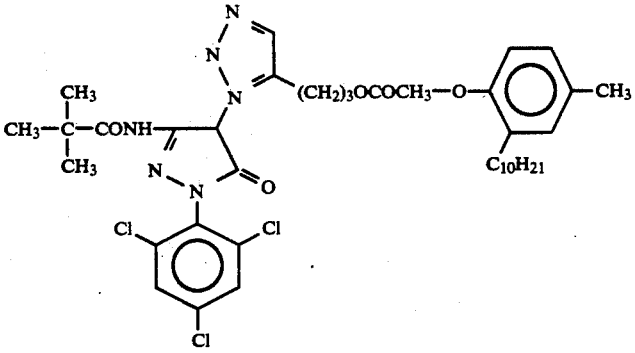

-continued
ExM-5
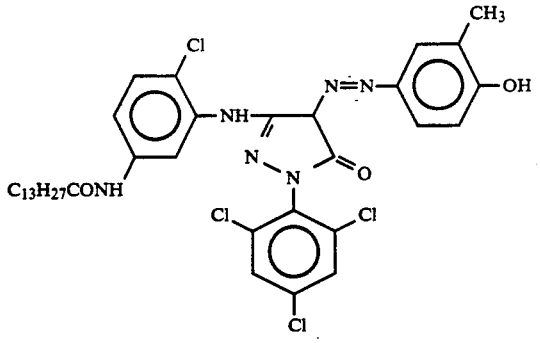
ExM-6
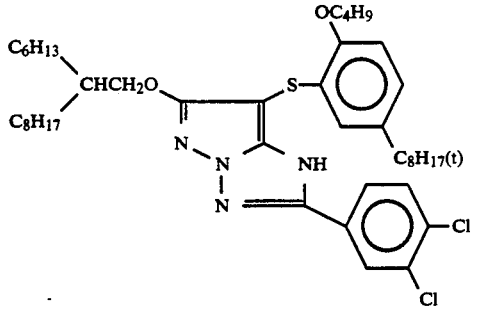
ExY-1
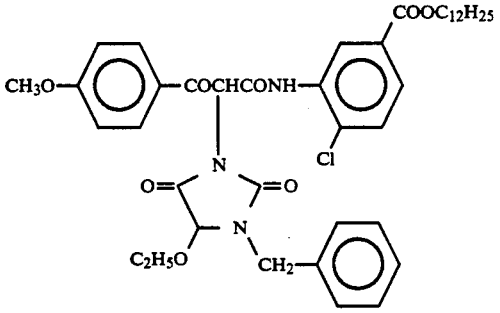
ExY-2
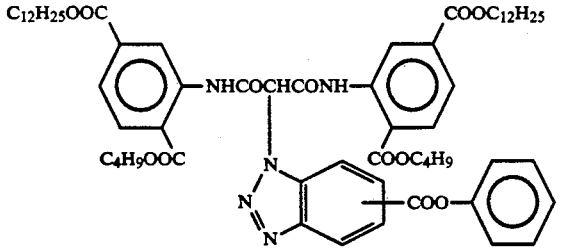
ExY-3
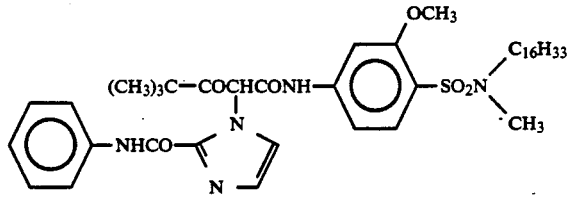

-continued
ExS-1
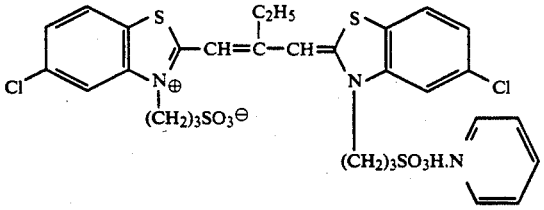
ExS-2
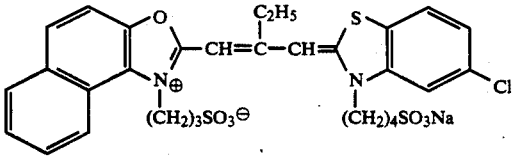
ExS-3
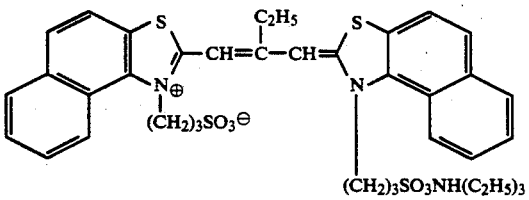
ExS-4
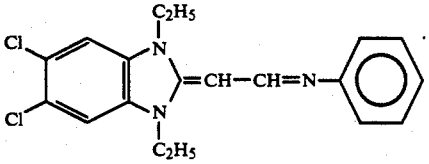
ExS-5
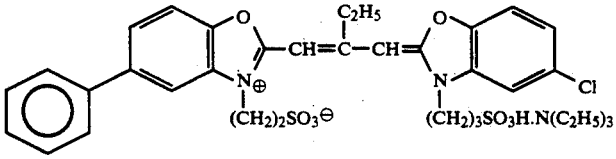
ExS-6
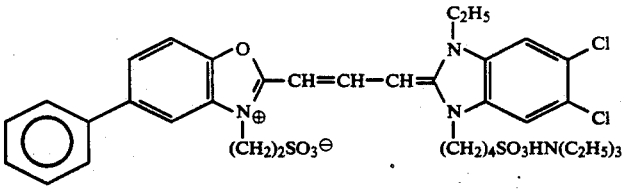
ExS-8
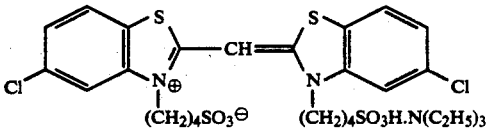
ExS-7
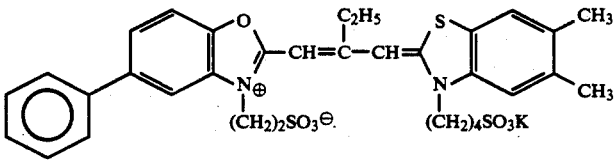

-continued
Solv-1
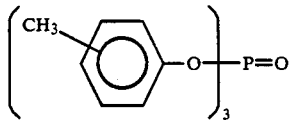
Solv-2
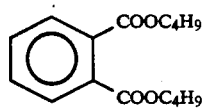
Solv-3
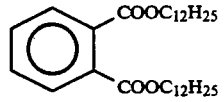
Solv-4
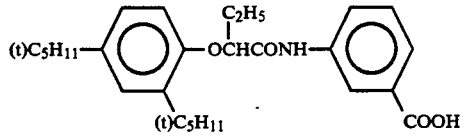
Cpd-1
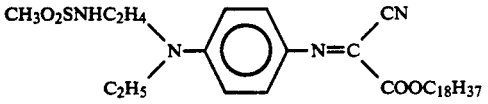
Cpd-2
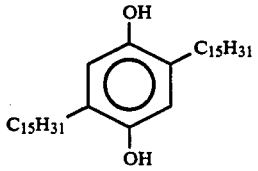
Cpd-3
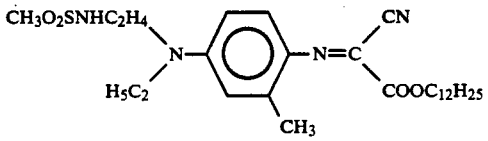
Cpd-4
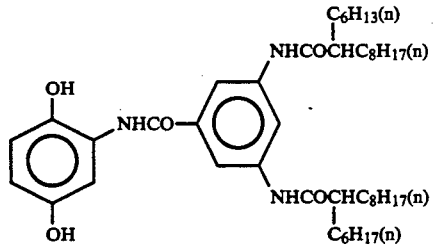
Cpd-5
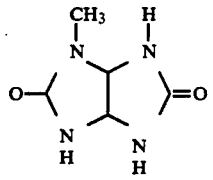

-continued
W-1
$C_8H_{17}SO_2NHCH_2CH_2CH_2OCH_2CH_2N^{\oplus}(CH_3)_3$
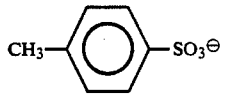
H-1
$CH_3{=}CHSO_2CH_2CONH{-}CH_2$
$\quad\quad\quad -continued

| | |
|---|---|
| pH | 5.0–7.0 |

The photographic light-sensitive material specimens thus processed were then measured for the remaining amount of silver on the maximum color density portion by means of a fluorescent X-ray analyzer. The results are set forth in Table 5.

These photographic light-sensitive material specimens were also measured for density. Dmin values measured by green light were read from the characteristic curve.

The same specimens were processed in the same manner as above except that they were processed with the following reference bleaching solution causing no bleach fogging at a temperature of 38° C. at a replenishment rate of 25 ml/35 mm width and 1 m length for 390 seconds.

Reference Bleaching Solution

| | Mother Solution | Replenisher |
|---|---|---|
| Ferric sodium ethylenediaminetetraacetate trihydrate | 100.0 g | 120.0 g |
| Disodium ethylenediaminetetraacetate | 10.0 g | 11.0 g |
| Ammonium bromide | 100 g | 120 g |
| Ammonium nitrate | 30.0 g | 35.0 g |
| Aqueous ammonia (27%) | 6.5 ml | 4.0 ml |
| Water to make | 1.0 l | 1.0 l |
| pH | 6.0 | 5.7 |

The specimens thus processed were measured for density in the same manner as described above. Dmin values were read from the characteristic curve.

The difference (Δmin) in Dmin of the specimens from that obtained by using the reference bleaching solution were determined. Dmin value obtained by the reference bleaching solution was 0.60.

Bleach fogging (Δmin) = (*D*min of each specimen) − (*D*min obtained by reference bleaching solution)

The results are set forth in Table 5.

These specimens were also measured for increase in fogging during the storage after processing. For this measurement, these specimens were stored under a wet heat condition (60° C., 70% RH) in a dark place for 4 weeks. The change in Dmin on noncolored portion between before and after storage was determined.

Increase in fogging (Δ*D*)=(*Dmin* after storage)−(*Dmin* before storage)

The results are set forth in Table 5.

TABLE 5

| No. | Chelate compound | Remaining amount of silver [μg/cm²] | Bleach fogging ΔDmin (G) | Increase in stain ΔD (G) |
|---|---|---|---|---|
| 501 | Comparative Compound A | 25.8 | 0.00 | 0.21 |
| 502 | Comparative Compound B | 7.2 | 0.14 | 0.10 |
| 503 | Comparative Compound C | 10.8 | 0.09 | 0.18 |
| 504 | Comparative Compound D | 6.2 | 0.18 | 0.11 |
| 505 | Comparative Compound E | 6.3 | 0.15 | 0.11 |
| 506 | Present Compound 51 | 4.8 | 0.01 | 0.03 |
| 507 | Present Compound 52 | 4.4 | 0.05 | 0.03 |
| 508 | Present Compound 54 | 4.2 | 0.02 | 0.03 |
| 509 | Present Compound 56 | 4.2 | 0.02 | 0.03 |
| 510 | Present Compound 61 | 4.0 | 0.03 | 0.04 |
| 511 | Present Compound 64 | 5.8 | 0.00 | 0.02 |
| 512 | Present Compound 67 | 5.0 | 0.06 | 0.05 |
| 513 | Present Compound 70 | 4.0 | 0.02 | 0.03 |
| 514 | Present Compound 75 | 5.5 | 0.01 | 0.03 |
| 515 | Present Compound 77 | 5.2 | 0.01 | 0.03 |
| 516 | Present Compound 81 | 5.2 | 0.02 | 0.04 |
| 517 | Present Compound 91 | 4.8 | 0.03 | 0.03 |
| 518 | Present Compound 92 | 4.9 | 0.03 | 0.04 |

(Note: Specimens 501 to 505 are comparative while the others are according to the present invention)

Comparative Compound A

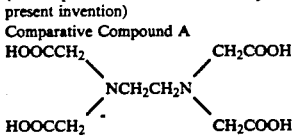

Comparative Compound B

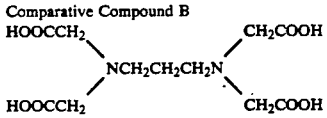

Comparative Compound C

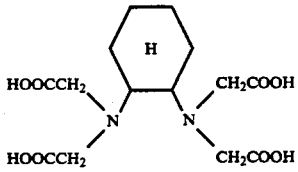

Comparative Compound D

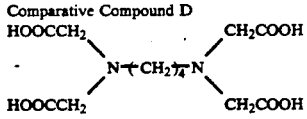

Comparative Compound E

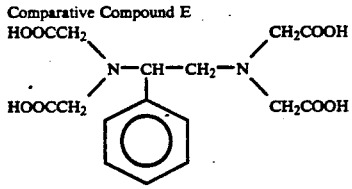

The results set forth in Table 1 show that as compared to the comparative compounds the present compounds are capable of reducing the remaining amount of silver while contributing to eliminating bleach fogging and stain during the storage of dye images after processing.

EXAMPLE 6

Specimen 311 described in JP-A-2-28637 was processed in accordance with the following steps:

| Step | Processing step Time | Temperature | Replenishment rate* | Tank capacity |
|---|---|---|---|---|
| Color development | 1 min. 45 sec. | 43° C. | 25 ml | 10 l |
| Bleach | 20 sec. | 40° C. | 5 ml | 4 l |
| Blix | 20 sec. | 40° C. | — | 4 l |
| Fixing | 20 sec. | 40° C. | 16 ml | 4 l |
| Washing (1) | 20 sec. | 40° C. | — | 2 l |
| Washing (2) | 10 sec. | 40° C. | 30 ml | 2 l |
| Stabilization | 10 sec. | 40° C. | 20 ml | 2 l |
| Drying | 1 min. | 60° C. | | |

*Determined per 35-mm width and 1-m length

The washing step was effected in a countercurrent process wherein the washing water flows from (2) to (1). The overflow solution from the bleaching bath was all introduced into the blix bath.

Furthermore, the overflow solution from the washing tank (1) was all introduced into the fixing bath, and the overflow solution of fixing bath was all introduced into the blix bath.

The amount of the fixing solution brought over to the washing step was 2.0 ml per m of 35-mm wide light-sensitive material.

The composition of the various processing solutions used were as follows:

Color Developer

| | Mother Solution | Replenisher |
|---|---|---|
| Diethylenetriamine-pentaacetic acid | 2.0 g | 2.0 g |
| 1-Hydroxyethylidene-1,1-diphosphonic acid | 3.0 g | 3.2 g |
| Sodium sulfite | 4.0 g | 5.8 g |
| Potassium carbonate | 40.0 g | 40.0 g |
| Potassium bromide | 1.3 g | — |
| Potassium iodide | 1.5 ml | — |
| Hydroxylamine sulfate | 2.4 g | 3.6 g |
| 2-Methyl-4-[N-ethyl-N-(β-hydroxyethyl)amino]-aniline sulfate | 9.2 g | 13.4 g |
| Water to make | 1.0 l | 1.0 l |
| pH adjusted with 50% potassium hydroxide | 10.20 | 10.35 |

Bleaching Solution

| | Mother Solution | Replenisher |
|---|---|---|
| Chelate compound set forth in Table 6 | 0.30 mol | 0.42 mol |
| Iron nitrate | 0.27 mol | 0.38 mol |
| Ammonium bromide | 100 g | 140 g |
| Ammonium nitrate | 17.5 g | 25.0 g |
| Water to make | 1.0 l | 1.0 l |
| pH | 4.5 | 4.5 |

Fixing Solution

| | Mother Solution | Replenisher |
|---|---|---|
| Aqueous solution of ammonium thiosulfate (700 g/l) | 280 ml | 840 ml |
| Ethylenediaminetetraacetic acid | 12,6 g | 38 g |
| Ammonium sulfite | 27.5 g | 82.5 g |
| Imidazole | 28 g | 84 g |
| Water to make | 1 l | 1 l |
| pH | 7.8 | 8.0 |

Blix Solution

5:16:30 mixture (by volume) of bleaching solution, fixing solution and washing solution

Washing Solution

Same as in Example 5

Stabilizing Solution (The mother solution was used also as replenisher)

| | |
|---|---|
| Formalin (37%) | 2.0 ml |
| Polyoxyethylene-p-monononylphenylether (average polymerization degree: 10) | 0.3 |
| Disodium ethylenediaminetetraacetate | 0.05 |
| Water to make | 1.0 l |
| pH | 5.0–8.0 |

The specimens thus processed were measured for density in the same manner as described above. Dmix values measured by green light were read from the characteristic curve.

On the other hand, Specimen 311 as described in JP-A-2-28637 was processed with the same reference bleaching solution as used in Example 5, and then measured for Dmin in the same manner as described above. Bleach fogging and Dmin were calculated on the basis of the Dmin value of the reference bleaching solution in the same manner as in Example 5. The reference bleaching solution had a Dmix value of 0.57. The results are set forth in Table 6.

Another batch of the specimens thus processed were evaluated for stain during the storage of dye images after processing in the same manner as in Example 5. The results are set forth in Table 6.

Another batch of these specimens were exposed to light in such a manner that the grey density thus developed reached 1.5, processed in the same manner as described above, and then measured for the remaining amount of silver by fluorescent X-ray process. The results are set forth in Table 6.

TABLE 6

| No. | Chelate compound | Remaining amount of silver [μg/cm²] | Bleach fogging ΔDmin (G) | Increase in stain ΔD (G) |
|---|---|---|---|---|
| 601 | Comparative Compound A | 35.0 | 0.03 | 0.23 |
| 602 | Comparative Compound B | 7.2 | 0.26 | 0.16 |
| 603 | Comparative Compound C | 12.8 | 0.08 | 0.18 |
| 604 | Comparative Compound D | 6.0 | 0.27 | 0.17 |
| 605 | Comparative | 6.2 | 0.23 | 0.17 |

TABLE 6-continued

| No. | Chelate compound | Remaining amount of silver [μg/cm²] | Bleach fogging ΔDmin (G) | Increase in stain ΔD (G) |
|---|---|---|---|---|
| 606 | Compound E Present | 3.6 | 0.01 | 0.01 |
| 607 | Compound 51 Present | 3.3 | 0.04 | 0.02 |
| 608 | Compound 57 Present | 3.2 | 0.02 | 0.03 |
| 609 | Compound 54 Present | 3.2 | 0.02 | 0.03 |
| 610 | Compound 56 Present | 3.0 | 0.03 | 0.03 |
| 611 | Compound 61 Present | 5.2 | 0.00 | 0.02 |
| 612 | Compound 64 Present | 3.7 | 0.05 | 0.04 |
| 613 | Compound 67 Present | 3.8 | 0.03 | 0.03 |
| 614 | Compound 70 Present | 4.0 | 0.01 | 0.02 |
| 615 | Compound 75 Present | 3.7 | 0.01 | 0.02 |
| 616 | Compound 77 Present | 3.9 | 0.02 | 0.03 |
| 617 | Compound 81 Present | 3.5 | 0.02 | 0.03 |
| 518 | Compound 91 Present Compound | 3.6 | 0.03 | 0.03 |

(Note: Specimens 601 to 605 are comparative while the others are according to the present invention)

Comparative Compounds A, B, C, D and E used were as used in Example 5. Table 6 shows that as compared to the comparative compounds the present compounds are capable of reducing the remainining amount of silver while contributing to eliminating bleach fogging and stain during the storage of dye images after processing.

EXAMPLE 7

A multilayer color photographic paper specimen was prepared by coating on a polyethylene both side-laminated paper support which had been corona-discharged and then provided with a gelatin subbing layer containing sodium dodecylbenzenesulfonate various photographic constiuent layers having the following compositions. The coating solutions for these layers were prepared as follows:

Coating Liquid for 1st Layer 19.1 g of a yellow coupler (ExY), 4.4 g of a dye image stabilizer (Cpd-1) and 0.7 g of a dye image stabilizer (Cpd-7) were dissolved in 27.2 ml of ethyl acetate, 4.1 g of a solvent (Solv-3) and 4.1 g of a solvent (Solv-7). The solution thus obtained was then emulsion-dispersed in 185 ml of a 10% aqueous solution of gelatin containing 8 ml of 10% sodium dodecylbenzensulfonate to prepare Emulsion Dispersion A. On the other hand, a silver bromochloride emulsion A (3:7 mixture (ratio of molar amount of silver) of a large size emulsion A of cubic grains with a mean grain size of 0.88 μm and a grain size distribution fluctuation coefficient of 0.08 and a small size emulsion A of cubic grains with a mean grain size of 0.70 m and a grain size distribution fluctuation coefficient of 0.10, both having 0.3 mol % silver bromide localized on the surface thereof) was prepared by incorporating the blue-sensitive sensitizing dyes A and B as described later in amounts of $2.0\times10^{-4}$ mol and $2.5\times10^{-4}$ mol based on mol of silver in the large size emulsion A and the small size emulsion B, respectively. For the chemical sensitization of these emulsions a sulfur sensitizer and a gold sensitizer were used. Emulsion Dispersion A and Silver Bromochloride Emulsion A were then mixed and dissolved to prepare a coating solution for the 1st layer having the following composition.

Coating solutions for the 2nd to 7th layers were prepared in the same manner as in the 1st layer coating solution. There was incorporated in each layer a sodium salt of 1-oxy-3,5-dichloro-s-triazine as gelatin hardener.

To each of these layers were added Cpd-10 and Cpd-11 in amounts of 25.0 mg/m² and 50.0 mg/m², respectively.

In the silver bromochloride emulsion for each light-sensitive emulsion layer were incorporated the following spectral sensitizing dyes:

Sensitizing dye A for blue-sensitive emulsion layer

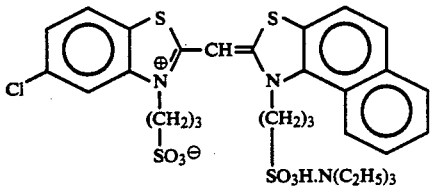

Sensitizing dye A for blue-sensitive emulsion layer

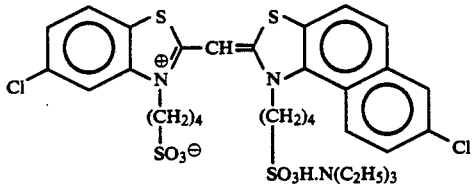

($2.0\times10^{-4}$ mol per mol of silver halide in the large size emulsion A and $2.5\times10^{-4}$ mol per mol of silver halide in the small size emulsion A)

Sensitizing dye C for green-sensitive emulsion layer

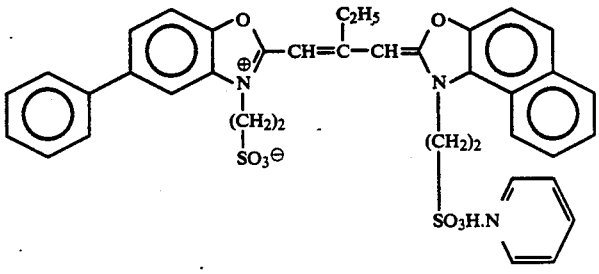

($4.0\times10^{-4}$ mol per mol of silver halide in the large size emulsion B and $5.6\times10^{-4}$ mol per mol of silver halide in the small size emulsion B)

Sensitizing dye D for green-sensitive emulsion layer

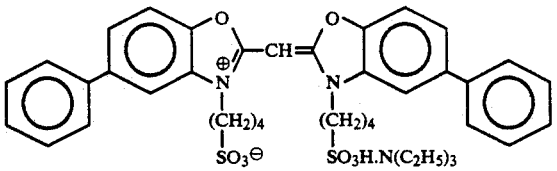

($7.0\times10^{-5}$ mol per mol of silver halide in the large size emulsion B and $1.0\times10^{-5}$ mol per mol of silver halide in the small size emulsion B)

Sensitizing dye E for red-sensitive emulsion layer

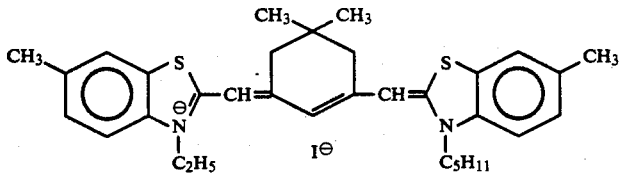

($0.9\times10^{-4}$ mol per mol of silver halide in the large size emulsion C and $1.1\times10^{-4}$ mol per mol of silver halide in the small size emulsion C)

In the red-sensitive emulsion layer was incorporated the following compound in an amount of $2.6\times10^{-3}$ mol per mol of silver halide:

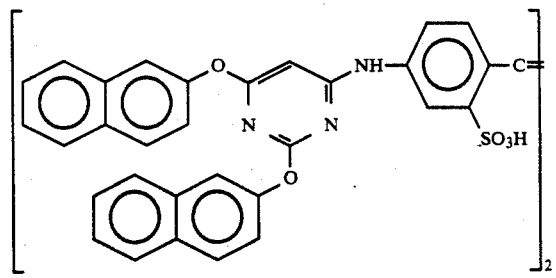

In the blue-sensitive emulsion layer, the green-sensitive emulsion layer and the red-sensitive emulsion layer was incorporated 1-(5-methylureidophenyl)-5-mercaptotetrazole in amounts of $8.5\times10^{-5}$ mol, $7.7\times10^{-4}$ mol and $2.5\times10^{-4}$ mol per mol of silver halide.

In the blue-sensitive emulsion layer and the green-sensitive emulsion layer was incorporated 4-hydroxy-6-methyl-1,3,3a,7-tetrazaindene in amounts of $1\times10^{-4}$ mol and $2\times10^{-4}$ mol per mol of silver halide.

In order to inhibit irradiation, the following dyes were incorporated in these emulsion layers (figure in parenthesis indicates coated amount).

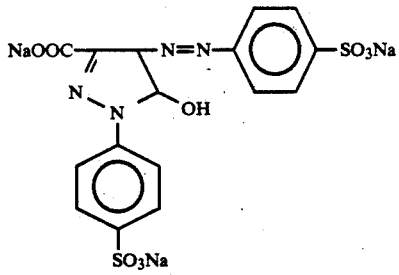

(10 mg/m²)

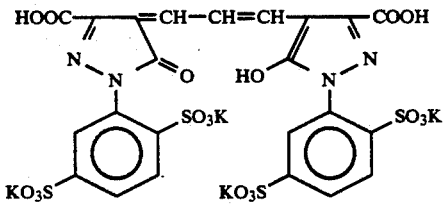

(10 mg/m²)

-continued

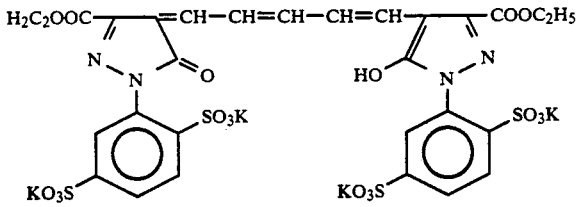

(40 mg/m²)

and

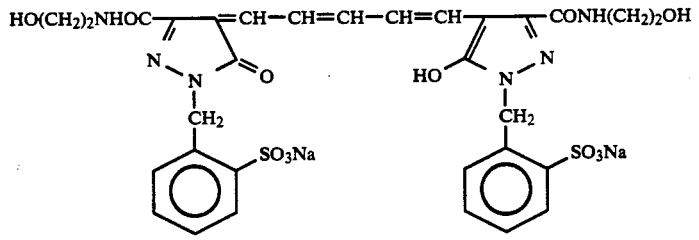

(20 mg/m²)

Layer Structure

The composition of these layers will be set forth below. The figure indicate coated amount in g/m². The coated amount of silver halide emulsion is represented as calculated in terms of amount of silver.

Support

Polyethylene-laminated paper [containing a white pigment ($TiO_2$) and a bluish dye (ultramarine) on the 1st layer side]

| | |
|---|---|
| 1st layer: blue-sensitive emulsion layer | |
| Silver bromochloride emulsion A as set forth above | 0.30 |
| Gelatin | 1.86 |
| Yellow Coupler (ExY) | 0.82 |
| Dye image stabilizer (Cpd-1) | 0.19 |
| Solvent (Solv-3) | 0.18 |
| Solvent (Solv-7) | 0.18 |
| Dye image stabilizer (Cpd-7) | 0.06 |
| 2nd layer: color mixing inhibiting layer | |
| Gelatin | 0.99 |
| Color mixing inhibiting agent (Cpd-5) | 0.08 |
| Solvent (Solv-1) | 0.16 |
| Solvent (Solv-4) | 0.08 |
| 3rd layer: green-sensitive emulsion layer | |
| Silver bromochloride emulsion (1:3 mixture (ratio of molar amount of silver) of a large size emulsion B of cubic grains with a mean grain size of 0.55 μm and a grain size distribution fluctuation coefficient of 0.10 and a small size emulsion B of cubic grains with a mean grain size of 0.39 μm and a grain size distribution fluctuation coefficient of 0.08, both having 0.8 mol % silver bromide localized on the surface thereof) | 0.12 |
| Gelatin | 1.24 |
| Magenta coupler (ExM) | 0.23 |
| Dye image stabilizer (Cpd-2) | 0.03 |
| Dye image stabilizer (Cpd-3) | 0.16 |
| Dye image stabilizer (Cpd-4) | 0.02 |
| Dye image stabilizer (Cpd-9) | 0.02 |
| Solvent (Solv-2) | 0.40 |
| 4th layer: ultraviolet-absorbing layer | |
| Gelatin | 1.58 |
| Ultraviolet absorbent (UV-1) | 0.47 |
| Color mixing inhibitor (Cpd-5) | 0.05 |
| Solvent (Solv-5) | 0.24 |
| 5th layer: red-sensitive emulsion layer | |
| Silver bromochloride emulsion (1:4 mixture (ratio of molar amount of silver) of a large size emulsion C of cubic grains with a mean grain size of 0.58 μm and a grain size distribution fluctuation coefficient of 0.09 and a small size emulsion C of cubic grains with a mean grain size of 0.45 μm and a grain size distribution fluctuation coefficient of 0.11, both having 0.6 mol % silver bromide localized on the surface thereof) | 0.23 |
| Gelatin | 1.34 |
| Cyan coupler (ExC) | 0.32 |
| Dye image stabilizer (Cpd-2) | 0.03 |
| Dye image stabilizer (Cpd-4) | 0.02 |
| Dye image stabilizer (Cpd-6) | 0.18 |

-continued

| | |
|---|---|
| Dye image stabilizer (Cpd-7) | 0.40 |
| Dye image stabilizer (Cpd-8) | 0.05 |
| Solvent (Solv-6) | 0.14 |
| 6th layer: ultraviolet-absorbing layer | |
| Gelatin | 0.53 |
| Ultraviolet absorbent (UV-1) | 0.16 |
| Color mixing inhibitor (Cpd-5) | 0.02 |
| Solvent (Solv-5) | 0.08 |
| 7th layer: protective layer | |
| Gelatin | 1.33 |
| Acryl-modified copolymer of polyvinyl alcohol (modification degree: 17%) | 0.17 |
| Liquid paraffin | 0.03 |

Yellow coupler (ExY)
1:1 Mixture (molar ratio) of

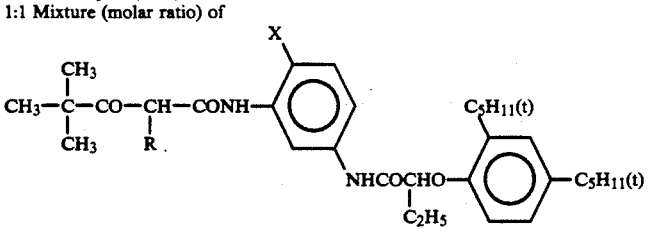

R =

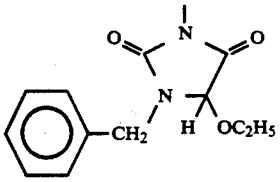

X = Cl and

R =

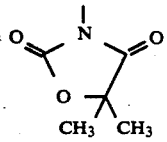

X = $OCH_3$

Magenta coupler (ExM)

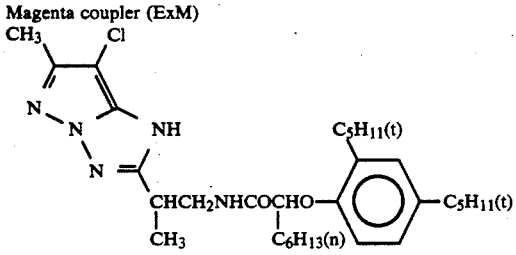

Cyan coupler (ExC)
1:1 (molar ratio) mixture of:

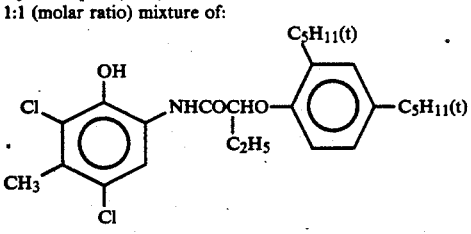

and

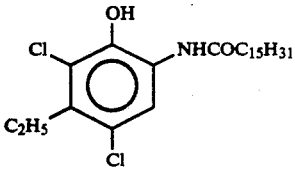

-continued
Dye image stabilizer (Cpd-1)
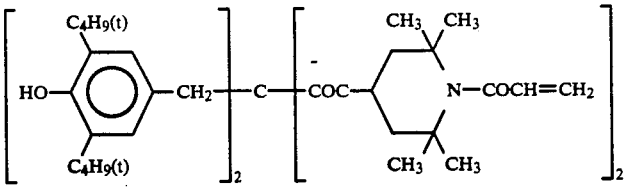
Dye image stabilizer (Cpd-2)
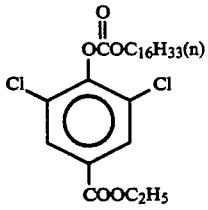
Dye image stabilizer (Cpd-3)
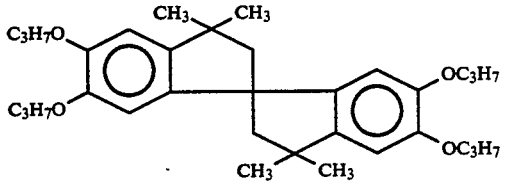
Dye image stabilizer (Cpd-4)
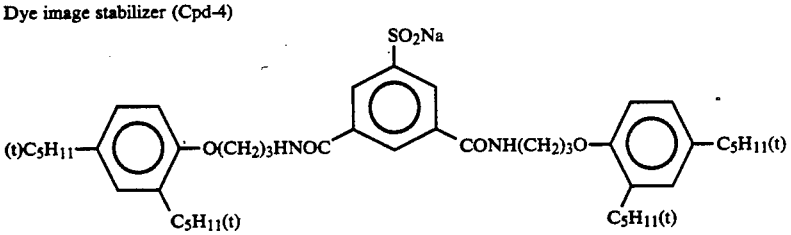
Color mixing inhibitor (Cpd-5)
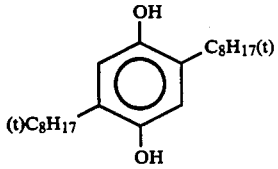
Dye image stabilizer (Cpd-6)
2:4:4 (weight ratio) mixture of:
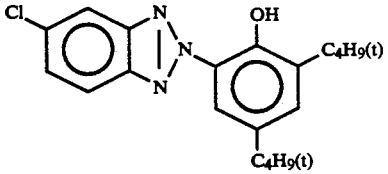
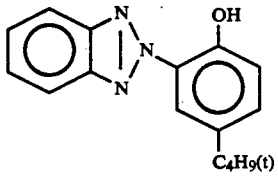

-continued
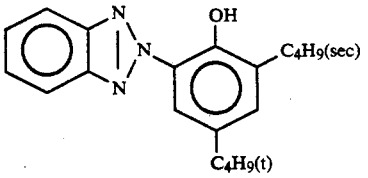
Dye image stabilizer (Cpd-7)
$$\left(CH_2-\underset{\substack{|\\ CONHC_4H_9(t)}}{CH}\right)_n$$
(Average MW 60,000)
Dye image stabilizer (Cpd-8)
1:1 (weight ratio) mixture of:
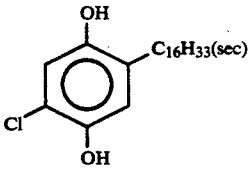
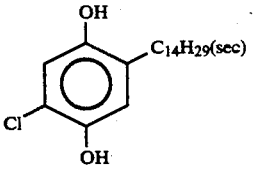
Dye image stabilizer (Cpd-9)
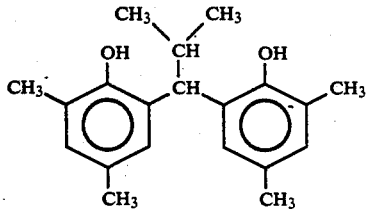
Antiseptic agent (Cpd-10)
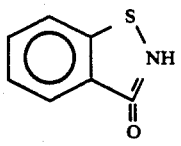
Antiseptic agent (Cpd-11)
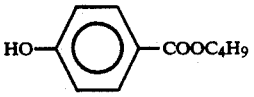
Ultraviolet absorbent (UV-1)
4:2:4 (weight ratio) mixture of:
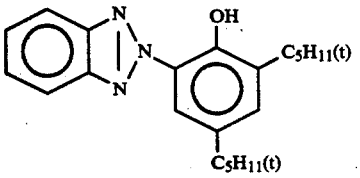
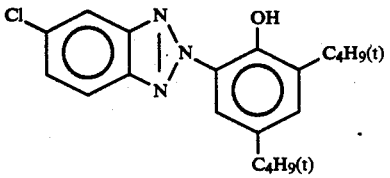

-continued

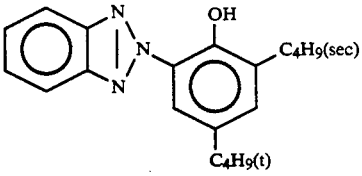

Solvent (Solv-1)

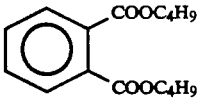

Solvent (Solv-2)
1:1 (by volume) mixture of:

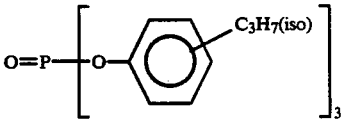

and

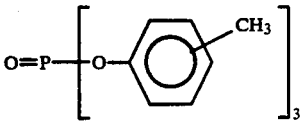

Solvent (Solv-3)
$O{=}P{+}O{-}C_9H_{19}(iso)]_3$
Solvent (Solv-4)

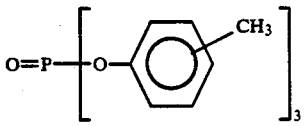

Solvent (Solv-5)

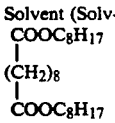

Solvent (Solv-6)
80:20 (by volume) mixture of:

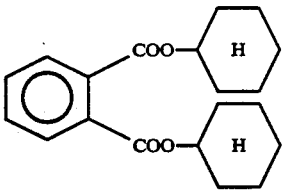

and

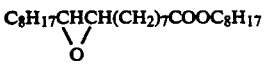

Solvent (Solv-7)

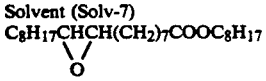

Various processing solutions having the following compositions were prepared:

Color Developer

| | |
|---|---|
| Water | 600 ml |
| Ethylenediamine-N,N,N',N'-tetramethylenephosphonic acid | 2.0 g |
| Potassium bromide | 0.015 g |

-continued

| | |
|---|---|
| Potassium chloride | 3.1 g |
| Triethanolamine | 10.0 g |
| Potassium carbonate | 27 g |
| Fluorescent brightening agent (WHITEX.4B, available from Sumitomo Chemical Co., Ltd.) | 1.0 g |
| Diethylhydroxylamine | 4.2 g |
| N-ethyl-N-(β-methanesulfonamido- | 5.0 g |

-continued

| | |
|---|---|
| ethyl)-3-methyl-4-aminoaniline sulfate | |
| Water to make | 1,000 ml |
| pH (25° C.) | 10.05 |

Blix Solution

| | |
|---|---|
| Water | 400 ml |
| Ammonium thiosulfate (70%) | 100 ml |
| Sodium sufite | 17 g |
| Iron chloride | 0.30 mol |
| Chelate compound as set forth in Table 7 | 0.33 mol |
| Ammonium bromide | 40 g |
| Water to make | 1,000 ml |
| pH (25° C.) | 6.8 |

Rinse Solution

Ion-exchanged water (calcium and magnesium concentrations: 3 ppm each)

The above mentioned light-sensitive material specimens were processed in the following manner:

| Processing step | Temperature | Time |
|---|---|---|
| Color development | 38° C. | 45 sec. |
| Blix | 35° C. | 25 sec. |
| Rinse 1 | 35° C. | 20 sec. |
| Rinse 2 | 35° C. | 20 sec. |
| Rinse 3 | 35° C. | 20 sec. |
| Drying | 80° C. | 60 sec. |

Another batch of these specimens were uniformly exposed to light in such a manner that the grey density thus developed reached 1.5, processed in the same manner as described above, and then measured for the amount of silver remaining in the maximum density portion thereon by a fluorescent X-ray process. The results are set forth in Table 7.

TABLE 7

| No. | Chelate compound | Remaining amount of silver ($\mu g/cm^2$) | Remarks |
|---|---|---|---|
| 701 | Comparative Compound A* | 23.3 | Comparative |
| 702 | Present Compound 51 | 2.1 | Invention |
| 703 | Present Compound 52 | 2.1 | " |
| 704 | Present Compound 54 | 2.3 | " |
| 705 | Present Compound 56 | 2.4 | " |
| 706 | Present Compound 61 | 2.0 | " |
| 707 | Present Compound 67 | 2.6 | " |
| 708 | Present Compound 77 | 2.8 | " |
| 709 | Present Compound 81 | 3.0 | " |

Comparative Compound A* is the same as Comparative Compound A in Example 5.

The results show that the use of the present compounds enables the reduction in the remaining amount of silver as compared to Comparative Compound A.

EXAMPLE 8

Fuji Color SUPER HG400 (Production No. 311130) and Fuji Color REALA (Production No. 861016) were processed in the same manner as in Specimens 601 to 618 in Example 6. As a result, results similar to that of Example 6 were confirmed.

EXAMPLE 9

A multilayer color light-sensitive material was prepared as Specimen 902 by coating on a undercoated cellulose triacetate film support various layers having the following compositions.

Composition of Photographic Layer

The coated amount of silver halide and colloidal silver is represented in $g/m^2$ as calculated in terms of amount of silver. The coated amount of coupler, additive and gelatin is represented in $g/m^2$. The coated amount of sensitizing dye is represented in mol per mol of silver halide contained in the same layer. The symbols indicating additives have the following meanings. The additives having a plurality of effects are represented by the symbol indicating one of the effects.

UV: ultraviolet absorbent; Solv: high boiling organic solvent; ExF: dye; ExS: sensitizing dye; ExC: cyan coupler; ExM: magenta coupler; ExY: yellow coupler; Cpd: additive

| | |
|---|---|
| 1st Layer: anti-halation layer | |
| Black colloidal silver | 0.15 |
| Gelatin | 2.33 |
| ExM-2 | 0.11 |
| UV-1 | $3.0 \times 10^{-2}$ |
| UV-2 | $6.0 \times 10^{-2}$ |
| UV-3 | $7.0 \times 10^{-2}$ |
| Solv-1 | 0.16 |
| Solv-2 | 0.10 |
| ExF-1 | $1.0 \times 10^{-2}$ |
| ExF-2 | $4.0 \times 10^{-2}$ |
| ExF-3 | $5.0 \times 10^{-3}$ |
| Cpd-6 | $1.0 \times 10^{-3}$ |
| 2nd Layer: low sensitivity red-sensitive emulsion layer | |
| Silver bromoiodide emulsion (AgI content: 4.0 mol %; uniform AgI type; grain diameter: 0.4 μm (as calculated in terms of sphere); grain diameter fluctuation coefficient: 30% (as calculated in terms of sphere); tabular grain; diameter/thickness: 3.0); (coated silver amount) | 0.35 |
| Silver bromoiodide emulsion (AgI content: 6.0 mol %; internal high AgI type with core/shell ratio of 1:2; grain diameter: 0.45 μm (as calculated in terms of sphere); grain diameter fluctuation coefficient: 23% (as calculated in terms of sphere); tabular grain; diameter/thickness: 2.0); (coated silver amount) | 0.18 |
| Gelatin | 0.77 |
| ExS-1 | $2.4 \times 10^{-4}$ |
| ExS-2 | $1.4 \times 10^{-4}$ |
| ExS-5 | $2.3 \times 10^{-4}$ |
| ExS-7 | $4.1 \times 10^{-6}$ |
| ExC-1 | 0.09 |
| ExC-2 | $4.0 \times 10^{-2}$ |
| ExC-3 | $8.0 \times 10^{-2}$ |
| ExC-5 | 0.08 |
| 3rd layer: middle sensitivity red-sensitive emulsion layer | |
| Silver bromoiodide emulsion (AgI content: 6.0 mol %; internal high AgI type with core/shell ratio of 1:2; grain diameter: 0.65 μm (as calculated in terms of sphere); grain diameter fluctuation coefficient: 23% (as calculated in terms of sphere); tabular grain; diameter/thickness: 2.0); (coated silver amount) | 0.80 |
| Gelatin | 1.46 |
| ExS-1 | $2.4 \times 10^{-4}$ |
| ExS-2 | $1.4 \times 10^{-4}$ |

-continued

| | |
|---|---|
| ExS-5 | $2.4 \times 10^{-4}$ |
| ExS-7 | $4.3 \times 10^{-6}$ |
| ExC-1 | 0.19 |
| ExC-2 | $2.0 \times 10^{-2}$ |
| ExC-3 | 0.10 |
| ExC-5 | 0.19 |
| ExC-6 | $2.0 \times 10^{-2}$ |
| ExM-3 | $2.0 \times 10^{-2}$ |
| UV-2 | $5.7 \times 10^{-2}$ |
| UV-3 | $5.7 \times 10^{-2}$ |
| 4th Layer: high sensitivity red-sensitive emulsion layer | |
| Silver bromoiodide emulsion (AgI content: 9.3 mol %; polystructural grain with core/shell ratio of 3:4:2; AgI content: 24, 0, 6 mol % towards surface; grain diameter: 0.75 μm (as calculated in terms of sphere); grain diameter fluctuation coefficient: 23% (as calculated in terms of sphere); tabular grain; diameter/thickness: 2.5); (coated silver amount) | 1.49 |
| Gelatin | 1.38 |
| ExS-1 | $2.0 \times 10^{-4}$ |
| ExS-2 | $1.1 \times 10^{-4}$ |
| ExS-5 | $1.9 \times 10^{-4}$ |
| ExS-7 | $1.4 \times 10^{-5}$ |
| ExC-1 | $8.0 \times 10^{-2}$ |
| ExC-4 | $9.0 \times 10^{-2}$ |
| ExC-6 | $2.0 \times 10^{-2}$ |
| Solv-1 | 0.20 |
| Solv-2 | 0.53 |
| 5th Layer: interlayer | |
| Gelatin | 0.62 |
| Cpd-1 | 0.13 |
| Polyethyl acrylate latex | $8.0 \times 10^{-2}$ |
| Solv-1 | $8.0 \times 10^{-2}$ |
| 6th Layer: low sensitivity green-sensitive emulsion layer | |
| Silver bromoiodide emulsion (AgI content: 4.0 mol %; uniform AgI type; grain diameter: 0.33 μm (as calculated in terms of sphere); grain diameter fluctuation coefficient: 37% (as calculated in terms of sphere); tabular grain; diameter/thickness ratio: 2.0); (coated silver amount) | 0.19 |
| Gelatin | 0.44 |
| ExS-3 | $1.5 \times 10^{-4}$ |
| ExS-4 | $4.4 \times 10^{-4}$ |
| ExS-5 | $9.2 \times 10^{-5}$ |
| ExM-1 | 0.17 |
| ExM-3 | $3.0 \times 10^{-2}$ |
| Solv-1 | 0.13 |
| Solv-4 | $1.0 \times 10^{-2}$ |
| 7th Layer: middle sensitivity green-sensitive emulsion layer | |
| Silver bromoiodide emulsion (AgI content: 4.0 mol %; uniform AgI type; grain diameter: 0.55 μm (as calculated in terms of sphere); grain diameter fluctuation coefficient: 15% (as calcualted in terms of sphere); tabular grain; diameter/thickness ratio: 4.0); (coated silver amount) | 0.24 |
| Gelatin | 0.54 |
| ExS-3 | $2.1 \times 10^{-4}$ |
| ExS-4 | $6.3 \times 10^{-4}$ |
| ExS-5 | $1.3 \times 10^{-4}$ |
| ExM-1 | 0.15 |
| ExM-3 | $4.0 \times 10^{-2}$ |
| ExY-1 | $3.0 \times 10^{-2}$ |
| Solv-1 | 0.13 |
| Solv-4 | $1.0 \times 10^{-2}$ |
| 8th Layer: high sensitivity green-sensitive emulsion layer | |
| Silver bromoiodide emulsion (AgI content: 8.8 mol %; polystructural grain with ratio of amount of silver of 3:4:2; AgI content: 24, 0, 3 mol % towards surface; grain diameter: 0.75 μm (as calculated in terms of sphere); grain diameter fluctuation coefficient: 23% (as calculated in terms of sphere); diameter/thickness ratio: 1.6); (coated silver amount) | 0.61 |
| Gelatin | |
| ExS-4 | $4.3 \times 10^{-4}$ |
| ExS-5 | $8.6 \times 10^{-5}$ |
| ExS-8 | $2.8 \times 10^{-5}$ |
| ExM-1 | $8.0 \times 10^{-2}$ |
| ExM-2 | $3.0 \times 10^{-2}$ |
| ExY-1 | $3.0 \times 10^{-2}$ |
| ExC-1 | $1.0 \times 10^{-2}$ |
| ExC-4 | $1.0 \times 10^{-2}$ |
| Solv-1 | 0.23 |
| Solv-2 | $5.0 \times 10^{-2}$ |
| Solv-4 | $1.0 \times 10^{-2}$ |
| Cpd-8 | $1.0 \times 10^{-2}$ |
| 9th Layer: interlayer | |
| Gelatin | 0.56 |
| Cpd-1 | $4.0 \times 10^{-2}$ |
| Polyethyl acrylate latex | $5.0 \times 10^{-2}$ |
| Solv-1 | $3.0 \times 10^{-2}$ |
| V-4 | $3.0 \times 10^{-2}$ |
| UV-5 | $4.0 \times 10^{-2}$ |
| 10th Layer: donor layer having interimage effect on red-sensitive layer | |
| Silver bromoiodide emulsion (AgI content: 8.0 mol %; internal high AgI type with core/shell ratio 1:2; grain diameter: 0.65 μm (as calculated in terms of sphere); grain diameter fluctuation coefficient: 25% (as calculated in terms of sphere); tabular grain; diameter/thickness ratio: 2.0); (coated silver amount) | 0.67 |
| Silver bromoiodide emulsion (AgI content: 4.0 mol %; uniform AgI type; grain diameter: 0.4 μm (as calculated in terms of sphere); grain diameter fluctuation coefficient: 30% (as calculated in terms of sphere); tabular grain; diameter/thickness: 3.0); (coated silver amount) | 0.20 |
| Gelatin | 0.87 |
| ExS-3 | $6.7 \times 10^{-4}$ |
| ExM-4 | 0.16 |
| Solv-1 | 0.30 |
| Solv-6 | $3.0 \times 10^{-2}$ |
| 11th Layer: yellow filter layer | |
| Yellow colloidal silver | $9.0 \times 10^{-2}$ |
| Gelatin | 0.84 |
| Cpd-2 | 0.13 |
| Solv-1 | 0.13 |
| Cpd-1 | $8.0 \times 10^{-2}$ |
| Cpd-6 | $2.0 \times 10^{-3}$ |
| H-1 | 0.25 |
| 12th Layer: low sensitivity blue-sensitive emulsion layer | |
| Silver bromoiodide emulsion (AgI content: 4.5 mol %; uniform AgI type; grain diameter: 0.7 μm (as calculated in terms of sphere); grain diameter fluctuation coefficient: 15% (as calculated in terms of sphere); tabular grain; diameter/thickness: 7.0); (coated silver amount) | 0.50 |
| Silver bromoiodide emulsion (AgI content: 3.0 mol %; uniform AgI type; grain diameter: 0.3 μm (as calculated in terms of sphere); grain diameter fluctuation coefficient: 30% (as calculated in terms of sphere); tabular grain; diameter/thickness: 7.0); (coated silver amount) | 0.30 |
| Gelatin | 2.18 |
| ExS-6 | $9.0 \times 10^{-4}$ |
| ExC-1 | 0.14 |
| ExY-2 | 0.17 |
| ExY-3 | 1.09 |
| Solv-1 | 0.54 |

-continued

| | |
|---|---|
| 13th Layer: interlayer | |
| Gelatin | 0.40 |
| ExY-4 | 0.19 |
| Solv-1 | 0.19 |
| 14th Layer: 1st protective layer | |
| Silver bromoiodide emulsion (AgI content: 10.0 mol %; internal high AgI type; grain diameter: 1.0 μm (as calculated in terms of sphere); grain diameter fluctuation coefficient: 25% (as calculated in terms of sphere); polytwinning tabular grain; diameter/thickness ratio: 2.0); (coated silver amount) | 0.40 |
| Gelatin | 0.49 |
| ExS-6 | $2.6 \times 10^{-4}$ |
| ExY-2 | $1.0 \times 10^{-2}$ |
| ExY-3 | 0.20 |
| ExC-1 | $1 \times 10^{-2}$ |
| Solv-1 | $9.0 \times 10^{-2}$ |
| 15th Layer: 1st protective layer | |
| Emulsion of finely divided silver bromoiodide grains (AgI content: 2.0 mol %; uniform AgI type; grain diameter: 0.07 μm (as calculated in terms of sphere)); (coated silver amount) | 0.12 |
| Gelatin | 0.63 |
| UV-4 | 0.11 |
| UV-5 | 0.18 |
| Solv-5 | $2.0 \times 10^{-2}$ |
| Cpd-5 | 0.10 |
| Polyethyl acrylate latex | $9.0 \times 10^{-2}$ |

-continued

| | |
|---|---|
| 16th layer: 2nd protective layer | |
| Emulsion of finely divided silver bromoiodide grains (AgI content: 0.2 mol %; uniform AgI type; grain diameter: 0.07 μm (as calculated in terms of sphere)); (coated silver amount) | 0.36 |
| Gelatin | 0.85 |
| B-1 (diameter: 1.5 μm) | $8.0 \times 10^{-2}$ |
| B-2 (diameter: 1.5 μm) | $8.0 \times 10^{-2}$ |
| B-3 | $2.0 \times 10^{-2}$ |
| W-4 | $2.0 \times 10^{-2}$ |
| H-1 | 0.18 |

In addition to the above mentioned components, 1,2-benzisothiazoline-3-one, n-butyl-p-hydroxybenzoate, and 2-phenoxyethanol were incorporated in the specimen in amounts of 200 ppm on the average, about 1,000 ppm and about 10,000 ppm based on gelatin, respectively. The specimen further comprised B-4, B-5, F-1, F-2, F-3, F-4, F-5, F-6, F-7, F-8, F-9, F-10, F-11, F-12, and iron salts, lead salts, gold salts, platinum salts, iridium salts, and rhodium salts.

In addition to the above mentioned components, surface active agents W-1, W-2, and W-3 were added to each of these layers as coating aid or emulsion dispersant.

The structural formula of the compounds incorporated in these layers will be set forth below:

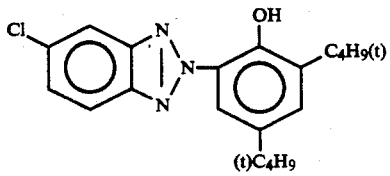

UV-1

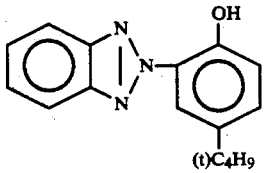

UV-2

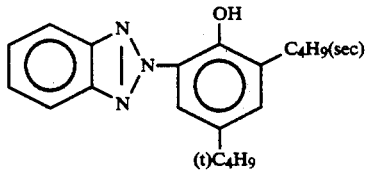

UV-3

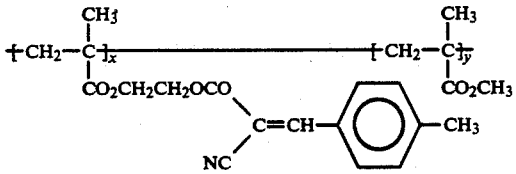

x:y = 70:30 (wt %)

UV-4

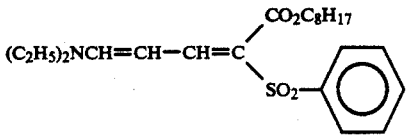

UV-5

Solv-1: Tricresyl phosphate

Solv-2: Dibutyl phthalate

-continued
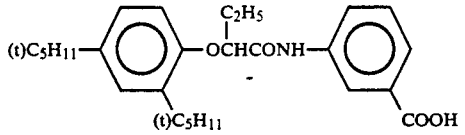
Solv-4
Solv-5: Trihexyl phosphate
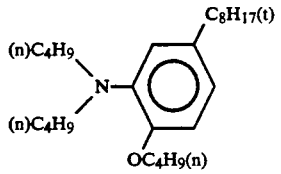
Solv-6
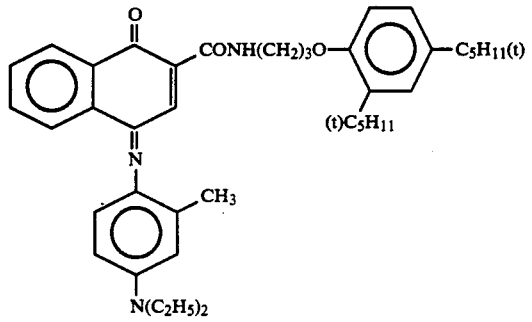
ExF-1
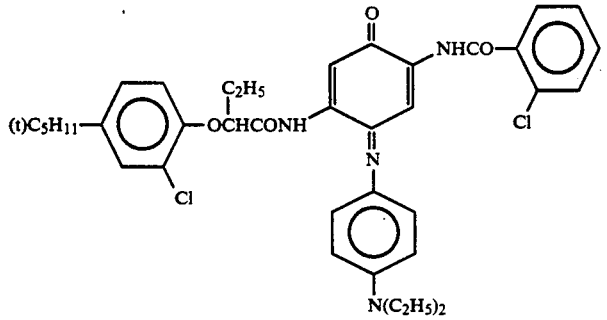
ExF-2
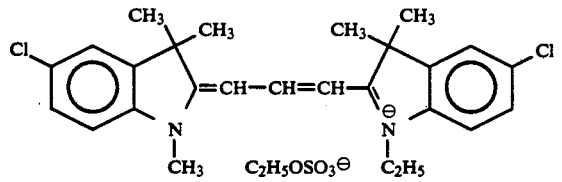
ExF-3
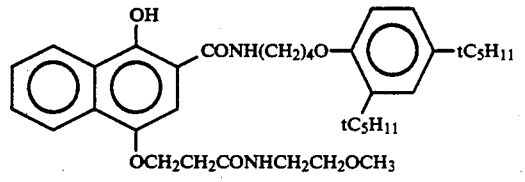
ExC-1

-continued
ExC-2
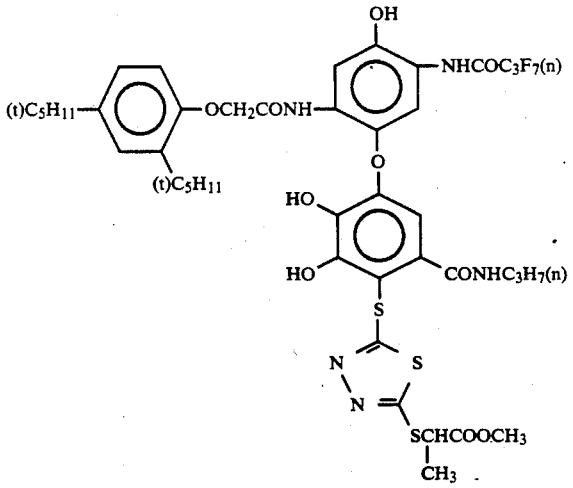
ExC-3
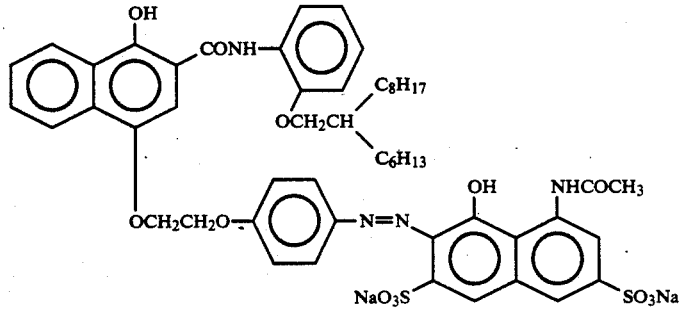
ExC-4
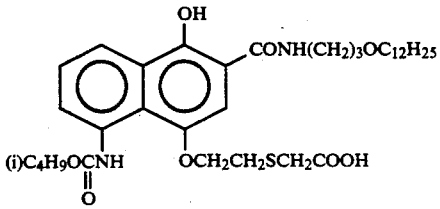
ExC-5
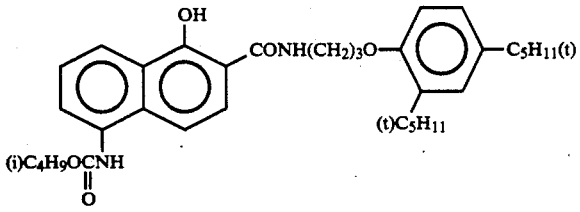
ExC-6
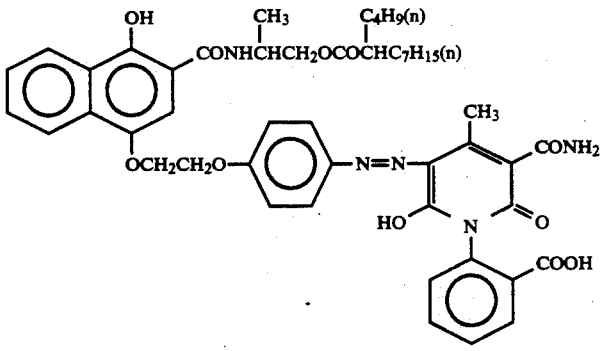

-continued
ExM-1
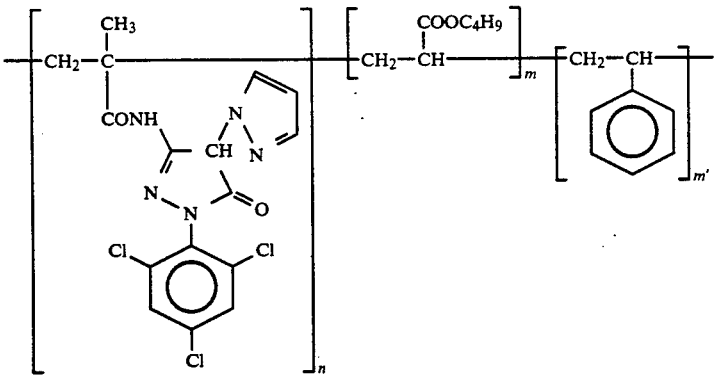
n = 50
m = 25
m' = 25
Molecular weight: approx. 20,000
ExM-2
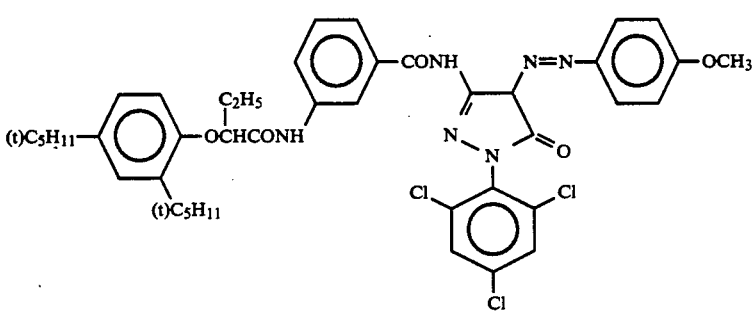
ExM-3
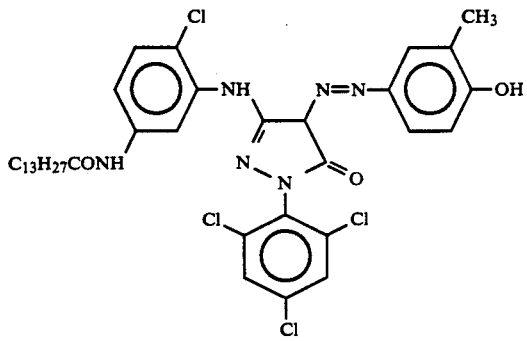
ExM-4
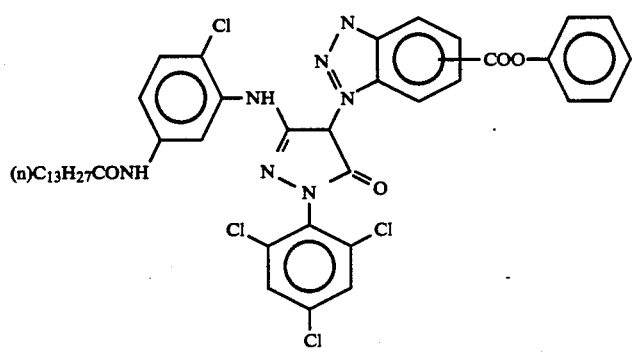

-continued
ExY-1
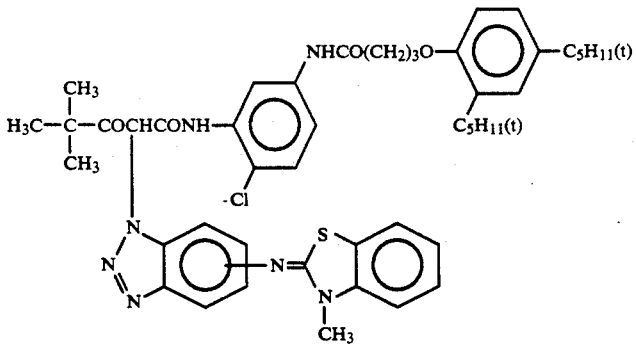
ExY-2
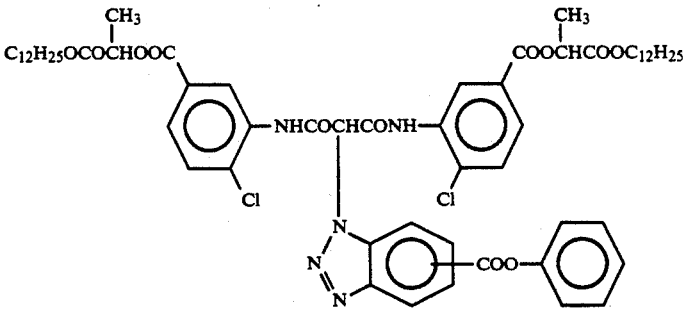
ExY-3
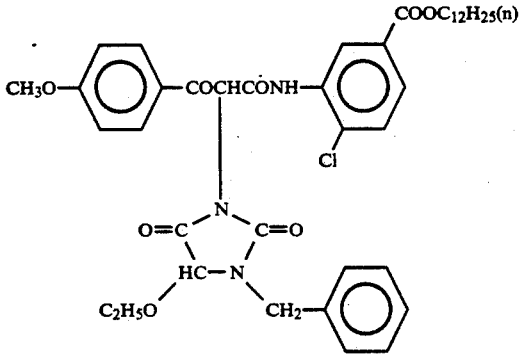
ExY-4
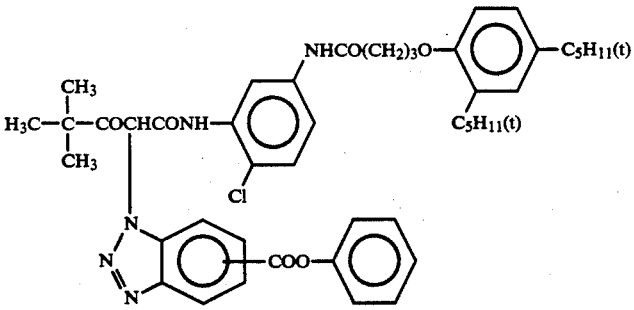
Cpd-1
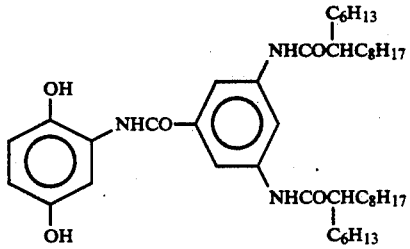

-continued
Cpd-2
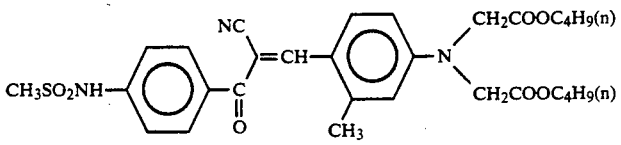
Cpd-5
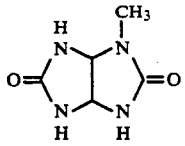
Cpd-6
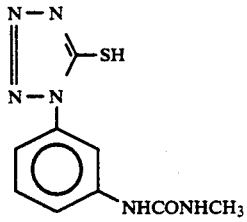
Cpd-8
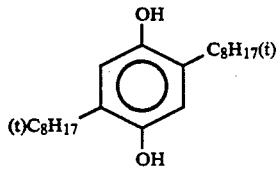
H-1
$CH_2{=}CH{-}SO_2{-}CH_2{-}CONH{-}CH_2$
$CH_2{=}CH{-}SO_2{-}CH_2{-}CONH{-}CH_2$
W-1
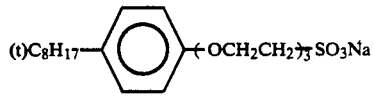
W-2
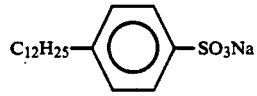
W-3
$(n)C_4H_9CH(C_2H_5)CH_2COOCH_2$
$(n)C_4H_9CH(C_2H_5)CH_2COOCH(SO_3Na)$
W-4
$C_8F_{17}SO_2N(C_3H_7)CH_2COOK$
ExS-1
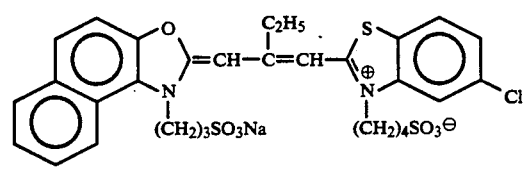
ExS-2
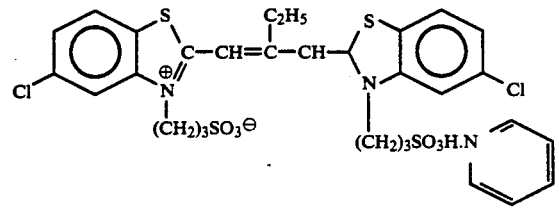

-continued
ExS-3
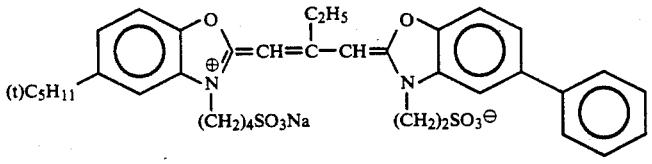
ExS-4
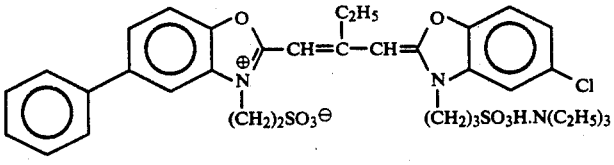
ExS-5
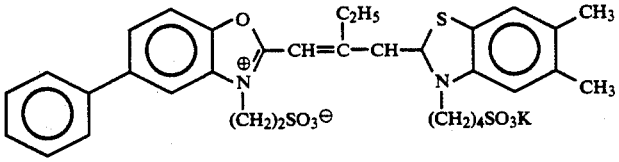
ExS-6
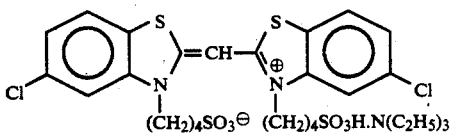
ExS-7
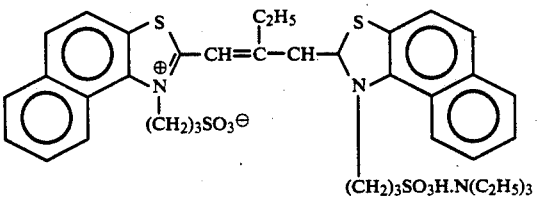
ExS-8
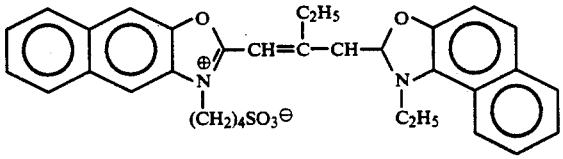
F-1
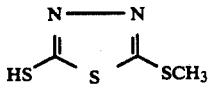
F-2
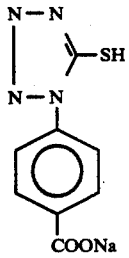

-continued
F-3
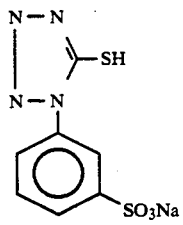
F-4
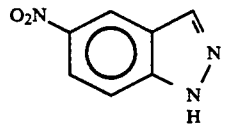
F-5
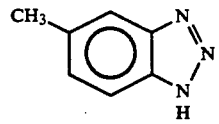
F-6
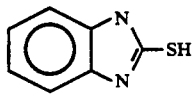
F-7
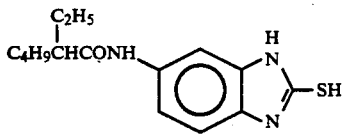
F-8
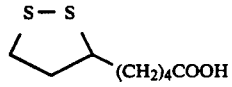
F-9
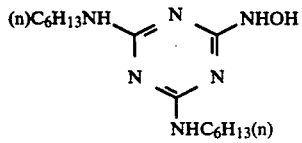
F-10
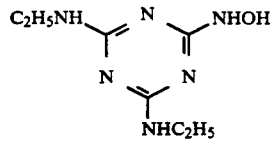
F-11
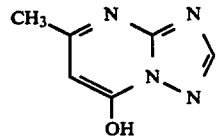
F-12
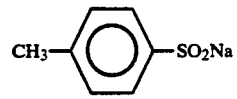
B-1
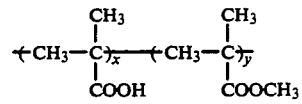
x/y = 10/90 (by molar ratio)

-continued

B-2

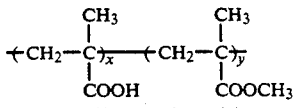

x/y = 40/60 (by molar ratio)

B-3

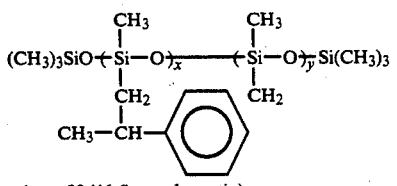

x/y = 29/46 (by molar ratio)

B-4

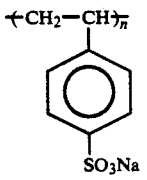

B-5

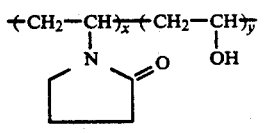

x/y = 70/30 (by molar ratio)

The specimen thus prepared was cut into 35-m wide strips, worked, wedgewise exposed to white light (color temperature of light source: 4,800° K.), and then processed by means of a processing machine for motion picture in the following process. For the evaluation of properties, another batch of the specimen imagewise exposed to light was processed using the developer until the accumulated replenishment of color developer reached three times the capacity of the mother liquid tank.

The composition of the bleaching solution used in the processing step were as set forth in Table 5. For the aeration of the bleaching solution, the bleaching bath was provided at the bottom thereof with a pipe having a large number of 0.2-mmϕ pores through which air was blown at a rate of 200 ml/minute.

| | Processing step | | | |
|---|---|---|---|---|
| Step | Time | Temperature | Replenishment rate* | Tank capacity |
| Color development | 3 min. 15 sec. | 37.8° C. | 23 ml | 10 l |
| Bleach | 25 sec. | 38.0° C. | 5 ml | 5 l |
| Fixing | 1 min. 40 sec. | 38.0° C. | 30 ml | 10 l |
| Washing (1) | 30 sec. | 38.0° C. | — | 5 l |
| Washing (2) | 20 sec. | 38.0° C. | 30 ml | 5 l |
| Stabilization | 20 sec. | 38.0° C. | 20 ml | 5 l |
| Drying | 1 min. | 55° C. | | |

*Determined per 35-mm width and 1-m length

The washing step was effected in a countercurrent process wherein the washing water flows from (2) to (1). The amount of the developer brought over to the bleaching step, and the amount of the fixing solution brought over to the washing step were each 2.0 ml per m of 35-mm wide light-sensitive material.

The time for crossover was 5 seconds in all the steps. This crossover time is included in the processing time at the previous step.

The various processing solutions had the following compositions:

Color Developer

| | Mother solution | Replenisher |
|---|---|---|
| Diethylenetriamine-pentaacetic acid | 1.0 g | 1.1 g |
| 1-Hydroxyethylidene-1,1-diphosphonic acid | 3.0 g | 3.2 g |
| Sodium sulfite | 4.0 g | 4.9 g |
| Potassium carbonate | 30.0 g | 30.0 g |
| Potassium bromide | 1.4 g | — |
| Potassium iodide | 1.5 mg | — |
| Hydroxylamine sulfate | 2.4 g | 3.6 g |
| 4-(N-ethyl-N-β-hydroxyethyl-amino)-2-methylaniline sulfate | 4.5 g | 6.4 g |
| Water to make | 1.0 l | 1.0 l |
| pH | 10.05 | 10.10 |

Bleaching Solution

| | Mother solution | Replenisher |
|---|---|---|
| Iron nitrate | 0.20 mol | 0.30 mol |
| Chelate compound as set forth in Table 8 | 0.31 mol | 0.47 mol |
| Ammonium bromide | 100 g | 150 g |
| Ammonium nitrate | 20 g | 30 g |
| Acetic acid | 0.72 mol | 1.09 mol |
| Water to make | 1.0 l | 1.0 l |
| pH | 4.0 | 3.8 |

The chelating compound used is a compound constituting a ferric chelating compound with a metal salt, which is used as the bleaching agent.

Fixing Solution

| | Mother solution | Replenisher |
|---|---|---|
| Diammonium ethylenediamine-tetraacetate | 1.7 g | Same as left |
| Ammonium sulfite | 14.0 g | " |
| Aqueous solution of ammonium thiosulfate (700 g/l) | 260.0 ml | " |
| Water to make | 1.0 l | " |
| pH | 7.0 | " |

Washing Solution (The Mother Solution Was Used Also As Replenisher)

Tap water was passed through a mixed bed column packed with an H-type strongly acidic cation exchange resin (Amberlite IR-120B available from Rohm & Haas) and an OH-type strongly basic anion exchange resin (Amberlite IRA-400 available from the same company) so that the calcium and magnesium ion concentrations were each reduced to 3 mg/l or less. Dichlorinated sodium isocyanurate and sodium sulfate were then added to the solution in amounts of 20 mg/l and 150 mg/l, respectively.

The washing solution thus obtained had a pH value of 6.5 to 7.5.

Stabilizing Solution (The mother solution was used also as replenisher)

| | |
|---|---|
| Formalin (37%) | 1.2 mg |
| Surface active agent $[C_{10}H_{21}\text{-}(OCH_2CH_2O)_{10}\text{-}H]$ | 0.4 g |
| Ethylene glycol | 1.0 g |
| Water to make | 1.0 l |
| pH | 5.0–7.0 |

The photographic light-sensitive material specimens thus processed were then measured for the remaining amount of silver on the maximum color density portion by means of a fluorescent X-ray analyzer. The results are set forth in Table 8.

These photographic light-sensitive material specimens were also measured for density. Color density values $D_R$ measured by red light on the maximum color density portion were read from the characteristic curve.

Another batch of these specimens were processed in the same manner as mentioned above except that the following reference bleaching solution causing no malrecovery to original color was used in stead of the above mentioned bleaching solution and bleach was effected at a temperature of 38° C. at a replenishment rate of 25 ml/35 mm width and 1 m length for 600 seconds.

Reference Bleaching Solution

| | Mother Solution | Replenisher |
|---|---|---|
| Ferric sodium ethylenediamine-tetraacetate trihydrate | 100.0 g | 120.0 g |
| Disodium ethylenediamine-tetraacetate | 10.0 g | 11.0 g |
| Ammonium bromide | 140 g | 140 g |
| Ammonium nitrate | 30.0 g | 35.0 g |
| 27% Aqueous ammonia | 6.5 ml | 4.0 ml |

-continued

| | Mother Solution | Replenisher |
|---|---|---|
| Water to make | 1.0 l | 1.0 l |
| pH | 6.0 | 5.7 |

The specimens thus processed were measured for density in the same manner as described above. $D_R$ values were read from the characteristic curve.

The difference ($\Delta D_R$) in $D_R$ of the specimens from that obtained by the reference bleaching solution were determined. $D_R$ value of the specimens, obtained by the reference bleaching solution was 2.1.

Malrecovery to original color ($\Delta D_R$) = ($D_R$ obtained by reference bleaching solution) − ($D_R$ of each specimen)

The results are set forth in Table 8.

These specimens were also measured for change in gradation during the storage after processing. For this measurement, these specimens were stored under a wet heat condition (60° C., 70% RH) in a dark place for 4 weeks. The term "gradation ($\gamma_G$)" as used herein means the "difference between the color density ($D_{G1}$) measured by green light on the portion which has been exposed by one tenth of the exposure that gives the maximum color density measured by green light and the color density ($D_{G2}$) measured by green light on the portion which has been exposed by one thousandth of the exposure that gives the maximum color density measured by green light on the characteristic curve.

Gradation $= D_{G1} - D_{G2}$

Change in gradation ($\Delta\gamma_G$) = ($\gamma_G$ after storage) − ($\gamma_G$ before storage)

The results are set forth in Table 8.

TABLE 8

| No. | Compound | Remaining amount of silver [μg/cm²] | Malrecovery to original ($\Delta D_R$) | Increase in gradation ($\Delta\gamma_G$) |
|---|---|---|---|---|
| 801 | Comparative Compound A | 60.5 | 0.10 | 0.15 |
| 802 | Comparative Compound B | 13.8 | 0.27 | 0.30 |
| 803 | Comparative Compound C | 30.0 | 0.41 | 0.15 |
| 804 | Present Compound 51 | 9.8 | 0.10 | 0.06 |
| 805 | Present Compound 53 | 12.1 | 0.11 | 0.04 |
| 806 | Present Compound 73 | 9.5 | 0.08 | 0.03 |
| 807 | Present Compound 85 | 10.8 | 0.05 | 0.04 |

Comparative Compounds A, B and C are the same as those used in Example 5.

The results set forth in Table 8 show that as compared to the comparative compounds the present compounds are capable of reducing the remaining amount of silver while contributing to eliminating malrecovery to original color and gradation change during the storage of dye images after processing.

EXAMPLE 10

Specimen 102 as prepared in Example 9 was processed in the same manner as in Example 9 except that the bleaching time was altered. The specimen thus processed was then measured for malrecovery to original color in the same manner as in Example 9 except that the bleaching solution (mother solution) contained 0.72 mol of acetic acid. The results are set forth in Table 9.

TABLE 9

| Compound | Malrecovery to original color ($\Delta D_R$) Bleaching time (sec.) 20 | 30 | 50 | 100 |
|---|---|---|---|---|
| Comparative Compound B | 0.30 | 0.25 | 0.10 | 0.03 |
| Present Compound 73 | 0.10 | 0.06 | 0.04 | 0.01 |

(Note: Comparative Compound B is the same as that used in Example 9)

The results set forth in Table 9 show that the compound of the present invention exhibits an excellent effect of eliminating malrecovery to original color upon rapid bleach.

EXAMPLE 11

A multilayer color light-sensitive material was prepared as Specimen 103 by coating on a undercoated cellulose triacetate film support various layers having the following compositions.

Composition of Photographic Layer

The coated amount of silver halide and colloidal silver is represented in g/m$^2$ as calculated in terms of amount of silver. The coated amount of coupler, additive and gelatin is represented in g/m$^2$. The coated amount of sensitizing dye is represented in mol per mol of silver halide contained in the same layer.

| | |
|---|---|
| 1st Layer: anti-halation layer | |
| Black colloidal silver: (coated silver amount) | 0.20 |
| Gelatin | 2.20 |
| UV-1 | 0.11 |
| UV-2 | 0.20 |
| Cpd-1 | $4.0 \times 10^{-2}$ |
| Cpd-2 | $1.9 \times 10^{-2}$ |
| Solv-1 | 0.30 |
| Solv-2 | $1.2 \times 10^{-2}$ |
| 2nd Layer: interlayer | |
| Finely divided silver bromide grains (AgI content: 1.0 mol %; diameter: 0.07 μm as calculated in terms of sphere):(coated silver amount) | 0.15 |
| Gelatin | 1.00 |
| ExC-4 | $6.0 \times 10^{-2}$ |
| Cpd-3 | $2.0 \times 10^{-2}$ |
| 3rd Layer: 1st red-sensitive emulsion layer | |
| Silver bromoiodide emulsion (AgI content: 5.0 mol %; high surface AgI type; diameter: 0.9 μm (as calculated in terms of sphere); coefficient of fluctuation in grain diameter: 21% (as calculated in terms of sphere); tabular grains; diameter/thickness ratio: 7.5):(coated silver amount) | 0.42 |
| Silver bromoiodide emulsion (AgI content: 4.0 mol %; high internal AgI type; diameter: 0.4 μm (as calculated in terms of sphere); coefficient of fluctuation in grain diameter: 18% (as calculated in terms of sphere); tetradecahedral grains): (coated silver amount) | 0.40 |
| Gelatin | 1.90 |
| ExS-1 | $4.5 \times 10^{-4}$ mol |
| ExS-2 | $1.5 \times 10^{-4}$ mol |
| ExS-3 | $4.0 \times 10^{-5}$ mol |
| ExC-1 | 0.65 |
| ExC-3 | $1.0 \times 10^{-2}$ |
| ExC-4 | $2.3 \times 10^{-2}$ |
| Solv-1 | 0.32 |
| 4th Layer: 2nd red-sensitive emulsion layer | |
| Silver bromoiodide emulsion (AgI content: 8.5 mol %; high internal AgI type; diameter: 1.0 μm (as calculated in terms of sphere); coefficient of fluctuation in grain diameter: 25% (as calculated in terms of sphere); tabular grains; diameter/thickness ratio: 3.0):(coated silver amount) | 0.85 |
| Gelatin | 0.91 |
| ExS-1 | $3.0 \times 10^{-4}$ mol |
| ExS-2 | $1.0 \times 10^{-4}$ mol |
| ExS-3 | $3.0 \times 10^{-5}$ mol |
| ExC-1 | 0.13 |
| ExC-2 | $6.2 \times 10^{-2}$ |
| ExC-4 | $4.0 \times 10^{-2}$ |
| ExC-6 | $3.0 \times 10^{-2}$ |
| Solv-1 | 0.10 |
| 5th Layer: 3rd red-sensitive emulsion layer | |
| Silver bromoiodide emulsion (AgI content: 11.3 mol %; high internal AgI type; diameter: 1.4 μm (as calculated in terms of sphere); coefficient of fluctuation in grain diameter: 28% (as calculated in terms of sphere); tabular grains; diameter/thickness ratio: 6.0):(coated silver amount) | 1.50 |
| Gelatin | 1.20 |
| ExS-1 | $2.0 \times 10^{-4}$ mol |
| ExS-2 | $6.0 \times 10^{-5}$ mol |
| ExS-3 | $2.0 \times 10^{-5}$ mol |
| ExC-2 | $8.5 \times 10^{-2}$ |
| ExC-5 | $7.3 \times 10^{-2}$ |
| ExC-6 | $1.0 \times 10^{-2}$ |
| Solv-1 | 0.12 |
| Solv-2 | 0.12 |
| 6th Layer: interlayer | |
| Gelatin | 1.00 |
| Cpd-4 | $8.0 \times 10^{-2}$ |
| Solv-1 | $8.0 \times 10^{-2}$ |
| 7th Layer: 1st green-sensitive emulsion layer | |
| Silver bromoiodide emulsion (AgI content: 5.0 mol %; high surface AgI type; diameter: 0.9 μm (as calculated in terms of sphere); coefficient of fluctuation in grain diameter: 21% (as calculated in terms of sphere); tabular grains; diameter/thickness ratio: 7.0):(coated silver amount) | 0.28 |
| Silver bromoiodide emulsion (AgI content: 4.0 mol %; high internal AgI type; diameter: 0.4 μm (as calculated in terms of sphere); coefficient of fluctuation in grain diameter: 18% (as calculated in terms of sphere); tetradecahedral grains): (coated silver amount) | 0.16 |
| Gelatin | 1.20 |
| ExS-4 | $5.0 \times 10^{-4}$ mol |
| ExS-5 | $2.0 \times 10^{-4}$ mol |
| ExS-6 | $1.0 \times 10^{-4}$ mol |

-continued

| | |
|---|---|
| ExM-1 | 0.50 |
| ExM-2 | 0.10 |
| ExM-5 | $3.5 \times 10^{-2}$ |
| Solv-1 | 0.20 |
| Solv-3 | $3.0 \times 10^{-2}$ |
| 8th Layer: 2nd green-sensitive emulsion layer | |
| Silver bromoiodide emulsion (AgI content: 8.5 mol %; high internal AgI type; diameter: 1.0 μm (as calculated in terms of sphere); coefficient of fluctuation in grain diameter: 25% (as calculated in terms of sphere); tabular grains; diameter/thickness ratio: 3.0):(coated silver amount) | 0.57 |
| Gelatin | 0.45 |
| ExS-4 | $3.5 \times 10^{-4}$ mol |
| ExS-5 | $1.4 \times 10^{-4}$ mol |
| ExS-6 | $7.0 \times 10^{-5}$ mol |
| ExM-1 | 0.12 |
| ExM-2 | $7.1 \times 10^{-3}$ |
| ExM-3 | $3.5 \times 10^{-2}$ |
| Solv-1 | 0.15 |
| Solv-3 | $1.0 \times 10^{-2}$ |
| 9th Layer: interlayer | |
| Gelatin | 0.50 |
| Solv-1 | $2.0 \times 10^{-2}$ |
| 10th Layer: 3rd green-sensitive emulsion layer | |
| Silver bromoiodide emulsion (AgI content: 11.3 mol %; high internal AgI type; diameter: 1.4 μm (as calculated in terms of sphere); coefficient of fluctuation in grain diameter: 28% (as calculated in terms of sphere); tabular grains; diameter/thickness ratio: 6.0):(coated silver amount) | 1.30 |
| Gelatin | 1.20 |
| ExS-4 | $2.0 \times 10^{-4}$ mol |
| ExS-5 | $8.0 \times 10^{-5}$ mol |
| ExS-6 | $8.0 \times 10^{-5}$ mol |
| ExM-4 | $5.8 \times 10^{-2}$ |
| ExM-6 | $5.0 \times 10^{-3}$ |
| ExC-2 | $4.5 \times 10^{-3}$ |
| Cpd-5 | $1.0 \times 10^{-2}$ |
| Solv-3 | 0.25 |
| 11th Layer: yellow filter layer | |
| Gelatin | 0.50 |
| Cpd-6 | $5.2 \times 10^{-2}$ |
| Solv-1 | 0.12 |
| 12th Layer: interlayer | |
| Gelatin | 0.45 |
| Cpd-3 | 0.10 |
| 13th Layer: 1st blue-sensitive layer | |
| Silver bromoiodide emulsion (AgI content: 2 mol %; uniform AgI type; diameter: 0.55 μm (as calculated in terms of sphere); coefficient of fluctuation in grain diameter: 25% (as calculated in terms of sphere); tabular grains; diameter/thickness ratio: 7.0):(coated silver amount) | 0.20 |
| Gelatin | 1.00 |
| ExS-7 | $3.0 \times 10^{-4}$ mol |

-continued

| | |
|---|---|
| ExY-1 | 0.60 |
| ExY-2 | $2.3 \times 10^{-2}$ |
| Solv-1 | 0.15 |
| 14th Layer: 2nd blue-sensitive emulsion layer | |
| Silver bromoiodide emulsion (AgI content: 19.0 mol %; high internal AgI type; diameter: 1.0 μm (as calculated in terms of sphere); coefficient of fluctuation in grain diameter: 16% (as calculated in terms of sphere); octahedral grains):(coated silver amount) | 0.19 |
| Gelatin | 0.35 |
| ExS-7 | $2.0 \times 10^{-4}$ mol |
| ExY-1 | 0.22 |
| Solv-1 | $7.0 \times 10^{-2}$ |
| 15th Layer: interlayer | |
| Finely divided silver bromoiodide (AgI content: 2 mol %; uniform AgI type; grain diameter: 0.13 μm as calculated in terms of sphere):(coated silver amount) | 0.20 |
| Gelatin | 0.36 |
| 16th Layer: 3rd blue-sensitive emulsion layer | |
| Silver bromoiodide emulsion (AgI content: 14.0 mol %; high internal AgI type; grain diameter: 1.7 μm as calculated in terms of sphere; coefficient of fluctuation in grain diameter: 28% as calculated in terms of sphere); tabular grains; diameter/thickness ratio: 5.0):(coated silver amount) | 1.55 |
| Gelatin | 1.00 |
| ExS-8 | $1.5 \times 10^{-4}$ |
| ExY-1 | 0.21 |
| Solv-1 | $7.0 \times 10^{-2}$ |
| 17th Layer: 1st protective layer | |
| Gelatin | 1.80 |
| UV-1 | 0.13 |
| UV-2 | 0.21 |
| Solv-1 | $1.0 \times 10^{-2}$ |
| Solv-2 | $1.0 \times 10^{-2}$ |
| 18th Layer: 2nd protective layer | |
| Finely divided silver chloride grains (grain diameter: 0.07 μm as calculated in terms of sphere): (coated silver amount) | 0.36 |
| Gelatin | 0.70 |
| B-1 (diameter: 1.5 μm) | $2.0 \times 10^{-2}$ |
| B-2 (diameter: 1.5 μm) | 0.15 |
| B-3 | $3.0 \times 10^{-2}$ |
| W-1 | $2.0 \times 10^{-2}$ |
| H-1 | 0.35 |
| Cpd-7 | 1.00 |

In addition to the above mentioned components, 1,2-benzisothiazoline-3-one, n-butyl-p-hydroxybenzoate, and 2-phenoxyethanol were incorporated in the specimen in amounts of 200 ppm on the average, about 1,000 ppm and about 10,000 ppm based on gelatin, respectively. The specimen further comprised B-4, B-5, W-2, W-3, F-1, F-2, F-3, F-4, F-5, F-6, F-7, F-8, F-9, F-10, F-11, F-12, F-13, and iron salts, lead salts, gold salts, platinum salts, iridium salts, and rhodium salts.

UV-1

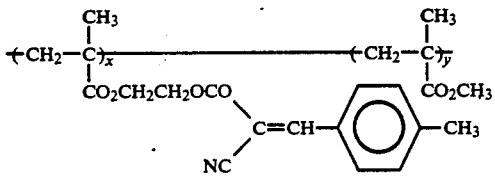

x/y = 7/3 (by weight)

-continued
UV-2
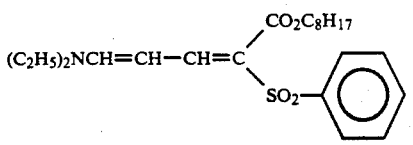
ExC-1
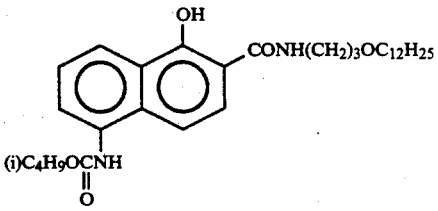
ExC-2
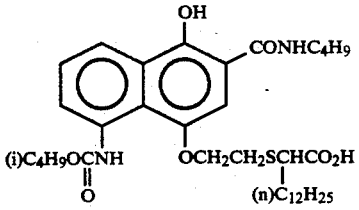
ExC-3
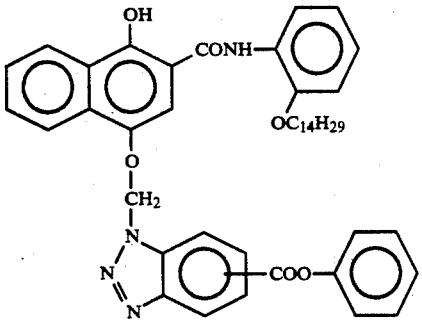
ExC-4
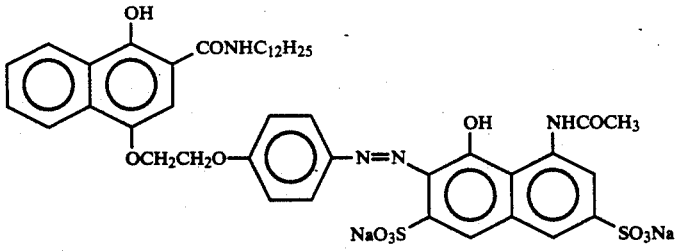
ExC-5
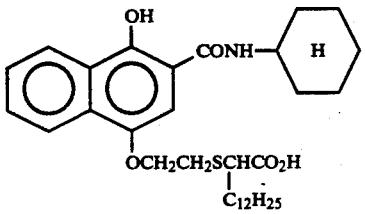

-continued
ExC-6
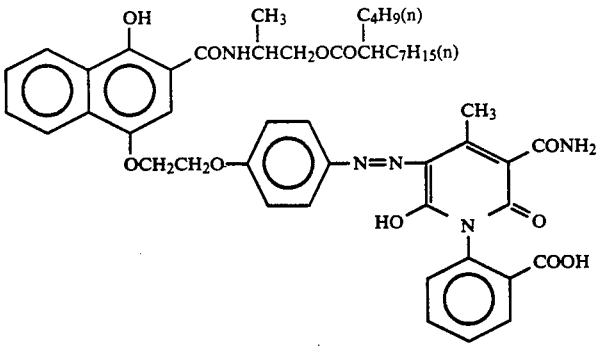
ExM-1
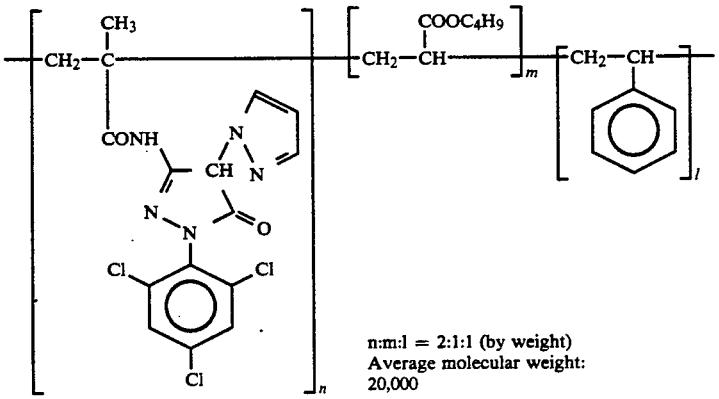
n:m:l = 2:1:1 (by weight)
Average molecular weight: 20,000
ExM-2
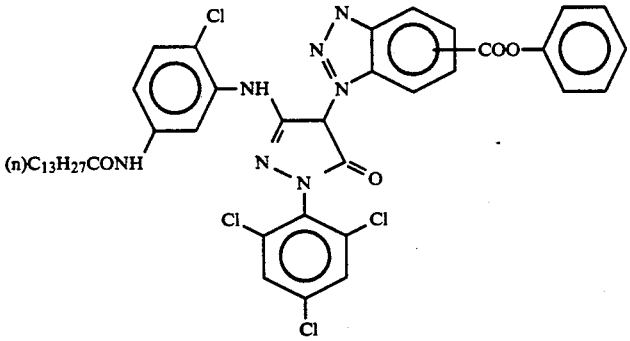
ExM-3
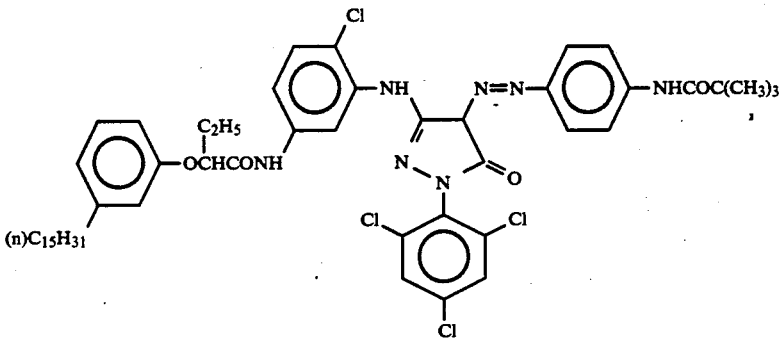

-continued
ExM-4
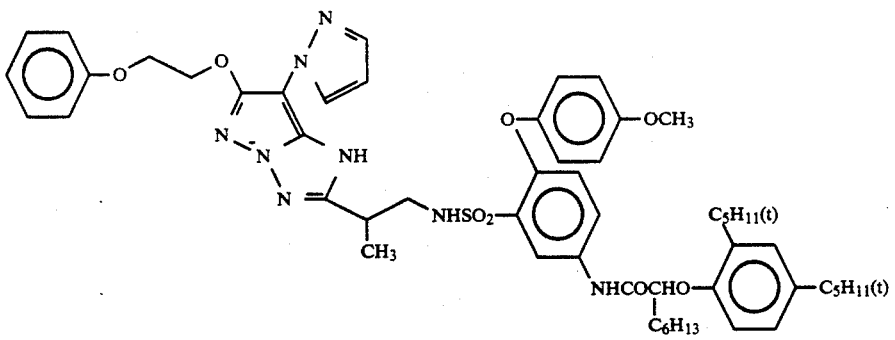
ExM-5
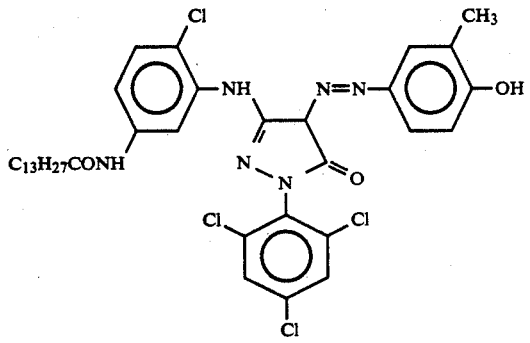
ExM-6
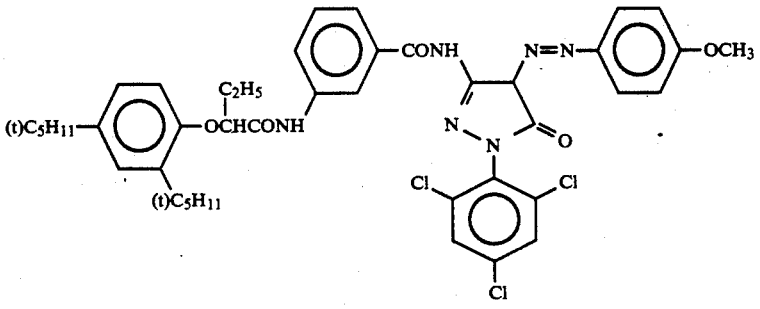
ExY-1
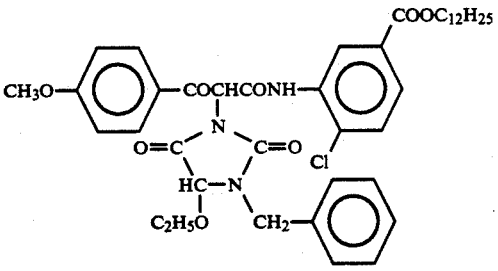
ExY-2
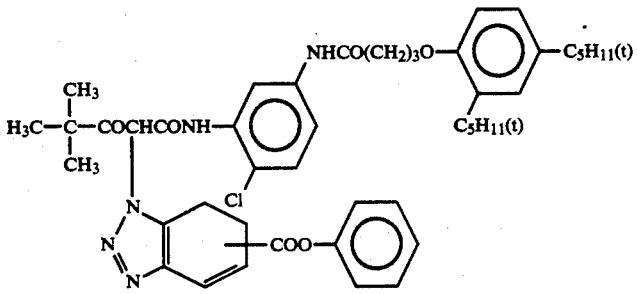

-continued
Cpd-1
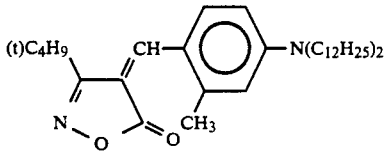
Cpd-2
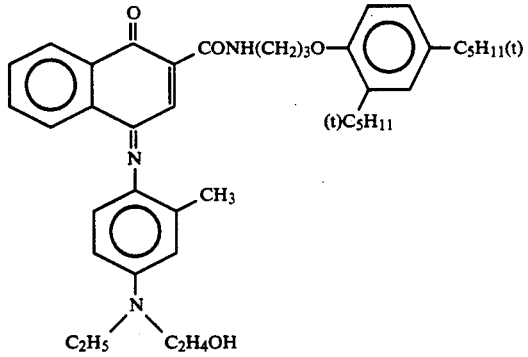
Cpd-3
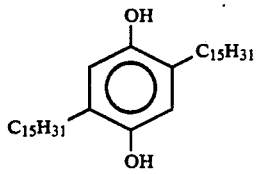
Cpd-4
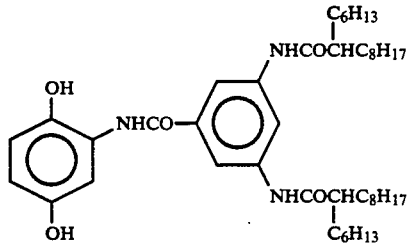
Cpd-5
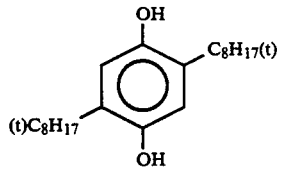
Cpd-6
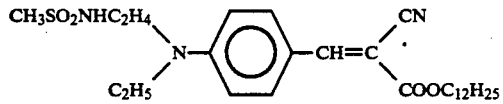
Cpd-7
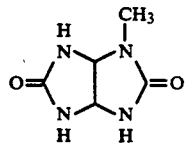
Solv-1
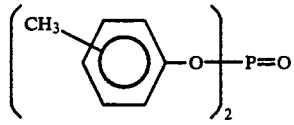

-continued
Solv-2
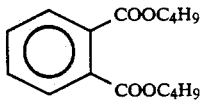
Solv-3
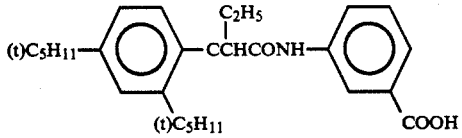
ExS-1
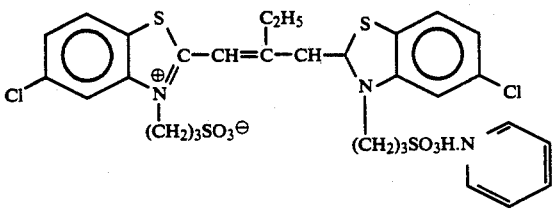
ExS-2
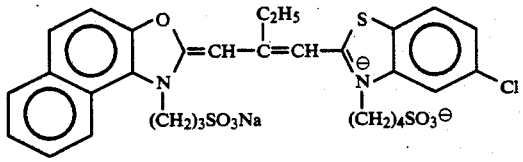
ExS-3
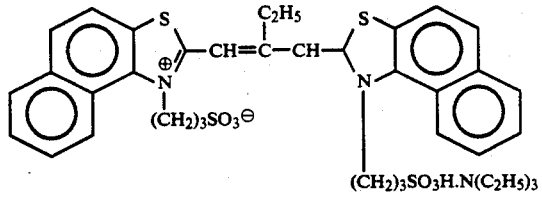
ExS-4
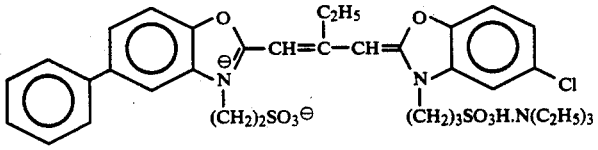
ExS-5
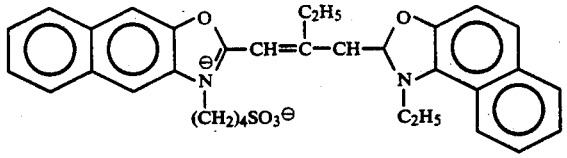
ExS-6
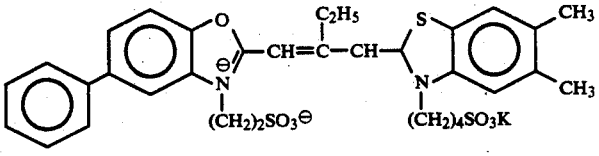
ExS-7
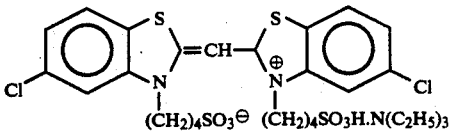

-continued
ExS-8
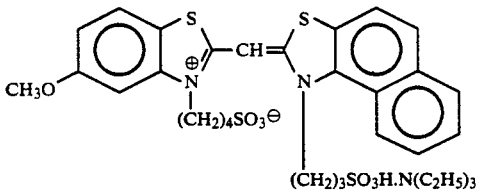
B-1
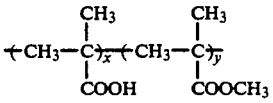
x/y = 10/90 (by molar ratio)
B-2
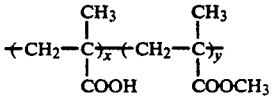
x/y = 40/60 (by molar ratio)
B-3
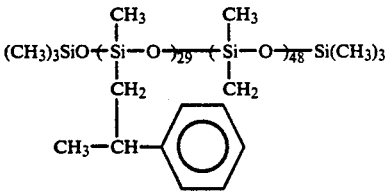
B-4
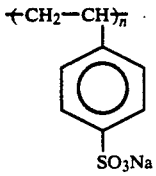
B-5
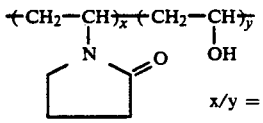
x/y = 70/30 (by molar ratio)
$C_8P_{17}SO_2NHCH_2CH_2CH_2OCH_2CH_2\overset{\ominus}{N}(CH_3)_3$
W-1
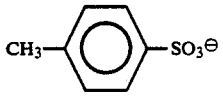
W-2
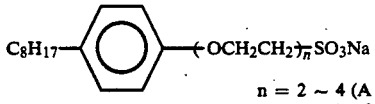
n = 2 ~ 4 (A mixture of compounds of n = 2 to 4)
W-3
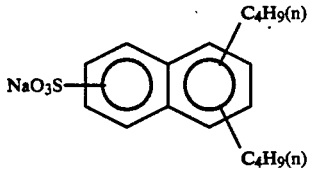
H-1
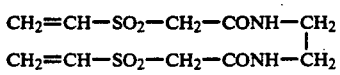
F-1
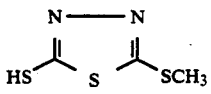

-continued
F-2
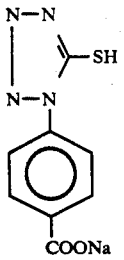
F-3
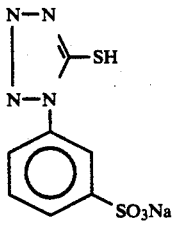
F-4
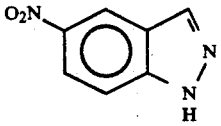
F-5
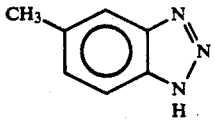
F-6
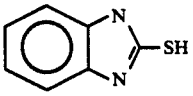
F-7
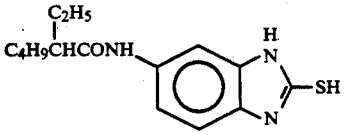
F-8
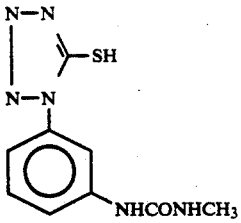
F-9
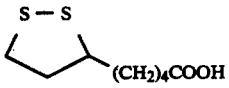
F-10
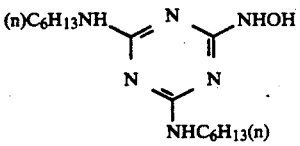

-continued

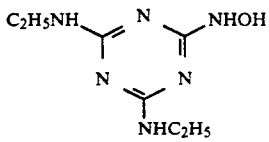

F-11

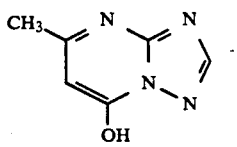

F-12

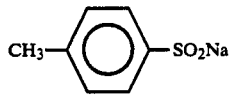

F-13

The specimen thus prepared was worked, exposed, and then processed in the same manner as in Example 9 except that the composition of the bleaching solution was altered and the bleaching time was 40 seconds.

The composition of the bleaching solution used in the processing step were as follows:

Bleaching Solution

| | Mother Solution | Replenisher |
|---|---|---|
| Ferric nitrate | 0.20 mol | 0.30 mol |
| Chelate compound 73 | 0.31 mol | 0.47 mol |
| Ammonium bromide | 100 g | 150 g |
| Ammonium nitrate | 20 g | 30 g |
| Organic acid (as set forth in Table 10) | 0.10 mol/ 0.30 mol | 0.14 mol/ 0.42 mol |
| Water to make | 1.0 l | 1.0 l |
| pH | 4.2 | 4.6 |

These photographic light-sensitive material specimens thus processed were then measured for gradation change ($\Delta\gamma_G$) in the same manner as in Example 9. The results are set forth in Table 10.

TABLE 10

| Remarks | Organic acid Compound | Concentration (mol/l) | Gradation change ($\Delta\gamma_G$) |
|---|---|---|---|
| Present Invention | Acetic acid | 0.1 | 0.04 |
| | | 0.3 | 0.03 |
| | Glycolic acid | 0.1 | 0.03 |
| | | 0.3 | 0.02 |
| | Lactic acid | 0.1 | 0.06 |
| | | 0.3 | 0.05 |
| | n-Butyric acid | 0.1 | 0.07 |
| | | 0.3 | 0.05 |
| | Malonic acid | 0.1 | 0.08 |
| | | 0.3 | 0.07 |
| | Malic acid | 0.1 | 0.08 |
| | | 0.3 | 0.06 |
| | Citric acid | 0.1 | 0.08 |
| | | 0.3 | 0.07 |
| | Aspartic acid | 0.1 | 0.10 |
| | | 0.3 | 0.09 |
| | Phthalic acid | 0.1 | 0.10 |
| | | 0.3 | 0.10 |

The results set forth in Table 10 show that the use of the compounds of the present invention provides an excellent effect of eliminating the gradation change upon storage of dye images after processing.

EXAMPLE 12

Specimen 101 as prepared in the examples in JP-A-2-44345 was worked, exposed to light, and then processed in the same manner as in Example 9 except that the bleaching time was 30 seconds and the replenishment rate of the bleaching solution was altered to alter the ratio (C/R) of the amount of the developer to be brought over to the bleach step (C) to the replenishment rate of the bleaching solution (R) as set forth in Table 11. The composition of the processing solutions other than the bleaching solution were the same as that in Example 9.

The composition of the bleaching solution used in Example 12 was as follows:

Bleaching Solution

| | Running Solution | Replenisher |
|---|---|---|
| Ferric nitrate | 0.20 mol | 0.30 mol |
| Chelate compound as set forth in Table 7 | 0.31 mol | 0.47 mol |
| Ammonium bromide | 100 g | 150 g |
| Ammonium nitrate | 20 g | 30 g |
| Glycolic acid | 0.5 mol | 0.75 mol |
| Water to make | 1.0 l | 1.0 l |
| pH | 3.5 | 3.6 |

These photographic light-sensitive material specimens thus processed were then measured for the remaining amount of silver in the same manner as in Example 5. The results are set forth in Table 11.

TABLE 11

| Compound | Remaining amount of silver ($\mu g/cm^2$) C/R 0.1 | 0.2 | 0.4 | 0.6 |
|---|---|---|---|---|
| Comparative Compound A | 46.0 | 46.8 | 49.8 | 53.5 |
| Comparative Compound B | 9.7 | 9.9 | 11.3 | 14.2 |
| Comparative Compound C | 25.8 | 26.1 | 27.4 | 31.7 |
| Present Compound 51 | 8.2 | 8.3 | 8.3 | 8.5 |
| Present Compound 53 | 9.1 | 9.2 | 9.1 | 9.8 |
| Present Compound 73 | 7.5 | 7.5 | 7.6 | 8.0 |
| Present Compound 85 | 8.3 | 8.5 | 8.4 | 8.5 |
| Present | 8.9 | 9.4 | 9.8 | 10.0 |

TABLE 11-continued

| Compound | Remaining amount of silver ($\mu g/cm^2$) C/R | | | |
|---|---|---|---|---|
| | 0.1 | 0.2 | 0.4 | 0.6 |
| Compound 50 | | | | |

The results set forth in Table 7 show that as compared to the comparative compounds the use of the compounds of the present invention can also provide excellent desilvering properties in a processing step wherein the replenishment rate of the bleaching solution is reduced.

As mentioned above, the use of a composition having a bleaching capacity containing a metal chelate compound of the present invention enables a rapid processing with no bleach fogging, little subsequent stain and excellent desilvering properties.

Further, the use of a composition containing an organic acid enables a rapid processing with little malrecovery to original color, little subsequent gradation change and excellent desilvering properties.

While the invention has been described in detail and with reference to specific embodiments thereof, it will be apparent to one skilled in the art that various changes and modifications can be made therein without departing from the spirit and scope thereof.

What is claimed is:

1. A process for the processing of an imagewise exposed silver halide color photographic material, which comprises developing in a color developing solution, and then processing with a processing composition comprising at least one metal chelate compound formed of a salt of a metal selected from the group consisting of Fe(III), Mn(III), Co(III), Rh(II), Rh(III), Au(III), Au(II) and Ce(IV) and a compound represented by the general formula (I):

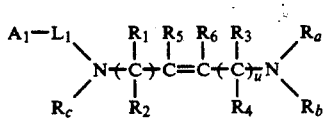

(I)

wherein $R_1$, $R_2$, $R_3$, $R_4$, $R_a$, $R_b$, and $R_c$ each represents a hydrogen atom, an aliphatic group or an aromatic group; $R_5$ and $R_6$ each represents a hydrogen atom, an aliphatic group, an aromatic group, a halogen atom, a cyano group, a nitro group, an acyl group, a sulfamoyl group, a carbamoyl group, an alkoxycarbonyl group, an aryloxycarbonyl group, a sulfonyl group or a sulfinyl group, or $R_5$ and $R_6$ together may form a 5- or 6-membered ring; $L_1$ represents a divalent aliphatic or aromatic group or a divalent linking group containing at least one of a divalent aliphatic group and a divalent aromatic group; $A_1$ represents a carboxyl group, a phosphono group, a sulfo group, a hydroxyl group, or a substituted group thereof (acidic group only) with an alkali metal atom; and t and u each represents an integer 0 or 1; provided that when $R_5$ and $R_6$ together form a 5- or 6-membered ring, $R_1$, $R_2$, $R_3$ and $R_4$ each does not represent an aromatic ring, and when $R_5$ and $R_6$ together form a benzene ring, at least one of t and u represents 1.

2. A process for the processing of a silver halide color photographic material as in claim 1, wherein at least one of t and u is 1 in the general formula (I).

3. A process for the processing of a silver halide color photographic material as in claim 1, wherein t and u each represents 1 in the general formula (I).

4. A process for the processing of a silver halide color photographic material as in claim 1, wherein said compound represented by formula (I) is a compound represented by the general formula (II):

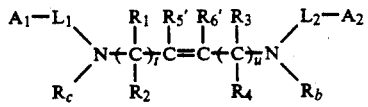

(II)

wherein $R_1$, $R_2$, $R_3$, $R_4$, $R_b$, $R_c$, $A_1$, $L_1$, t and u are as defined in the general formula (I); $L_2$ has the same meaning as $L_1$ in the general formula (I); $A_2$ has the same meaaning as $A_1$ in the general formula (I), and $R_5'$ and $R_6'$ has the same meaning as $R_5$ and $R_6$ with the proviso that $R_5'$ and $R_6'$ are not connected to each other to form a ring.

5. A process for the processing of a silver halide color photographic material as in claim 4, wherein said compound represented by formula (III) is a compound represented by the general formula (III):

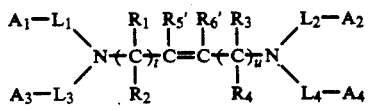

(III)

wherein $R_1$, $R_2$, $R_3$, $R_4$, $R_5'$, $R_6'$, $A_1$, $A_2$, $L_1$, $L_2$, t and u are as defined in the general formula (II); $L_3$ and $L_4$ each has the same meaning as $L_1$ in the general formula (I); and $A_3$ and $A_4$ each has the same meaaning as $A_1$ in the general formula (I).

6. A process for the processing of a silver halide color photographic material as in claim 1, wherein said compound represented by formula (I) is a compound represented by the general formula (IV):

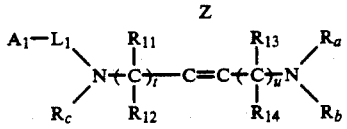

(IV)

wherein Z represents a nonmetallic atom group which forms a 5- or 6-membered ring; $A_1$, $L_1$, $R_a$, $R_b$, $R_c$, t and u each has the same meaning as those of general formula (I); $R_{11}$, $R_{12}$, $R_{13}$, and $R_{14}$ each represents a hydrogen atom, or an aliphatic group, provided that when the ring formed by Z is a benzene ring, at least one of t and u is 1.

7. A process for the processing of a silver halide color photographic material as in claim 6, wherein $R_{11}$, $R_{12}$, $R_{13}$ and $R_{14}$ each represents a hydrogen atom or an alkyl group, $R_a$, $R_b$ and $R_c$ each represents a hydrogen atom, an alkyl group or an aryl group, and $L_1$ represents an alkylene group, an arylene group or a divalent linking group containing at least one of an alkylene group and an arylene group.

8. A process for the processing of a silver halide color photographic material as in claim 6, wherein said 5- or 6-membered ring formed by Z is an aromatic ring, a heterocyclic ring or an cyclic alkene ring.

9. A process for the processing of a silver halide color photographic material as in claim 6, wherein said 5- or 6-membered ring formed by Z is a benzene ring, a naphthalene ring, a pyridine ring, a pyrazine ring, a pyrimidine ring, a pyridazine ring, a quinoline ring, and quinoxaline ring.

10. A process for the processing of a silver halide color photographic material as in claim 6, wherein said 5- or 6-membered ring formed by Z is a benzene ring.

11. A process for the processing of a silver halide color photographic material as in claim 1, wherein $L_1$ is a group represented by the general formula ($L_1$):

$$-L_a\text{-}(A)_n\text{-}(L_b)_m\text{-}^* \qquad (L_1)$$

wherein $L_a$ and $L_b$ each represents an alkylene group, an aralkylene group or an arylene group; and A represents —O—, —S—, $$-\underset{\underset{O}{\|}}{C}-,\ -\underset{\underset{R_{01}}{|}}{N}-$$

(in which $R_{01}$ represents a hydrogen atom, an aliphatic group, an aromatic group or hydroxyl group), $-SO_2-$ or a group formed of a combination thereof; m and n each represents an integer of 0 or 1; and the symbol * indicates the position at which $L_1$ is connected to $A_1$.

12. A process for the processing of a silver halide color photographic material as in claim 11, wherein m and n are 0.

13. A process for the processing of a silver halide color photographic material as in claim 11, wherein $L_1$ is a methylene group or an ethylene group.

14. A process for the processing of a silver halide color photographic material as in claim 6, wherein the compound represented by the general formula (IV) is a compound represented by the general formula (V):

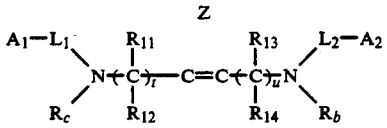

(V)

wherein Z, $A_1$, $L_1$, $R_{11}$, $R_{12}$, $R_{13}$, $R_{14}$, $R_b$, $R_c$, t, and u are as defined in the general formula (IV); $L_2$ has the same meaning as $L_1$ in the general formula (IV); and $A_2$ has the same meaning as $A_1$ in the general formula (IV).

15. A process for the processing of a silver halide color photographic material as in claim 14, wherein the compound represented by the general formula (V) is a compound represented by the general formula (VI):

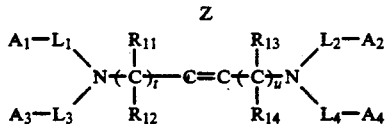

(VI)

wherein Z, $A_1$, $L_1$, $R_{11}$, $R_{12}$, $R_{13}$, $R_{14}$, t, and u are as defined in the general formula (IV); $L_2$, $L_3$ and $L_4$ each has the same meaning as $L_1$ in the general formula (IV); and $A_2$, $A_3$ and $A_4$ has the same meaning as $A_1$ in the general formula (IV).

16. A process for the processing of a silver halide color photographic material as in claim 1, wherein the amount of said metal chelate compound is 0.05 to 1 mol/l of the processing composition.

17. A process for the processing of a silver halide color photographic material as in claim 1, said processing composition further comprising an organic acid.

18. A process for the processing of a silver halide color photographic material as in claimd 1, wherein said silver halide color photographic material comprises a silver halide emulsion containing silver iodide in an amount of 0.1 to 30 mol % and the processing is effected with said processing composition from 10 to 40 seconds.

19. A process for the processing of a silver halide color photographic material as in claim 1, wherein said silver halide color photographic material comprises a silver halide emulsion containing silver chloride or silver bromochloride and the processing is effected with said processing composition from 5 to 30 seconds.

20. A method for processing a silver halide color photographic material comprising an imagewise exposed silver halide color photographic material comprising a support having thereon at least one silver halide emulsion layer with a color developing solution and thereafter processing said material with a processing solution having a bleaching capacity which contains at least a bleaching agent, wherein the bleaching agent is a metal chelate compound formed of a salt of a metal selected from the group consisting of Fe(III), Mn(III), Co(III), Rh(II), Rh(III), Au(III), Au(II) and Ce(IV) and a compound represented by the general formula (I):

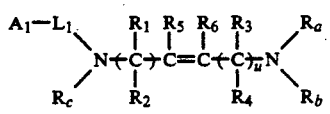

(I)

wherein $R_1$, $R_2$, $R_3$, $R_4$, $R_a$, $R_b$, and $R_c$ each represents a hydrogen atom, an aliphatic group or an aromatic group; $R_5$ and $R_6$ each represents a hydrogen atom, an aliphatic group, an aromatic group, a halogen atom, a cyano group, a nitro group, an acyl group, a sulfamoyl group, a carbamoyl group, an alkoxycarbonyl group, an aryloxycarbonyl group, a sulfonyl group or a sulfinyl group, or $R_5$ and $R_6$ together may form a 5- or 6-membered ring; $L_1$ represents a divalent aliphatic or aromatic group or a divalent linking group containing at least one of a divalent aliphatic group and a divalent aromatic group; $A_1$ represents a carboxyl group, a phosphono group, a sulfo group, a hydroxyl group, or a substituted group thereof (acidic group only) with an alkali metal atom; and t and u each represents an integer 0 or 1; provided that when $R_5$ and $R_6$ together form a 5- or 6-membered ring, $R_1$, $R_2$, $R_3$ and $R_4$ each does not represent an aromatic ring, and when $R_5$ and $R_6$ together form a benzene ring, at least one of t and u represents 1.

* * * * *